US012287172B2

(12) United States Patent
Searle et al.

(10) Patent No.: US 12,287,172 B2
(45) **Date of Patent: *Apr. 29, 2025**

(54) COMPOSITE CASE HAVING RETAINING BAG INCLUDING BEAD REFILL MECHANISM

(71) Applicant: GSTC LLC, Scottsdale, AZ (US)

(72) Inventors: Gideon P. Searle, Scottsdale, AZ (US); Theodore Bobrick Root, Jr., Charlotte, NC (US)

(73) Assignee: GSTC LLC, Scottsdale, AZ (US)

( * ) Notice: Subject to any disclaimer, the term of this patent is extended or adjusted under 35 U.S.C. 154(b) by 241 days.

This patent is subject to a terminal disclaimer.

(21) Appl. No.: 18/112,325

(22) Filed: Feb. 21, 2023

(65) Prior Publication Data

US 2023/0243619 A1 Aug. 3, 2023

Related U.S. Application Data

(63) Continuation-in-part of application No. 18/154,529, filed on Jan. 13, 2023, which is a continuation-in-part of application No. 17/897,951, filed on Aug. 29, 2022, now Pat. No. 11,635,278, which is a continuation of application No. 16/950,454, filed on Nov. 17, 2020, now Pat. No. 11,435,161, which is a continuation-in-part of application No. 16/697,265, filed on Nov. 27, 2019, now abandoned.

(Continued)

(51) Int. Cl.

| | |
|---|---|
| ***B65D 81/05*** | (2006.01) |
| ***B65D 81/107*** | (2006.01) |
| ***F41C 33/06*** | (2006.01) |

(52) U.S. Cl.

CPC ..... *F41C 33/06* (2013.01); *B65D 81/052* (2013.01); *B65D 81/1075* (2013.01)

(58) Field of Classification Search

CPC ..... A45C 13/021; A45C 13/026; A45C 13/02; A45C 13/008; A45C 2013/026; A45C 11/00; F41C 33/06; F41C 33/0209; F41C 33/02; B65D 81/1075; B65D 81/052; B65D 81/03; B65D 81/051; B65D 81/09; A47G 2400/083

USPC ..... 206/522, 317, 521, 523

See application file for complete search history.

(56) References Cited

U.S. PATENT DOCUMENTS

| | | | |
|---|---|---|---|
| 2,472,754 | A | 6/1949 | Mead |
| 3,074,543 | A | 1/1963 | Stanley |

(Continued)

FOREIGN PATENT DOCUMENTS

| | | | |
|---|---|---|---|
| CN | 107125891 | A | 9/2017 |
| CN | 209610140 | U | 11/2019 |

(Continued)

OTHER PUBLICATIONS

English translation of CN 107125891 (Year: 2021).

*Primary Examiner* — King M Chu
(74) *Attorney, Agent, or Firm* — NEO IP

(57) ABSTRACT

A protective carrying case for a firearm is disclosed, wherein the protective carrying case includes a top component, a bottom component, and semi-hexagonal ends, wherein the top component and the bottom component are constructed from carbon fiber. The protective carrying case additionally includes a retaining element with vacuum split functionality to retain elements within the case.

19 Claims, 63 Drawing Sheets

Related U.S. Application Data

(60) Provisional application No. 62/779,587, filed on Dec. 14, 2018.

(56) References Cited

U.S. PATENT DOCUMENTS

| | | | | |
|---|---|---|---|---|
| 3,515,267 | A | 6/1970 | Larocca et al. | |
| 4,702,029 | A | 10/1987 | DeVaul et al. | |
| 4,890,466 | A | 1/1990 | Cislo | |
| 5,009,318 | A | 4/1991 | Lepinoy | |
| 5,316,149 | A * | 5/1994 | Tate | B65D 81/09 53/472 |
| 5,351,830 | A * | 10/1994 | Bender | B65D 81/051 206/592 |
| 5,515,975 | A | 5/1996 | Jarvis et al. | |
| 5,788,078 | A | 8/1998 | Fuss | |
| 5,833,069 | A | 11/1998 | Jones | |
| 6,029,683 | A | 2/2000 | Moebs et al. | |
| 6,135,277 | A | 10/2000 | Armstrong | |
| 7,106,202 | B2 | 9/2006 | Dickinson | |
| 7,223,461 | B2 | 5/2007 | Kannankeril et al. | |
| 7,546,920 | B1 | 6/2009 | Horn et al. | |
| 8,783,776 | B1 | 7/2014 | Perkins | |
| 8,960,734 | B2 | 2/2015 | Camp | |
| 9,303,950 | B2 | 4/2016 | Fuller | |
| 9,429,389 | B1 | 8/2016 | Brewer | |
| 9,504,598 | B2 | 11/2016 | Mazzucchelli | |
| 9,803,956 | B2 | 10/2017 | Ellingson | |
| 9,955,763 | B2 | 5/2018 | McLean et al. | |
| 2003/0085140 | A1 | 5/2003 | Hagemann et al. | |
| 2003/0217948 | A1 | 11/2003 | Lantz | |
| 2004/0144664 | A1 | 7/2004 | Hammill | |
| 2004/0188302 | A1 | 9/2004 | Rogers, Jr. | |
| 2006/0054627 | A1 | 3/2006 | Youngs | |
| 2009/0032429 | A1 | 2/2009 | Morris et al. | |
| 2010/0329589 | A1 * | 12/2010 | Taira | B65D 81/03 206/521 |
| 2011/0088532 | A1 | 4/2011 | Klemp | |
| 2011/0259764 | A1 | 10/2011 | Sonoda et al. | |
| 2011/0278288 | A1 | 11/2011 | Fuller | |
| 2012/0006714 | A1 | 1/2012 | Kasiwabara | |
| 2012/0118691 | A1 | 5/2012 | Ribaut | |
| 2013/0193005 | A1 | 8/2013 | Hoeth | |
| 2013/0307280 | A1 | 11/2013 | Camp | |
| 2014/0048593 | A1 | 2/2014 | Hoganson | |
| 2014/0224699 | A1 | 8/2014 | Smith | |
| 2015/0152665 | A1 | 6/2015 | Camp | |
| 2016/0084614 | A1 | 3/2016 | Ellingson | |
| 2016/0198823 | A1 | 7/2016 | Bergreen et al. | |
| 2016/0209024 | A1 | 7/2016 | Sale | |
| 2016/0251124 | A1 | 9/2016 | Arnold et al. | |
| 2016/0286925 | A1 | 10/2016 | Fuller | |
| 2017/0231349 | A1 | 8/2017 | McLean et al. | |
| 2018/0038668 | A1 | 2/2018 | Ellingson | |
| 2018/0213906 | A1 | 8/2018 | McLean et al. | |
| 2018/0283053 | A1 | 10/2018 | McLean et al. | |
| 2020/0191522 | A1 | 6/2020 | Searle et al. | |
| 2021/0080224 | A1 | 3/2021 | Searle et al. | |

FOREIGN PATENT DOCUMENTS

| | | | | |
|---|---|---|---|---|
| GB | 1304004 | A | 1/1973 | |
| WO | 1995003974 | A1 | 2/1995 | |
| WO | WO-9503974 | A1 * | 2/1995 | B65B 55/20 |

* cited by examiner

COMPOSITE CASE HAVING RETAINING BAG INCLUDING BEAD REFILL MECHANISM

CROSS REFERENCES TO RELATED APPLICATIONS

This application is related to and claims priority from the following US patents and patent applications. This application is a continuation-in-part of U.S. patent application Ser. No. 18/154,529, filed Jan. 13, 2023, which is a continuation-in-part of U.S. patent application Ser. No. 17/897,951, filed Aug. 29, 2022, which is a continuation of U.S. patent application Ser. No. 16/950,454, filed Nov. 17, 2020 and issued as U.S. Pat. No. 11,435,161, which is a continuation-in-part of U.S. patent application Ser. No. 16/697,265, filed Nov. 27, 2019, which claims priority to and the benefit of U.S. Provisional Patent Application No. 62/779,587, filed Dec. 14, 2018, each of which is incorporated herein by reference in its entirety.

BACKGROUND OF THE INVENTION

1. Field of the Invention

The present invention relates to protective cases for carrying equipment, and more specifically to cases for shipping and/or transporting equipment.

2. Description of the Prior Art

It is generally known in the prior art to provide equipment cases. Cases often contain foam or other padding that secures equipment, cameras, apparatuses, weapons, attachments, and other components in place and protect them from damage during transport.

Prior art patent documents include the following:

U.S. Pat. No. 9,955,763 for Secure portable encasement system by McLean et al., filed Feb. 10, 2017 and issued Aug. 17, 2017, is directed to a system for providing securement of a plurality of secure portable encasements including one or more encasements each configured to engage, and subsequently disengage, inseparable interaction with a common docking unit; and one or more common docking units.

U.S. Pat. No. 9,803,956 for Electronic tablet case and firearm holder by Ellingson, filed Mar. 24, 2016 and issued Oct. 31, 2017 is directed to an electronic tablet case capable of concealing a firearm. The case is formed from a housing having closeable panels that are hingedly connected, defining an interior and exterior. The exterior of one of the panels includes mounting elements for securing to an electronic tablet. The interior of one panel includes at least one support element for holding a firearm in position. The panels can be secured together by use of a zipper, hook & loop or the like fastener.

U.S. Pat. No. 9,303,950 for Lockable cut-resistant case by Fuller, filed Nov. 17, 2011 and issued Apr. 5, 2016 is directed to a light-weight case is provided that is cut-resistant, fire-resistant and/or water-proof and that can be easily locked and fasten to stationary objects. The exterior of the case is substantially cut-resistant, while the interior layers can be layers that are fire-resistant, water-proof, any type of padding or nylon for protecting the objects stored in the case. To protect the case from being stolen, a steel cable is threaded through a hole formed by two concentrically aligned grommets and locked to or around a stationary object. The cases include a Global Positioning System (GPS) transmitter that is able to track the location of the case if the case happens to be lost or stolen. The case can be sized and shaped to hold any type of valuable objects, such as guns, jewelry and money.

U.S. Pat. No. 9,429,389 for Multifunctional cases with locking mechanisms by Brewer, filed Jul. 29, 2015 and issued Aug. 30, 2016 is directed to a multifunctional case that can be used for protecting and preventing unauthorized use of different types and sizes of objects, weapons, firearms, or other items. In one embodiment, the multifunctional case includes a first shell and a second shell that is coupled to the first shell. A locking mechanism is coupled to the first shell. An external handle (e.g., handle that is external to the multifunctional case) is coupled to the locking mechanism and causes the locking mechanism to lock and unlock the first and second shells of the multifunctional case based on movement of the handle. The multifunctional case is securely locked and unlocked with no external clips or latches.

U.S. Pat. No. 6,135,277 for Vacuum resealable display/storage case by Armstrong, filed Apr. 10, 1998 and issued Oct. 24, 2000 is directed a portable airtight inner case (W, Z) including a receptacle (121) for having an item stored therein, for example a guitar (105), a hingedly mounted cover (11, 111) and a perimetric seal (39) to form a fluid seal between the cover (11, 111) and receptacle (121) when the cover is closed. The inner case cover and receptacle are made of a clear rigid plastic. A suction valve or pump (50, 130) opens to the inner case interior to evacuate fluid while a vacuum gauge (53) is provided for measuring the pressure. The inner case bottom wall (32, 117) has a plurality of pockets (74, 148) for having hangers extended therein to hang the case on a wall and stand pockets (142) to have stand parts of a foldable stand (85) extended therein or a stand (144) pivoted to the bottom wall to support the inner case (W, Z) in an inclined condition. A portable outer case (X, 170) has a compartment for containing the inner case.

SUMMARY OF THE INVENTION

The present invention relates to a equipment case, and more particularly to a case for transporting and shipping equipment. A carbon fiber shell is utilized for the exterior of the case. The case is preferably octagonal in shape, with the exterior of the case including chamfered sides and corners and hexagonal ends to mitigate the effects of impact on the case. Latches which include a stem and a housing with a pushbutton release mechanism for releasing the housing from the stem are utilized to open and close the case. The latches further include an integrated key-locking mechanism, thereby providing for additional security during transport. Insulating and cushioning layers are provided to protect the contents of the case from temperature and the effects of impact during transport. The case also preferably includes components which indicate that a predetermined humidity level has been reached, biometric components for unlocking the case, and a Global Positioning System tracking component synced to an electronic device of a user of the case such as a smart phone or a tablet. The present invention further includes at least one retaining element with microbeads, wherein the at least one retaining element employs vacuum splint functionality to retain elements in a customizable, secure manner.

It is an object of this invention to provide a equipment case suitable for shipping and transport of equipment. Prior art cases and the contents of these cases are prone to damage when handled by baggage handlers at airports and shipping agencies such as USPS, FEDEX, UPS, etc. Additionally, when shipped or transported, equipment cases are often in environments where temperature and humidity may cause damage to the equipment. Prior art cases are also prone to be lost at airports or lost in the mail. The present invention solves these prior art problems by providing equipment and protecting the equipment from extreme temperatures, components which indicate a heightened humidity inside the equipment case, and a GPS tracker to provide for tracking the location of the equipment case.

These and other aspects of the present invention will become apparent to those skilled in the art after a reading of the following description of the preferred embodiment when considered with the drawings, as they support the claimed invention.

DETAILED DESCRIPTION

Figure 1:
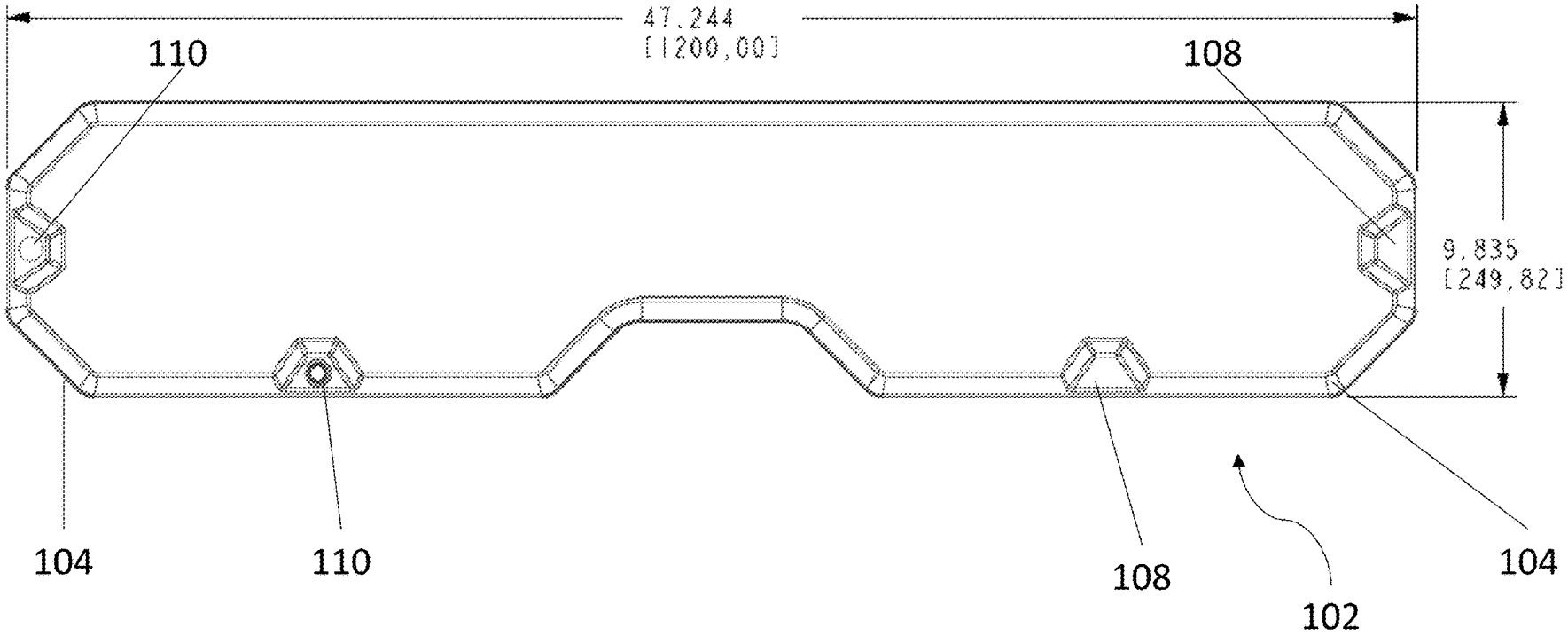
FIG. 1 illustrates a front orthogonal view of the exterior shell of an equipment case with recesses on the front of the exterior shell according to one embodiment of the present invention.

The present invention is generally directed to cases for transporting and shipping equipment.

None of the prior art discloses an equipment case utilizing a latch which includes a stem and a housing with a push-button release mechanism for releasing the housing from the stem, a carbon fiber exterior shell, chamfered sides and corners, hexagonal edges, biometric locks, a GPS tracking component, and at least one retaining element with vacuum splint functionality.

It is an object of this invention to provide an equipment case suitable for shipping and transport of equipment. Prior art cases and the contents of these cases are prone to damage when handled by shipping agencies and baggage handlers. Additionally, when shipped or transported, equipment cases are often in environments where temperature and humidity may cause damage to the equipment. Prior art cases are also prone to be lost at airports or lost in the mail. The present invention solves these prior art problems by providing a case constructed out of a carbon fiber shell with insulating, protective layers for cushioning the equipment and protecting the equipment from extreme temperatures, dehumidifiers to regulate the humidity inside the equipment case, and a GPS tracker to provide for tracking the location of the equipment case.

Although the case is primarily referred to as a "equipment case" throughout the specification, the present invention is also operable for protecting and transporting other objects. In particular, the case is also operable for transporting and shipping sporting goods, musical instruments, cameras, scientific instruments, equipment, collectibles, art, etc.

Referring now to the drawings in general, the illustrations are for the purpose of describing one or more preferred embodiments of the invention and are not intended to limit the invention thereto.

FIG. 1 illustrates a front orthogonal view of the exterior shell of an equipment case with recesses on the front of the exterior shell according to one embodiment of the present invention. The body of the case is an extended octagon shape and includes an exterior shell 102 with hexagonal (i.e., semi-hexagonal) ends 104. The exterior shell 102 is preferably formed of three layers. The outermost layer and the innermost layer of the exterior shell 102 are preferably formed of carbon fibers, and more preferably 3K carbon fibers. The middle layer of the exterior shell 102 is preferably an insulating material such as polystyrene (e.g. STYROFOAM), one or more thermoplastics, one or more thermosets, fiberglass, cellulose, NOMEX, polystyrene, polyurethane, and combinations thereof. Each of the outermost layer and the innermost layer of the exterior shell 102 is preferably about 0.03048 cm (about 0.012 inches) thick. In one embodiment, the shell is constructed from carbon fiber (with fibers being externally visible) with the addition of internal or external strips of any of the preceding middle layer materials. For example, in one embodiment, the shell is constructed completely from carbon fiber with horizontally or vertically aligned strips or sheets of a meta-aramid material, such as honeycomb-shaped NOMEX, embedded within one or more layers of the shell. Preferably, the shell is laid up with epoxy impregnated 3K carbon fiber with a 2×2 twill weave and is cured for approximately 4 hours at 225 degrees Fahrenheit. After initial curing, a piece of core (e.g., ⅛-inch thick NOMEX with a ⅛-inch honeycomb cell size) is embedded or attached to the shell. The carbon fiber notably adds stiffness to the case to prevent lateral torsion, while the core provides for strength while maintaining slight flexibility. In other embodiments, the case is constructed with alternative materials and cores that provide a similarly tough but flexible construction. The shell, in one embodiment, is in contact with, is manufactured with, or integrally includes one or more layers for padding, durability, strength, and/or flexibility, including any of the prior mentioned materials. In another embodiment, the outermost layer and the innermost layer are about 0.127 cm (about 0.05 inches) thick. The middle layer of the exterior shell 102 is preferably about 0.635 cm (about 0.25 inches) thick. Alternatives to 3K carbon fibers include 1K, 2K, 6K, 12K, 24K, or 48K carbon fibers. In another alternative, unidirectional carbon fibers are used in the exterior shell. Hybrid composites which include carbon fibers and high molecular-weight polypropylene, polyethylene, and/or other thermoplastics or thermosets are utilized in another alternative. An example of a hybrid composite is INNEGRA manufactured by INNEGRA TECHNOLOGIES. Carbon fibers are also blended with steel fibers or other metal fibers to form one or more layers of the exterior shell in one embodiment of the present invention. In yet another embodiment, any of the above recited materials are utilized in any combination and in any number of layers to form the exterior shell 102 of the case. For example, in one embodiment, any component of the case, including a top component, a bottom component, or an interior component, is operable to be constructed from poly-para-phenylene terephthalamide (i.e. KEVLAR), carbon fiber, and/or hybrids or combinations of Kevlar, carbon, and/or natural or synthetic fibers.

The hexagonal ends 104 of the case absorb forces caused by impact to the case, such as when the case is dropped, jostled, or thrown by baggage handlers at an airport. Although the ends depicted in FIG. 1 are hexagonal ends (i.e. three sides per end), ends with any amount of sides including octagonal ends (i.e. four sides per end) and decagonal ends (i.e. five sides per end) are alternatively utilized. In another embodiment, the ends are rounded, circular shaped, or oval shaped.

As illustrated in FIG. 1, the outer edge or sides of the exterior shell 102 is chamfered to mitigate effects from impact on the contents of the case. The outer edge or sides of the exterior shell 102 are alternatively beveled or are formed with a rounded convex surface. In one embodiment, the exterior shell 102 includes a honeycomb relief pattern which provides texture to the case. Each honeycomb is between about 1-4 mm in diameter. Preferably, the case includes at least one layer of carbon fiber or carbon fiber-reinforced materials, such as carbon fiber-reinforced aluminum. Other geometric patterns are utilized in other embodiments, including rectilinear or spiralized relief patterns. Advantageously, the relief patterns disperse the forces of impact across a greater surface area and reduce the amount of force the case experiences from impact compared to surfaces without relief patterns. Relief patterns also cause the case to appear more like luggage than an equipment case, which increases the security of the equipment case. The exterior shell 102 of FIG. 1 has a length of about 120.00 cm (about 47.244 inches) and a width of about 24.982 cm (about 9.835 inches).

The exterior shell 102 is operable to be manufactured using any method known in the art, including but not limited to, vacuum molding, vacuum forming, infusion including vacuum infusion, and extrusion.

Figure 30:
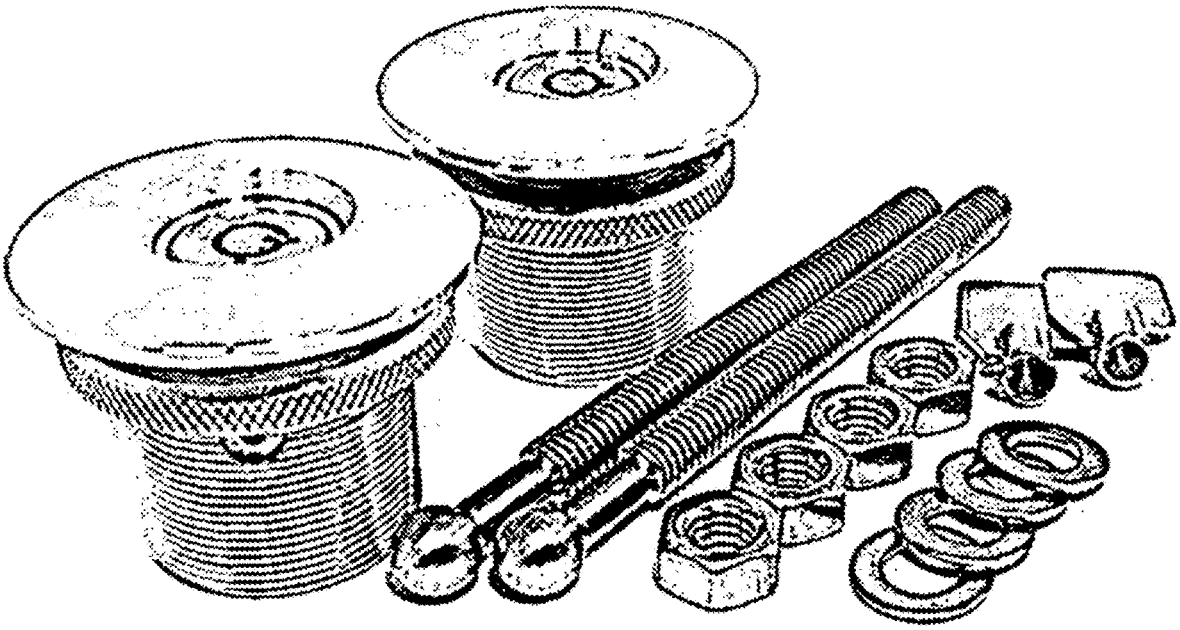
FIG. 30 illustrates one view of latch components and latches with integrated mechanical key lock mechanisms according to one embodiment of the present invention.
Figure 31:
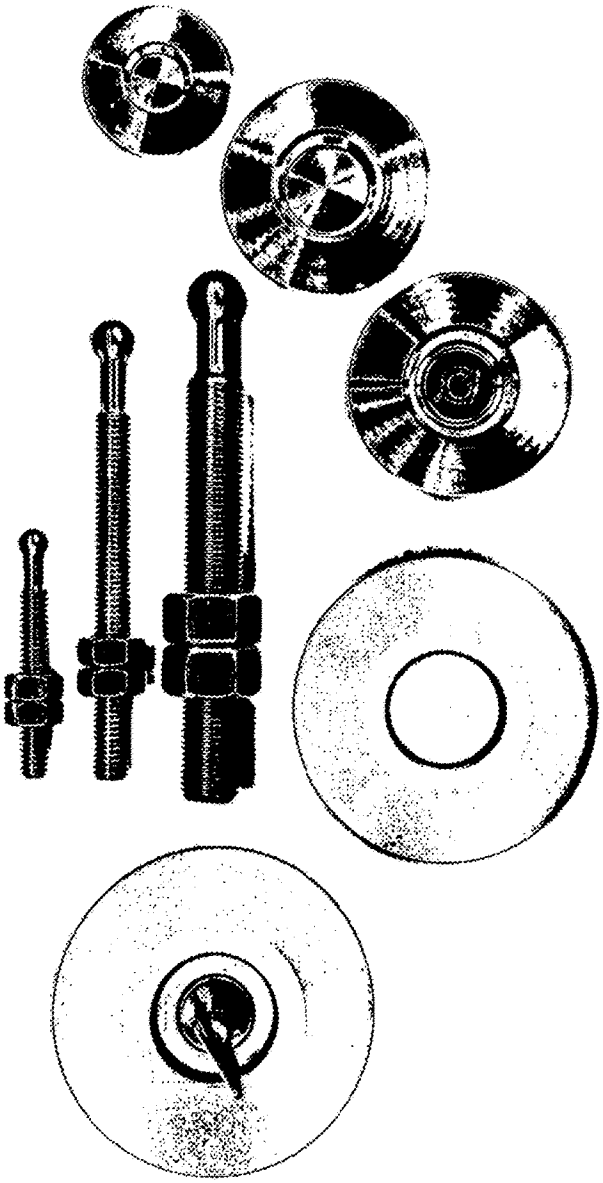
FIG. 31 illustrates another view of latch components and latches with integrated mechanical key lock mechanisms according to one embodiment of the present invention

The recesses 108 included in the front of the exterior shell in FIG. 1 provide openings in the exterior shell for insertion of latch or lock components. A variety of removable locks are operable to be inserted into the recesses, including padlocks. FIG. 1 illustrates latches 110 installed in the recesses which are utilized to close the equipment case. In a preferred embodiment, the latches include Mini Quik-Latches QL-25-SB sold by QUIK-LATCH DISTRIBUTION and described in U.S. Pat. No. 8,960,734, which is hereby incorporated by reference in its entirety. The upper portion of the housing of the latch is operable to have diameters of 1.25 inch (32 mm), 1.50 inch (38.1 mm), 1.0 inch (25.4 mm), 0.875 inch (22 mm), or any other diameter. The diameter of the threaded portion of the housing of the latch is 0.75 inch (19.05 mm) in one embodiment, and the length of the housing of the latch is 0.57 inches (15 mm). By way of example, the length of mounting stud is 2.13 inches (54 mm). The Mini Quik-Latches preferably include a mechanical key lock with a corresponding key which functions to lock and unlock the case. In one embodiment, the Mini Quik-Latches with a mechanical key lock are QL-38 Series Lockable Hood Pin Kits. These lockable latches have the following specifications in one embodiment: Materials: 6061 T6 Aluminum/303 Stainless Steel; Holding Force: 226.796 kg (100 lbs) per latch; Weight: 0.133243 kg (about 4.7 ounces); Height: 1.50 inch (38 mm); Height Below Mounting Flange: 1.375 inch (35 mm); OD of the latch mounting flange: 1.75 inch (44.5 mm); Thread size of latch body: 1⅛×24 UNEF; Hole size required to mount latch: 1.25 inch (32 mm); Pin dimensions: ⅜" ball with ⅜×24 thread; Retaining Ring: 1.50 inch (38 mm) OD×0.25 inch (6.4) thickness; Minimum distance from top of mounting surface to mounting point: 1.125 inch (28.50 mm); Maximum distance from top of mounting surface to mounting point: 3.50 inch (88 mm); Maximum mounting angle: 18 degrees; and Distance needed to engage pin into latch: 0.687 inch (17.5 mm). The latches preferably lock through the use of a tumbler lock cylinder held within a spring-loaded detention mechanism. FIGS. 30-31 illustrate the latch components utilized in the latches and latches with integrated mechanical key lock mechanisms according to one embodiment of the present invention.

Alternatively, other latches which include a stem and a housing with a pushbutton release mechanism for releasing the housing from the stem are also utilized. In other embodiments, spring-loaded latches, bolt latches, draw latches, tension latches, and/or magnetic latches are utilized.

The case preferably includes threaded openings for the latches which include a stem and a housing according to one embodiment of the present invention. The threaded openings are created during manufacture of the exterior shell 102 in one embodiment. Alternatively, the threaded openings are created after manufacture of the exterior shell 102 using a threading hand tool or a drill.

Figure 23:
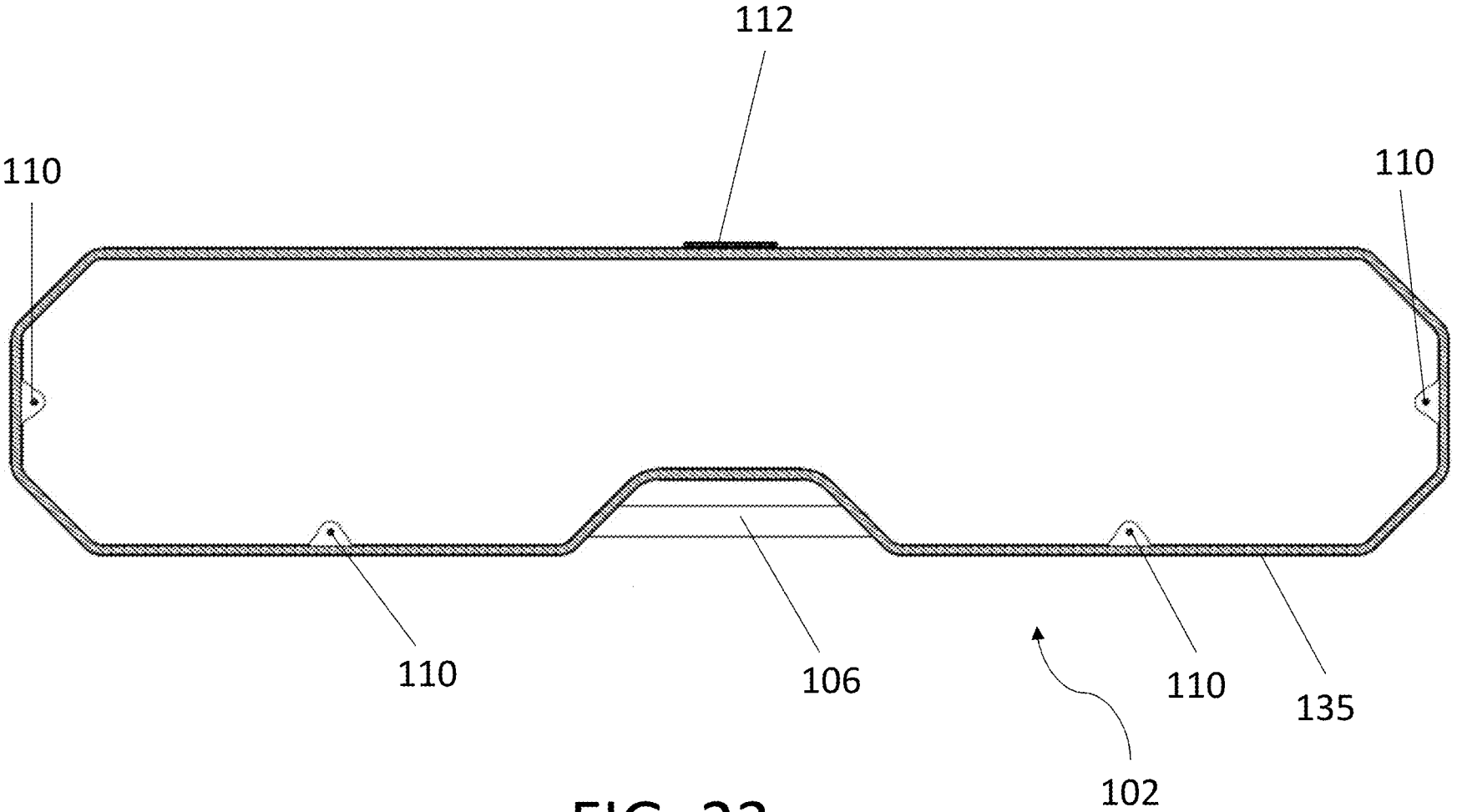
FIG. 23 illustrates a front orthogonal view of an equipment case showing the bezel according to one embodiment of the present invention.

FIG. 23 illustrates a front orthogonal view of an equipment case showing the bezel 135 according to one embodiment of the present invention. The bezel includes a top portion and a bottom portion, with a gasket between the top portion and the bottom portion to make the case watertight.

FIGS. 24-27 illustrate various views of the equipment case including the top portion of the bezel 136, the bottom portion of the bezel 140, the gasket 138, and latches incorporated into the openings, with the latches including a stem 116 and a housing 118 with a pushbutton release mechanism 120 for releasing the housing 118 from the stem 116. The stem 116 preferably incudes an elongated portion and a rounded head portion for engaging with the housing 118. In one embodiment, the latches are Mini-Quik Latches. The latch components including the stem 116 and the housing 118 are preferably threaded into the case through threaded openings in the exterior shell 102. Alternatively, the latch components are secured to the case via any other method of physical and/or chemical attachment, including any other type of mechanical fastener and/or adhesive. Washers 122 are included between the top of the shell and the bottom of the pushbutton latching component to provide a watertight seal between the latch components and the case. The washers 122 are preferably formed of rubber. The stem 116 also includes a locking nut 128 that connects to the threaded portion of the stem 116 to lock the stem 116 in place in the case.

Figure 26:
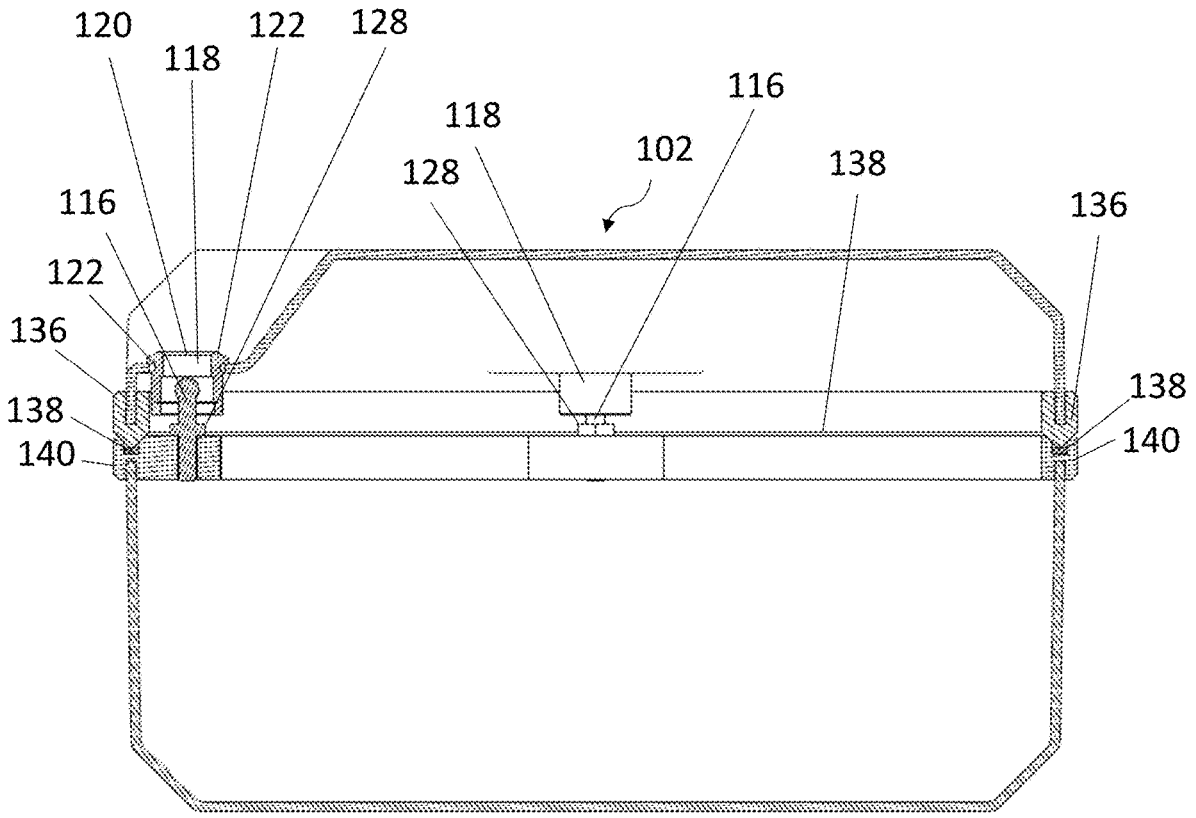
FIG. 26 illustrates a transparent end orthogonal view of an equipment case showing latches, a bezel, and a gasket according to one embodiment of the present invention.
Figure 27:
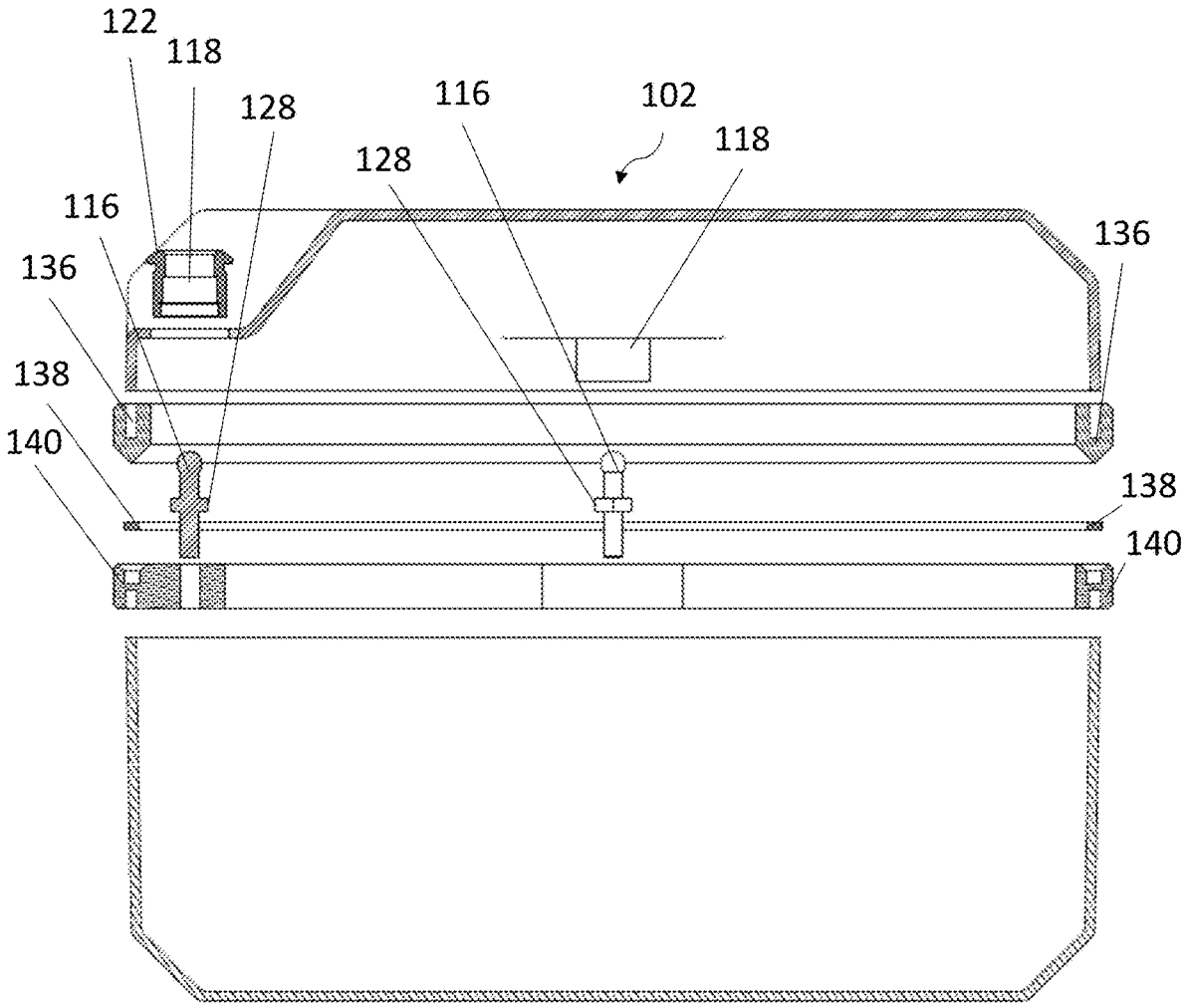
FIG. 27 illustrates a transparent exploded end orthogonal view of an equipment case showing latches, a bezel, and a gasket according to one embodiment of the present invention.

FIGS. 26-27 also illustrate the top portion of the bezel 136, the gasket 138, and the bottom portion of the bezel 140 of the case. The top portion of the bezel 136 and the bottom portion of the bezel 140 are preferably formed of plastic, including by way of example, thermoplastics, thermosets, and/or polymers. The top portion of the bezel 136 and the bottom portion of the bezel 140 are preferably extruded and custom designed. The top portion of the bezel 136 has a V-shape when viewed orthogonally or when viewing a cross section of the top portion of the bezel 136, and fits around the perimeter of the top portion of the exterior shell 102. The pointed section of the V-shaped top portion of the bezel 136 causes the gasket 138 to be pushed into the bottom portion of the bezel 140 when the case is closed. Importantly, the gasket 138 is utilized between the top portion of the bezel 136 and the bottom portion of the bezel 140 to protect the contents of the case. Preferably, the gasket 138 is formed of silicone, polyvinylchloride (PVC), neoprene, foam, ethylene propylene diene monomer (EPDM), or rubber, and inclusion of the gasket 138 makes the case waterproof. The pointed section of the V-shaped top portion of the bezel 136 also fits into the bottom portion of the bezel 140, serving to hold the gasket 138 in place and thereby providing a watertight seal around the case. The top portion of the bezel 136 and the bottom portion of the bezel 140 are preferably deeper, i.e. protrude more into the interior of the case at the location of the latches to prevent twisting or racking if one of the latches is left in the locked and/or locked position and the user tries to open the case. The bottom portion of the bezel 140 includes openings for the stems 116 of the latches. In one embodiment, these openings are threaded.

Additionally or alternatively, other locks are integrated into the case. Examples of these locks include integrated latch-key locks, integrated combination locks, and integrated biometric locks. Biometric locks include by way of example and not limitation, physiological biometric locks such as fingerprint recognition locks, facial recognition locks, iris recognition locks, hand recognition locks, etc. and behavioral biometric locks which are activated by voice recognition, etc.

Figure 24:
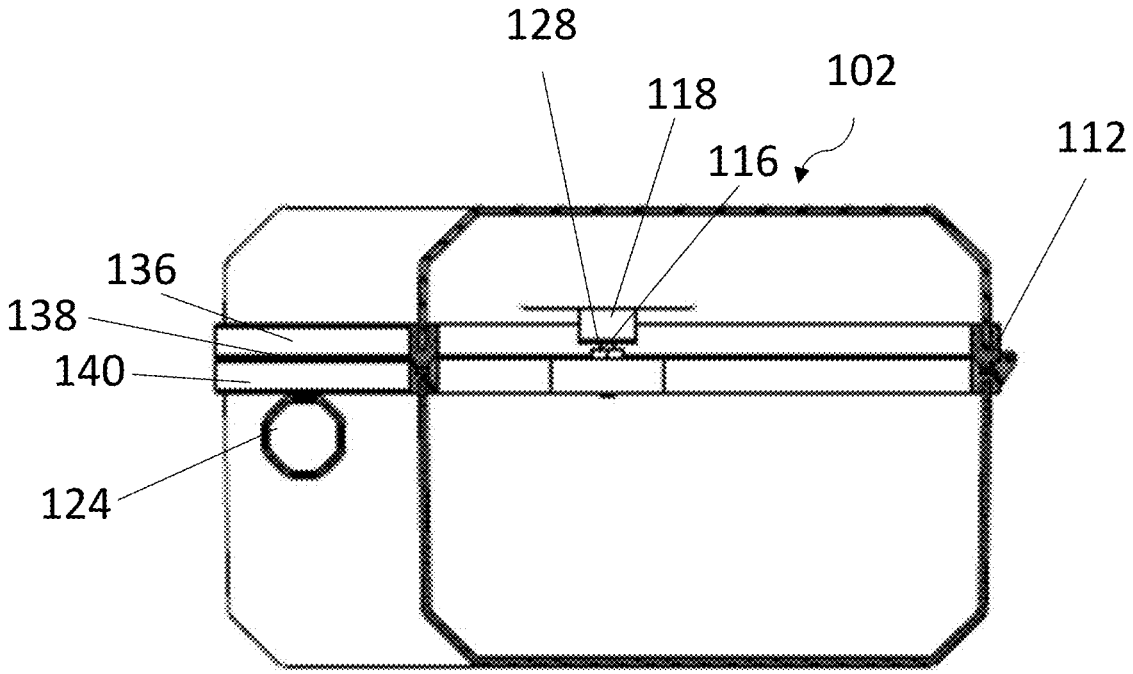
FIG. 24 illustrates a transparent perspective end view of an equipment case showing a latch, a bezel, a gasket, and a bracket mounted to the interior of the case according to one embodiment of the present invention.
Figure 25:
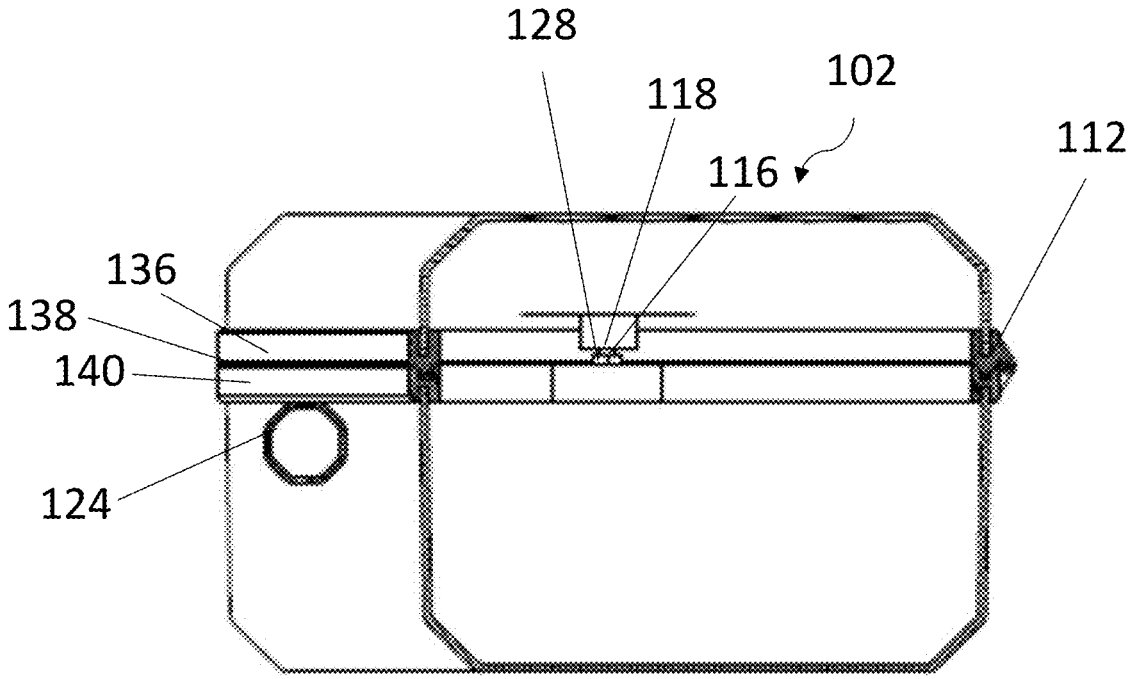
FIG. 25 illustrates another transparent perspective end view of an equipment case showing a latch, a bezel, a gasket, and a bracket mounted to the interior of the case according to one embodiment of the present invention.

Brackets are mounted to the interior of the case in another embodiment, and include a pivot pin to enable the bracket to swing out when a padlock or other type of attachable lock is utilized to lock the case. FIGS. 24-25 illustrate a bracket 124 mounted to the interior of the case according to one embodiment of the present invention.

The recesses 108 are reinforced with a layer of an aramid such as NOMEX or a synthetic aromatic hydrocarbon polymer such as polystyrene between the carbon fiber layers. For recesses 108 that receive removable locks such as padlocks, the recesses 108 include reinforcement around the inner perimeter of the recesses 108 formed of carbon fiber, hybrid composites which include carbon fibers, blends of carbon fibers and metal fibers, and/or any other material used in the exterior shell 102 or for reinforcing the recesses 108. The sides of the recesses 108 are preferably trapezoidal shaped and are chamfered, beveled, or otherwise slanted. Alternatively, the sides of the recesses are vertical and perpendicular with respect to the base of the recess 108. In one embodiment, four recesses are included to enable a user of the case to lock the case in four locations. Recesses are operable to be included in any location on the case, but are preferably included in the front of the exterior shell 102 of the case. Preferably recesses are formed during manufacture of the exterior shell 102. In one embodiment, the exterior shell 102 is formed via vacuum molding and the recesses are a part of the fiberglass mold used in the vacuum molding process. The pre-impregnated carbon fiber is inserted into the fiberglass mold and vacuum molded. By way of example, the carbon fiber is pre-impregnated with resin such as an epoxy. Manufacturing the exterior shell 102 via vacuum molding is advantageous over prior art methods of manufacture because vacuum molding produces a uniform exterior shell with uniform or substantially uniform rigidity throughout the shell. Notably, the recesses 108 shield the latches 110 and/or locks from any direct impact should the case be dropped, thrown, or mishandled. Additionally, the recesses 108 provide clear visual indication to the user where the latches 110 and/or locks are located on the case. The recesses 108 are formed in the center on the straight edge of the hexagonal ends and halfway between the hexagonal end and the recessed portion of the exterior shell through which the handle is attached. Placing the recesses 108 in these locations provides the maximum level of compressive strength when shut and mitigates added weight to the case. Furthermore, the recesses 108 differentiate the case in appearance from other equipment cases and help to make the case less conspicuous as an equipment case. Creating an equipment case which does not appear to be an equipment case improves the security of the case by deterring theft, unwanted attention, and scrutiny.

In one embodiment, at least one component of the case is formed from an aramid (e.g., Kevlar®, Twaron®), an ultra-high-molecular-weight polyethylene fiber (UHMWPE) (e.g., Spectra®, Dyneema®), a polycarbonate (e.g., Lexan®), a carbon fiber composite material, ceramic, steel, and/or titanium.

Figure 2:
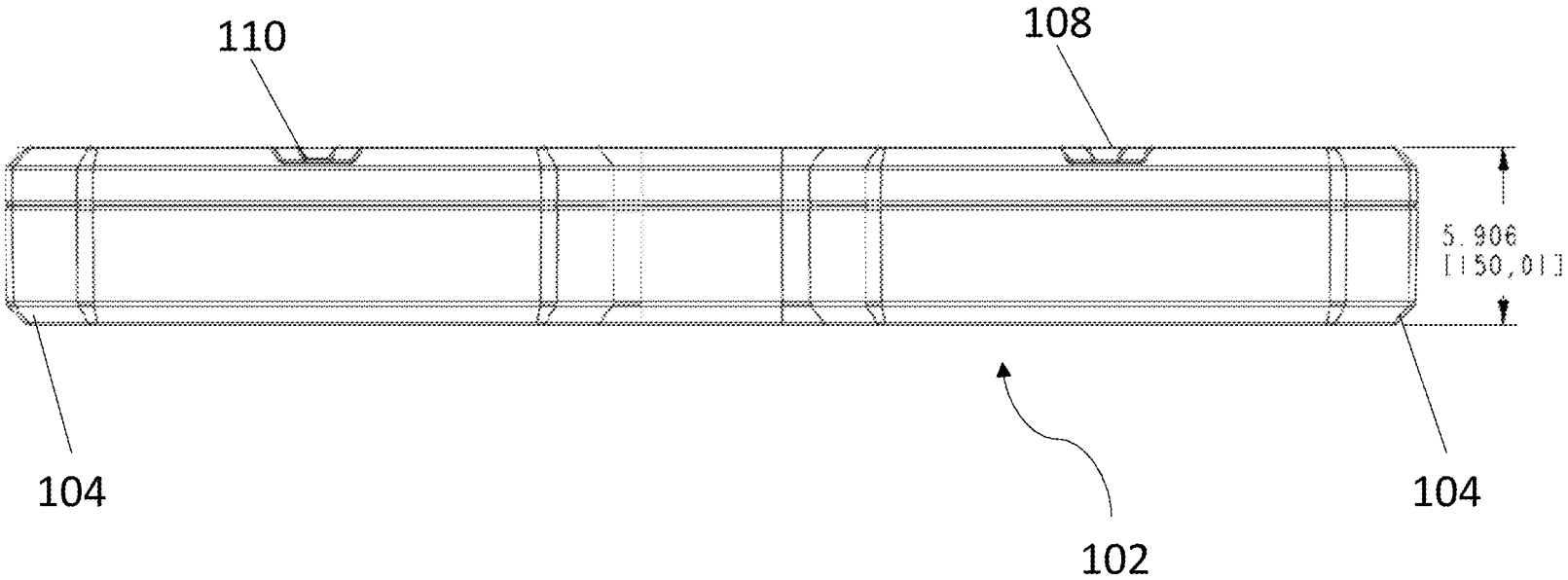
FIG. 2 illustrates a top orthogonal view of the exterior shell of an equipment case with recesses on the front of the exterior shell according to one embodiment of the present invention.
Figure 3:
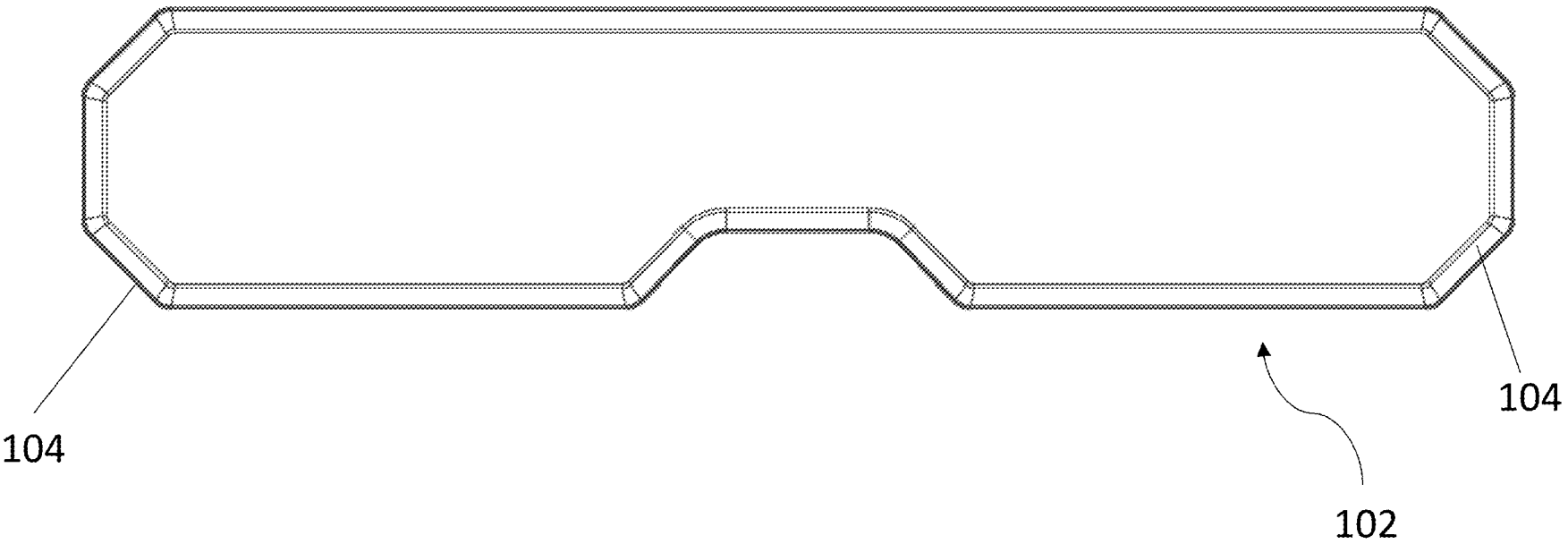
FIG. 3 illustrates a back orthogonal view of the exterior shell of an equipment case with recesses on the front of the exterior shell according to one embodiment of the present invention.
Figure 4:
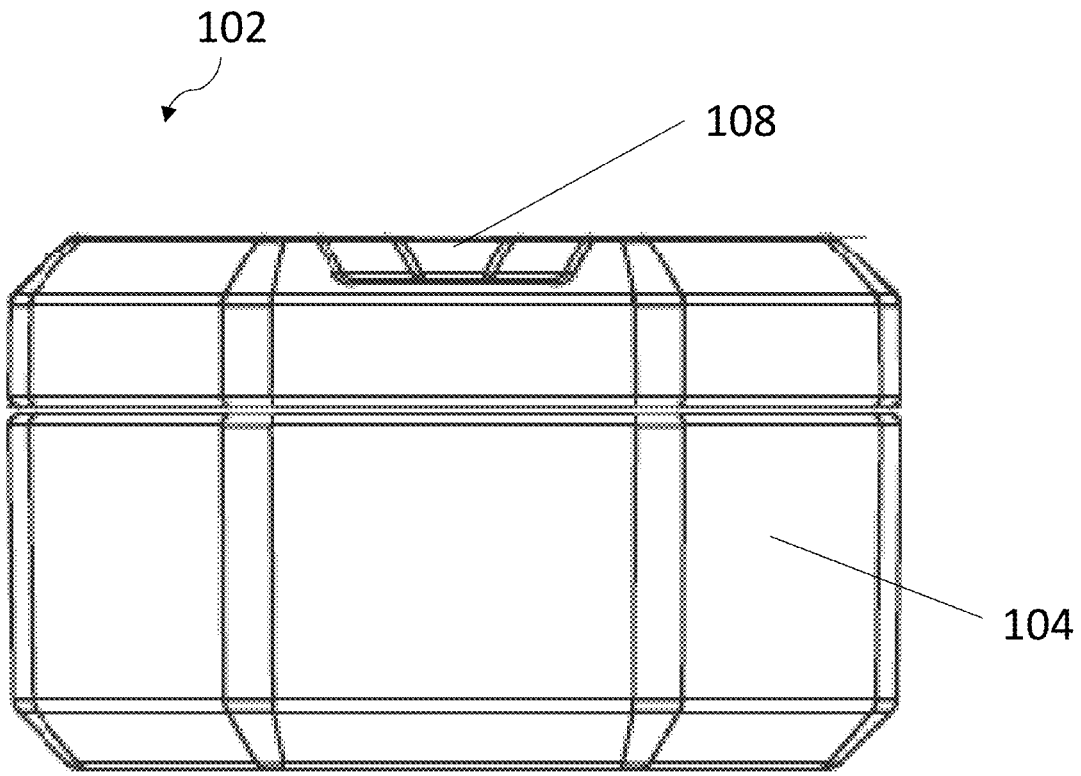
FIG. 4 illustrates an end orthogonal view of the exterior shell of an equipment case with recesses on the front of the exterior shell according to one embodiment of the present invention.
Figure 5:
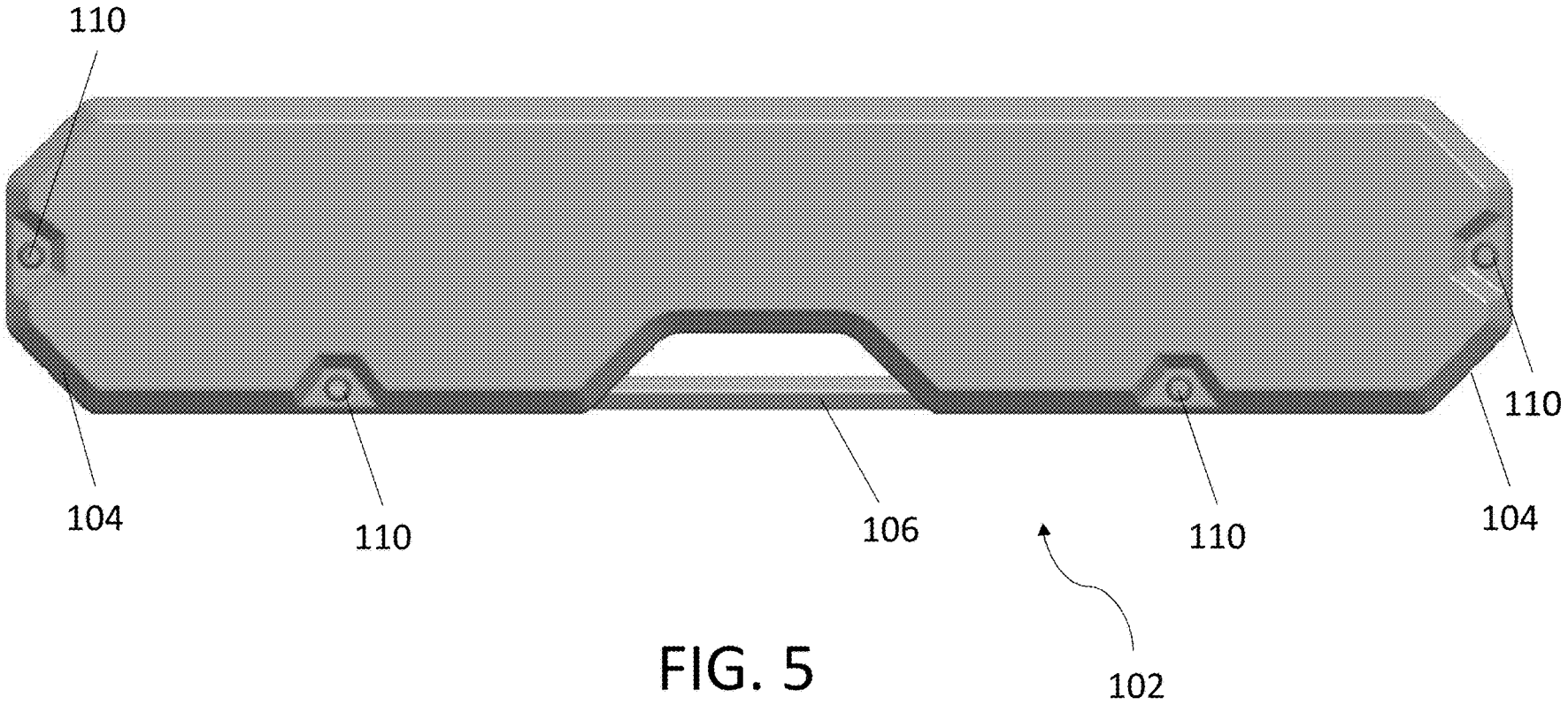
FIG. 5 illustrates a front orthogonal view of an equipment case with recesses on the front of the exterior shell according to one embodiment of the present invention.
Figure 6:
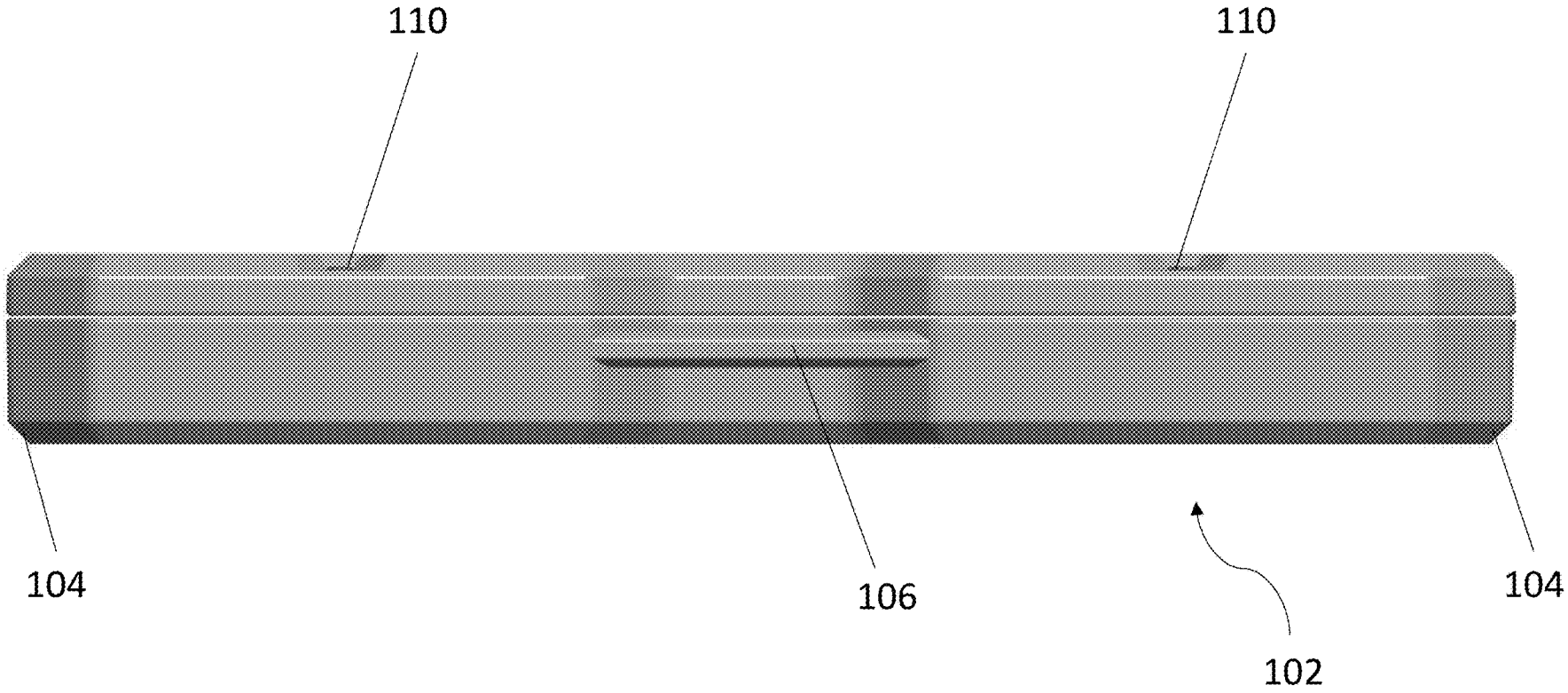
FIG. 6 illustrates a top orthogonal view of an equipment case with recesses on the front of the exterior shell according to one embodiment of the present invention.
Figure 7:
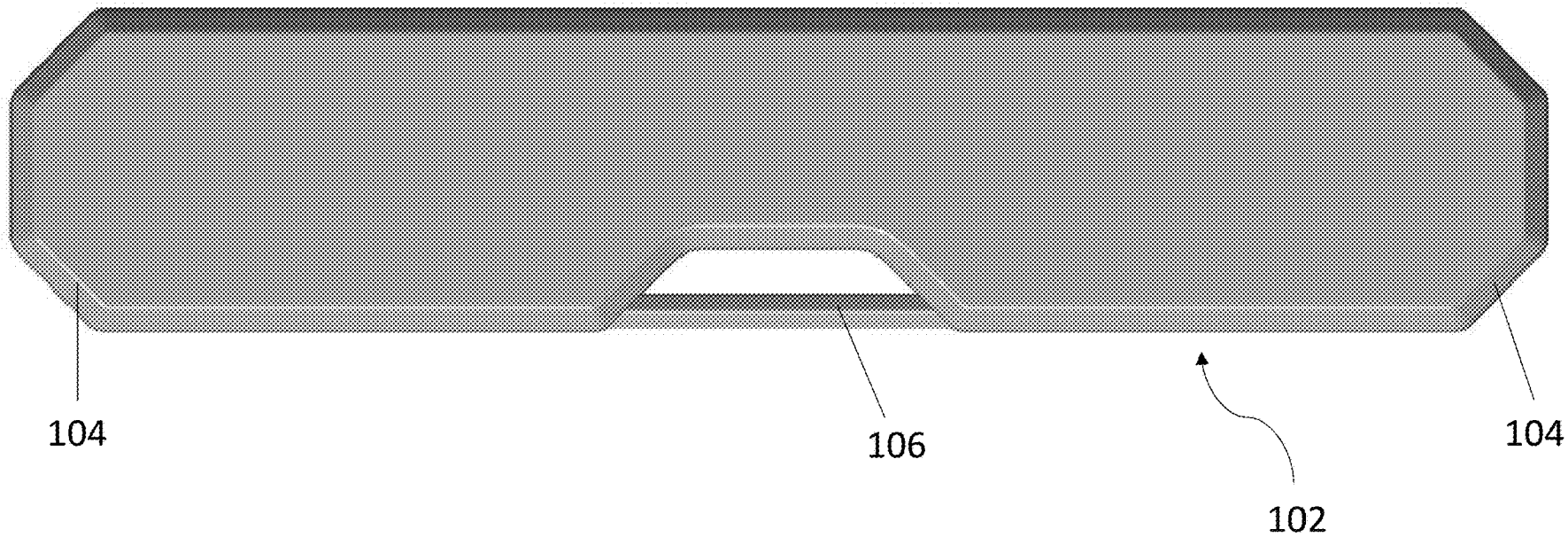
FIG. 7 illustrates a back orthogonal view of an equipment case with recesses on the front of the exterior shell according to one embodiment of the present invention.
Figure 8:
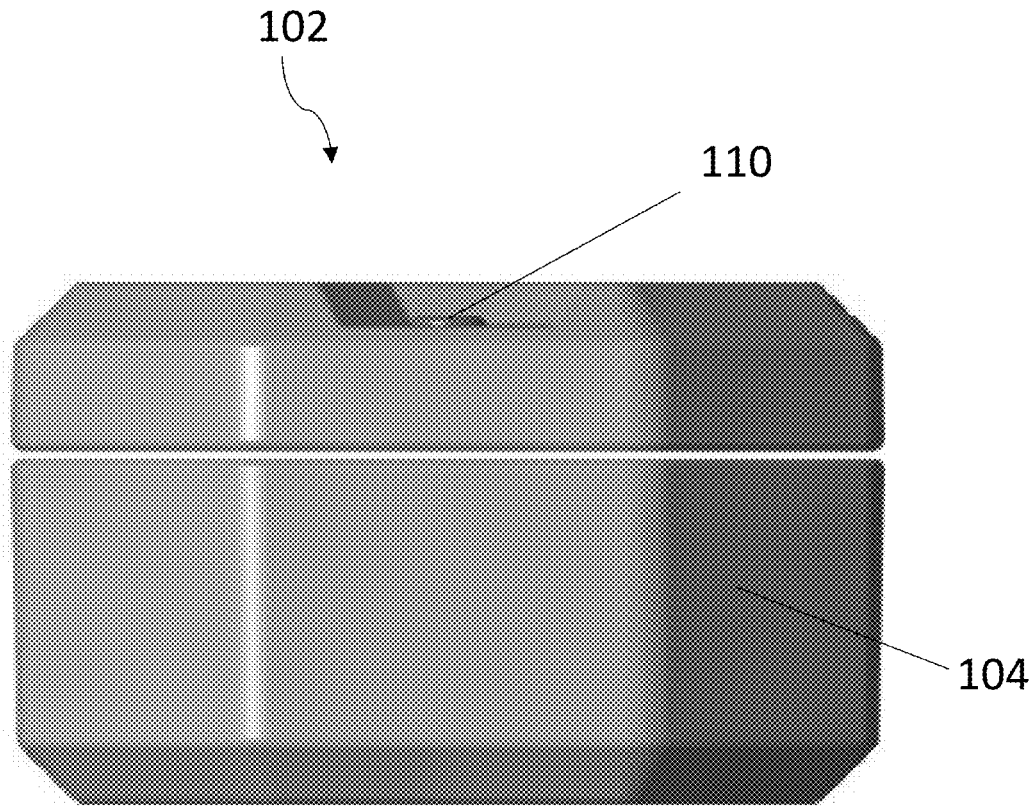
FIG. 8 illustrates an end orthogonal view of an equipment case with recesses on the front of the exterior shell according to one embodiment of the present invention.
Figure 9:
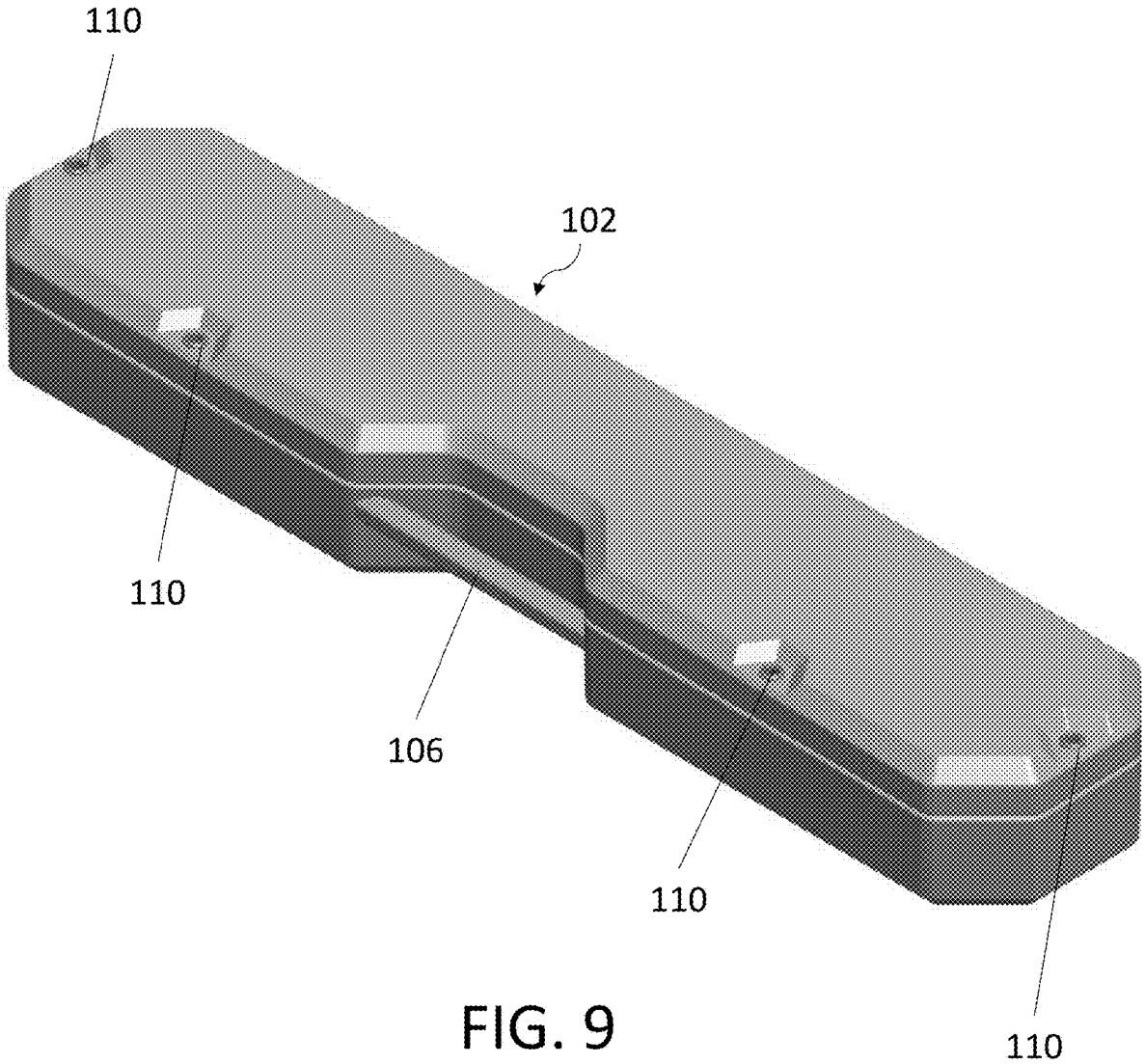
FIG. 9 illustrates a front perspective view of an equipment case with recesses on the front of the exterior shell according to one embodiment of the present invention.
Figure 10:
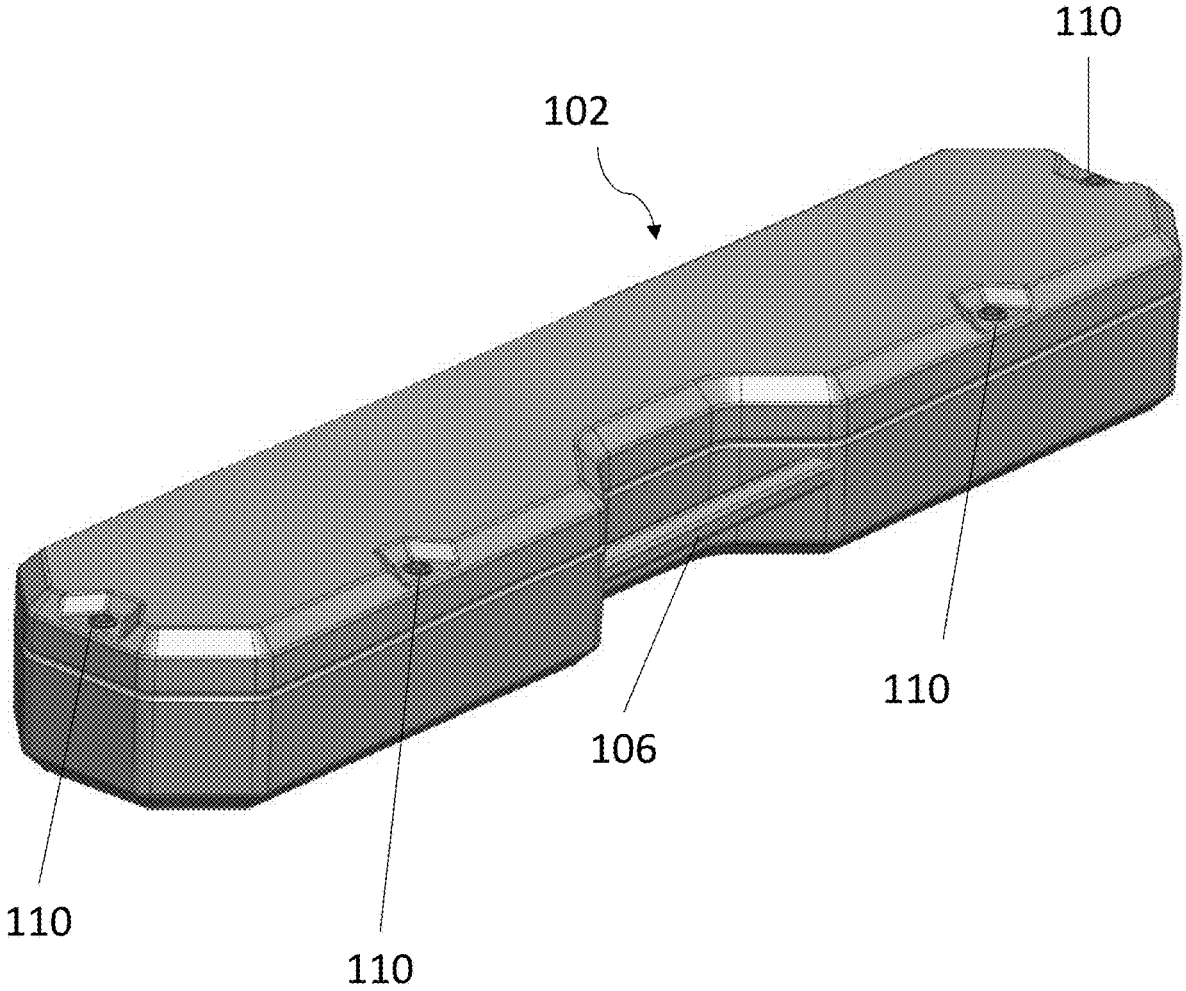
FIG. 10 illustrates another front perspective view of an equipment case with recesses on the front of the exterior shell according to one embodiment of the present invention.

FIGS. 2-3 illustrate a top orthogonal view and a back orthogonal view, respectively, of the exterior shell 102 of an equipment case with recesses on the front of the exterior shell according to one embodiment of the present invention. The exterior shell 102 of the equipment case shown in FIG. 2 has a depth of about 15.00 cm (about 5.906 inches). As shown in the end perspective view of FIG. 4, the height of the recess 108 is slightly less than the distance of the chamfered section of the front of the exterior shell 102 or is substantially equal to the distance of the chamfered section of the front of the exterior shell 102.

FIGS. 5-10 illustrate various views of an equipment case with latches 110 on the front of the exterior shell 102 according to one embodiment of the present invention. The case of FIG. 5 includes four latches 110 and a handle 106 which is constructed of strong, lightweight material such as carbon fiber or titanium pipe and is secured to the case through a void in the case. The handle 106 is alternatively constructed out of any material utilized in the exterior shell 102 of the case including but not limited to hybrid composites and blends of carbon and metal fibers.

Figure 11:
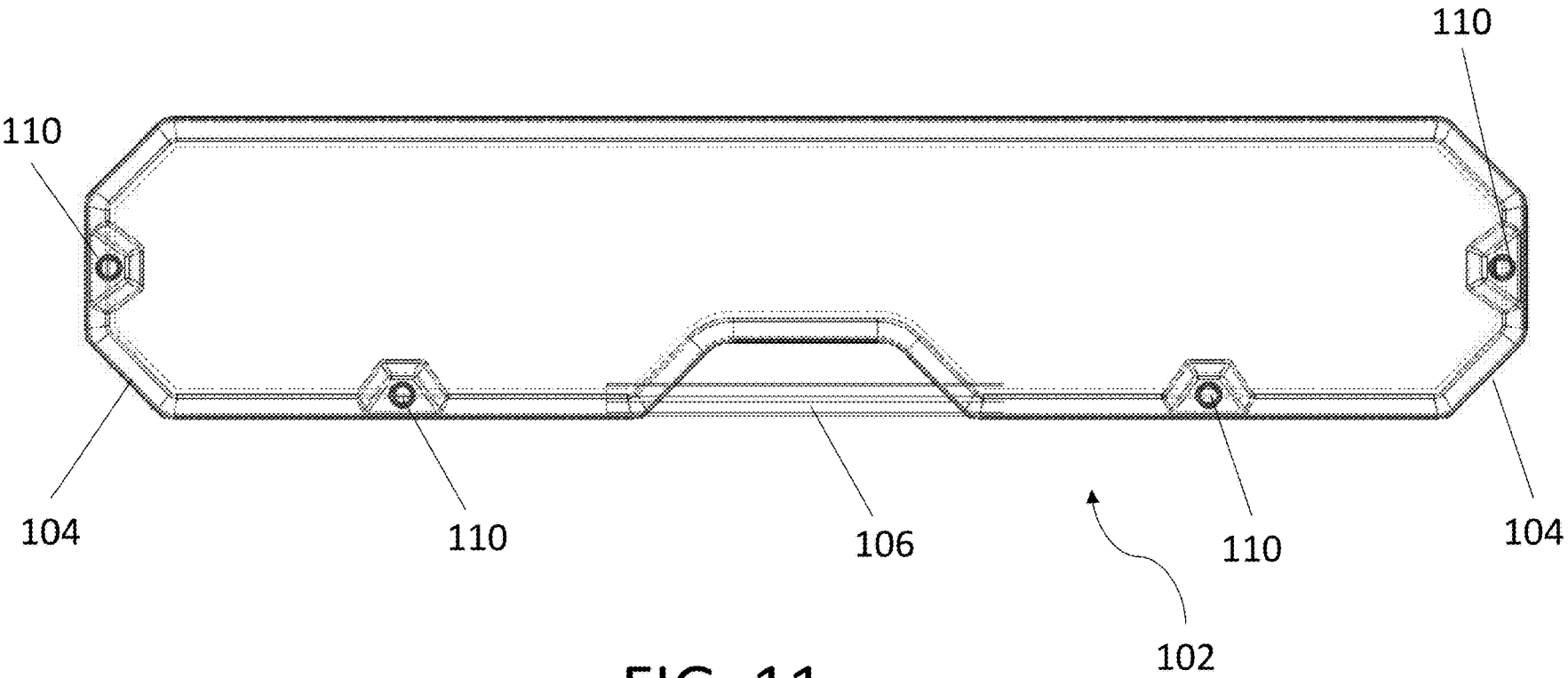
FIG. 11 illustrates a front transparent view of an equipment case with recesses on the front of the exterior shell according to one embodiment of the present invention.
Figure 12:
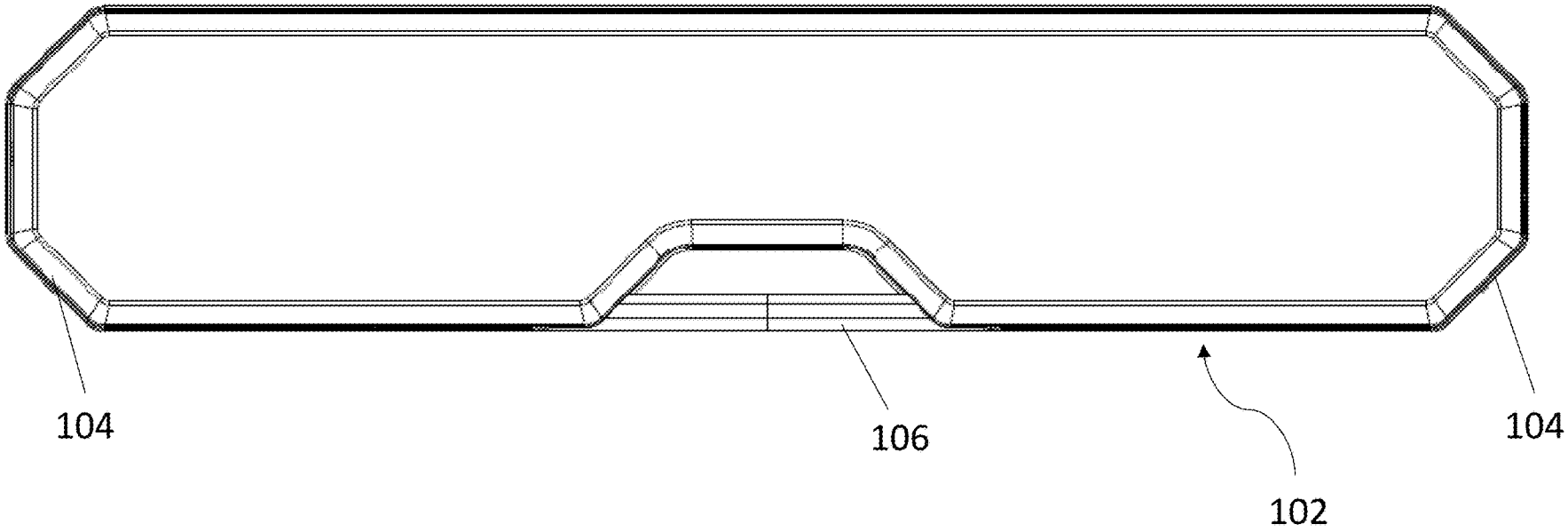
FIG. 12 illustrates a front orthogonal view of an equipment case with recesses on the top and ends of the exterior shell according to one embodiment of the present invention.
Figure 22:
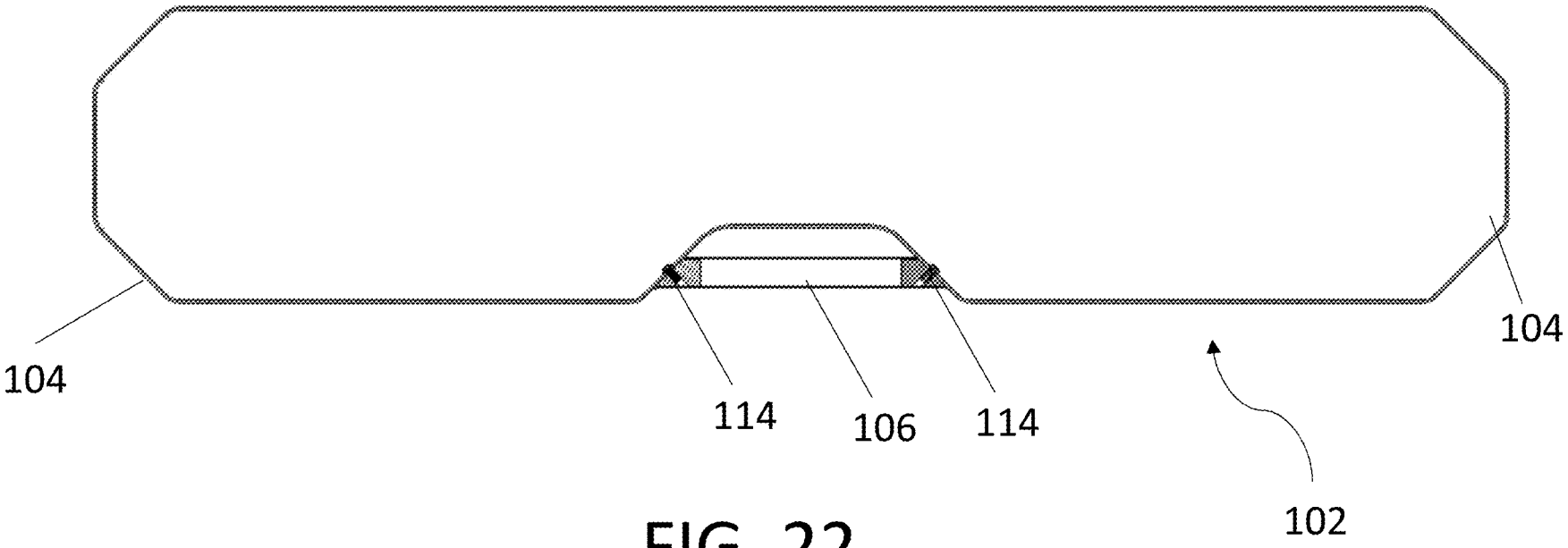
FIG. 22 illustrates a back transparent orthogonal view of an equipment case with mechanical fasteners for the handle according to one embodiment of the present invention.

FIG. 11 illustrates a front transparent view of an equipment case showing the full length of the handle, including the portion of the handle 106 that is adhered to the case. The handle 106 is preferably hollow, but is solid in other embodiments. In one embodiment, the handle 106 includes texture which creates a greater coefficient of friction than a non-textured handle. Texture is added to the handle via any method known in the art, including but not limited to, stippling and bead blasting. These methods create a fine "grit" texture to the handle 106, which provides a greater friction coefficient than a non-textured handle. The handle 106 is preferably bonded to the frame by inserting a chemical compound into each end of the handle 106 or coating each end of the handle with the chemical compound and inserting the handle 106 into openings in the case, thereby providing a complete or substantially complete seal of the end of the handle 106 and a complete or substantially complete seal of the handle 106 with the case. Chemical compounds utilized for bonding the handle to the case include adhesives such as epoxy. Additionally or alternatively, the handle 106 is secured in place by a locking screw or other mechanical fastener inserted from the interior of the case into the handle 106. FIG. 22 illustrates mechanical fasteners 114 which lock the handle 106 into place. The mechanical fasteners, which are preferably locking screws, prevent the handle from loosening or shifting. In another embodiment, the handle 106 is mechanically attached by flaring ends of handle 106 or riveting the handle 106 into place. Other methods of mechanical and/or chemical attachment are alternatively utilized, including mechanical interlocking, welding, etc. Advantageously, the handle 106 is of a sufficient length such that a user can hold the handle in different locations based on the center of gravity of the case, which is determined by the contents of the case.

The handle 106 is operable to be octagonal, hexagonal, cylindrical, rectangular, or any other shape. In one embodiment, the handle 106 includes an ergonomic grip over the handle 106. The ergonomic grip is formed of plastic, rubber, foam, and/or blends thereof. The grip is formed via injection molding or any other process known to one of ordinary skill in the art.

FIGS. 12-16 illustrate various views of an equipment case with recesses on the top and ends of the exterior shell according to one embodiment of the present invention. The recesses 108 on the top and the ends of the exterior shell of the case re operable top receive latch components or lock components. Preferably, these recesses 108 are located on a side of the end of the case that is perpendicular to the main body of the case, i.e. the side of the case farthest from the center of the case or the handle 106 of the case. Additionally or alternatively, the recesses 108 are located on the sides of the end of the case that are diagonal positioned with respect to the main body of the case.

In one embodiment, a latch component is installed in a recess 108 and a corresponding latch component is installed on the other side of the case such that when the latch components are engaged the components latch across the opening of the case to keep the case shut. In another embodiment, another recess is formed on the other side of the case to receive a lock component. The recesses provide the user of the case a visual indication of where the latches/locks are located on the case. Additionally, the recesses minimize the Z dimension between the latches/locks, bezel and the exterior shell 102 in order to meet the tolerances of latches with a stem and housing including a pushbutton and ensure a watertight seal the edges of the case. In addition, the smaller distance between the detent button on top of the case and pin that is bonded into the bottom bezel, the stronger the seal of the case will be, thus making it much more difficult for someone to pry the case open.

Figure 13:
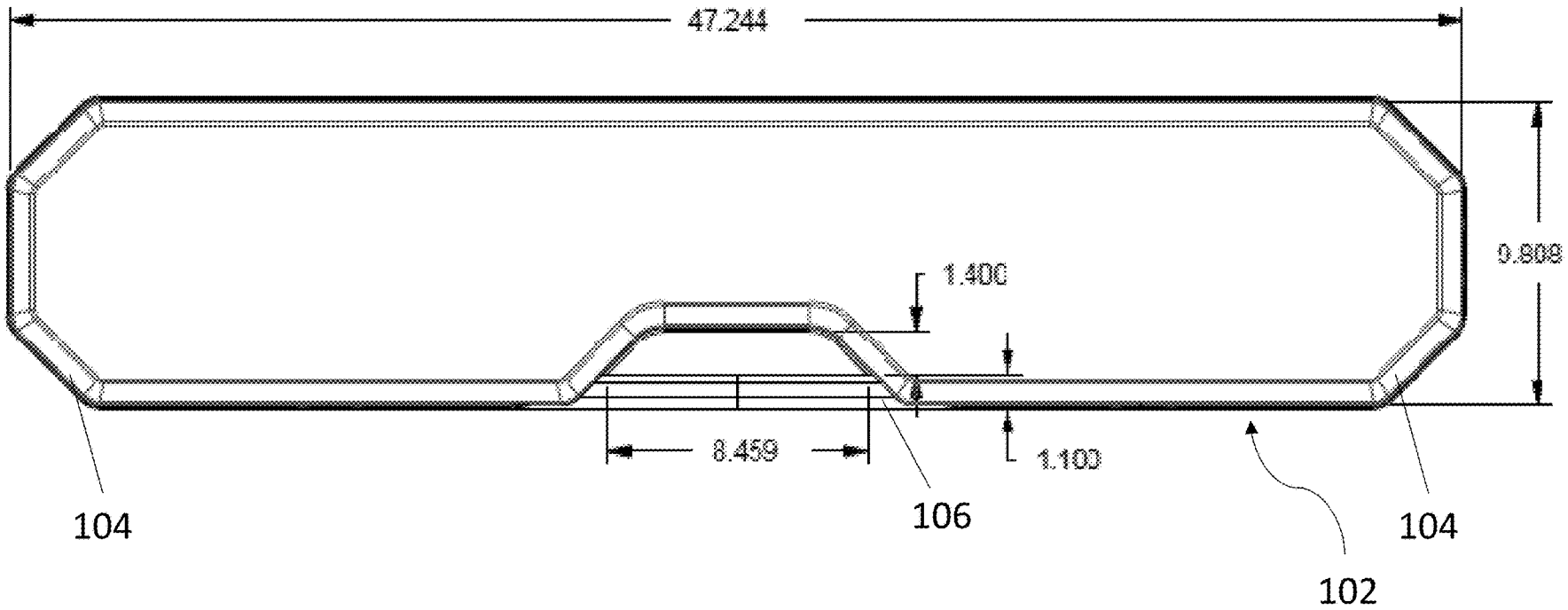
FIG. 13 illustrates a front orthogonal view of an equipment case with recesses on the top and ends of the exterior shell and with the dimensions of the case according to one embodiment of the present invention.
Figure 14:
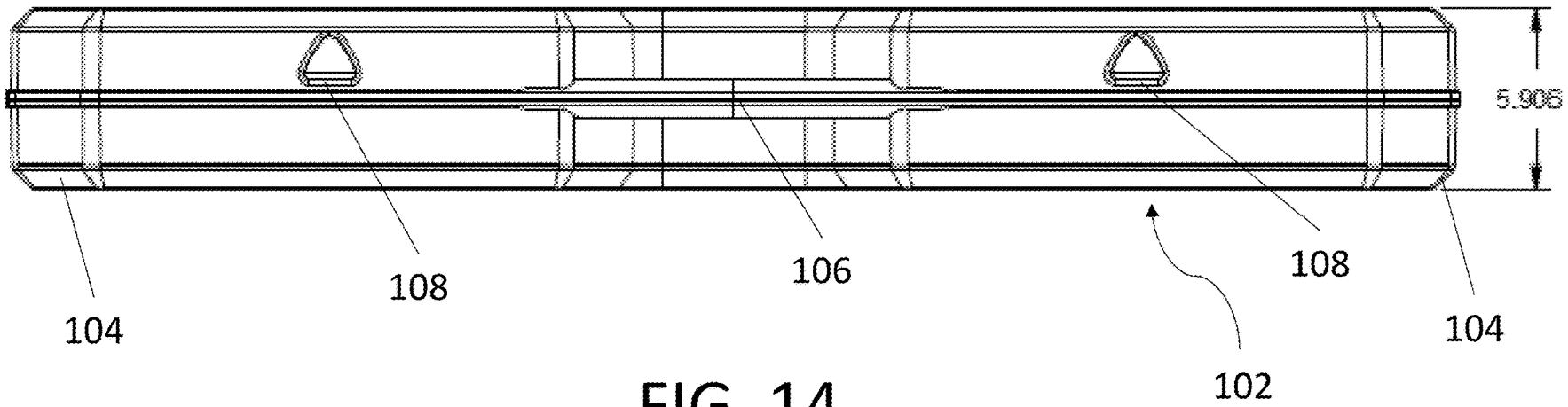
FIG. 14 illustrates a top orthogonal view of an equipment case with recesses on the top and ends of the exterior shell according to one embodiment of the present invention.
Figure 15:
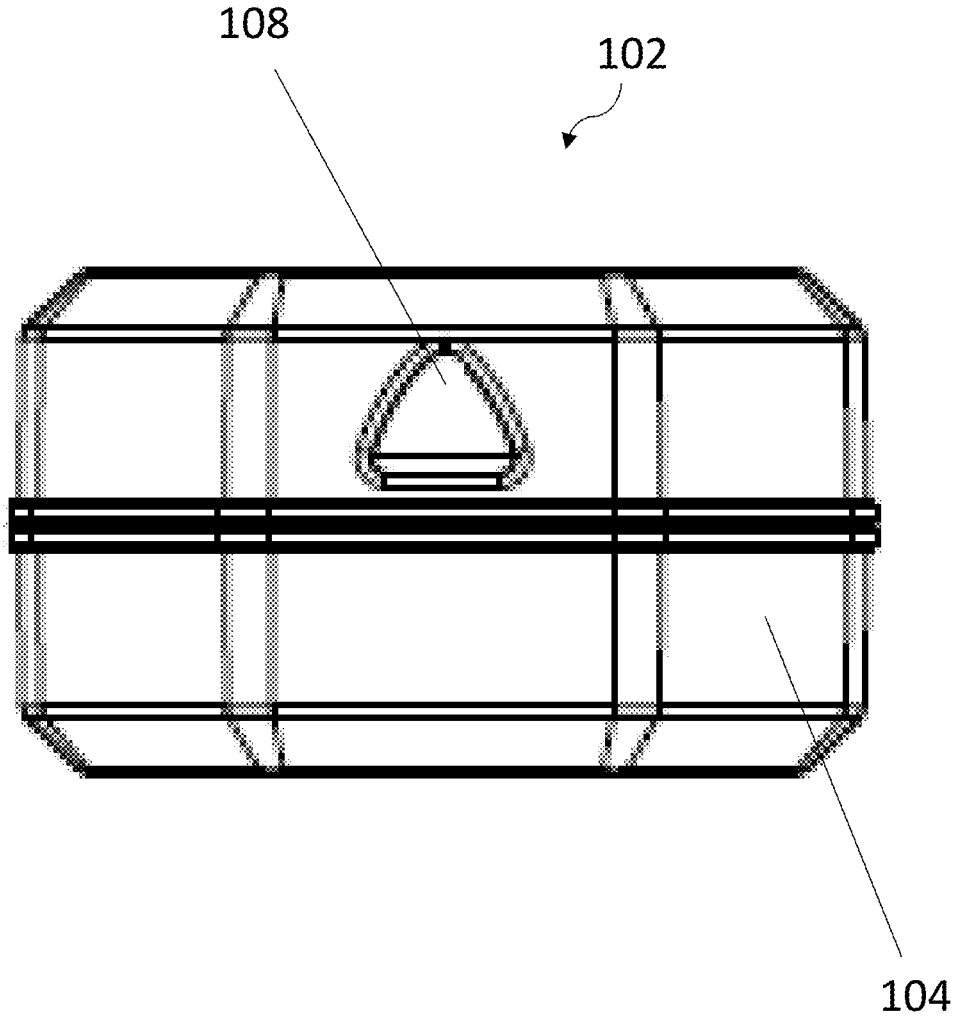
FIG. 15 illustrates an end orthogonal view of an equipment case with recesses on the top and ends of the exterior shell according to one embodiment of the present invention.
Figure 16:
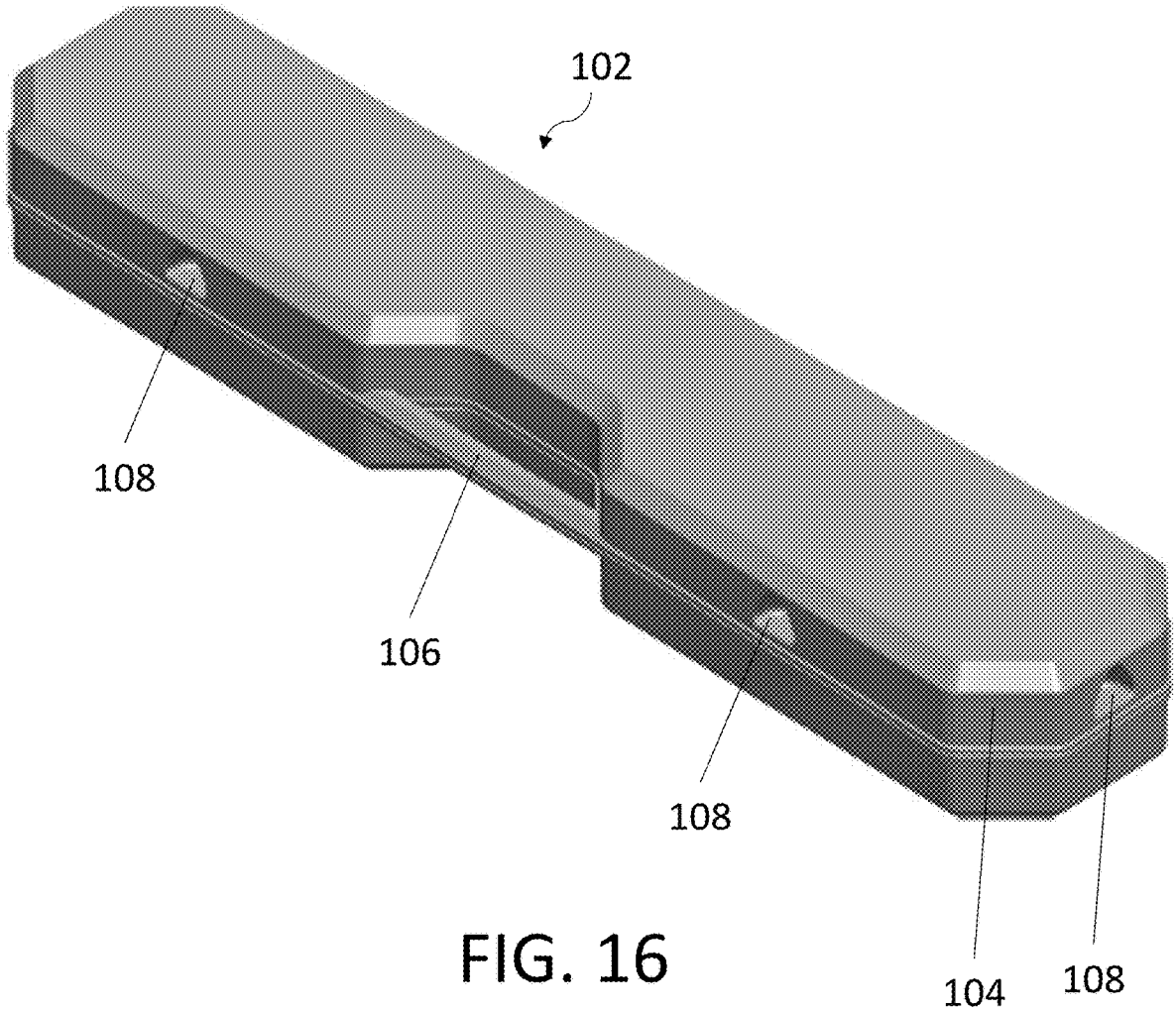
FIG. 16 illustrates a front perspective view of an equipment case with recesses on the top and ends of the exterior shell according to one embodiment of the present invention.
Figure 17:
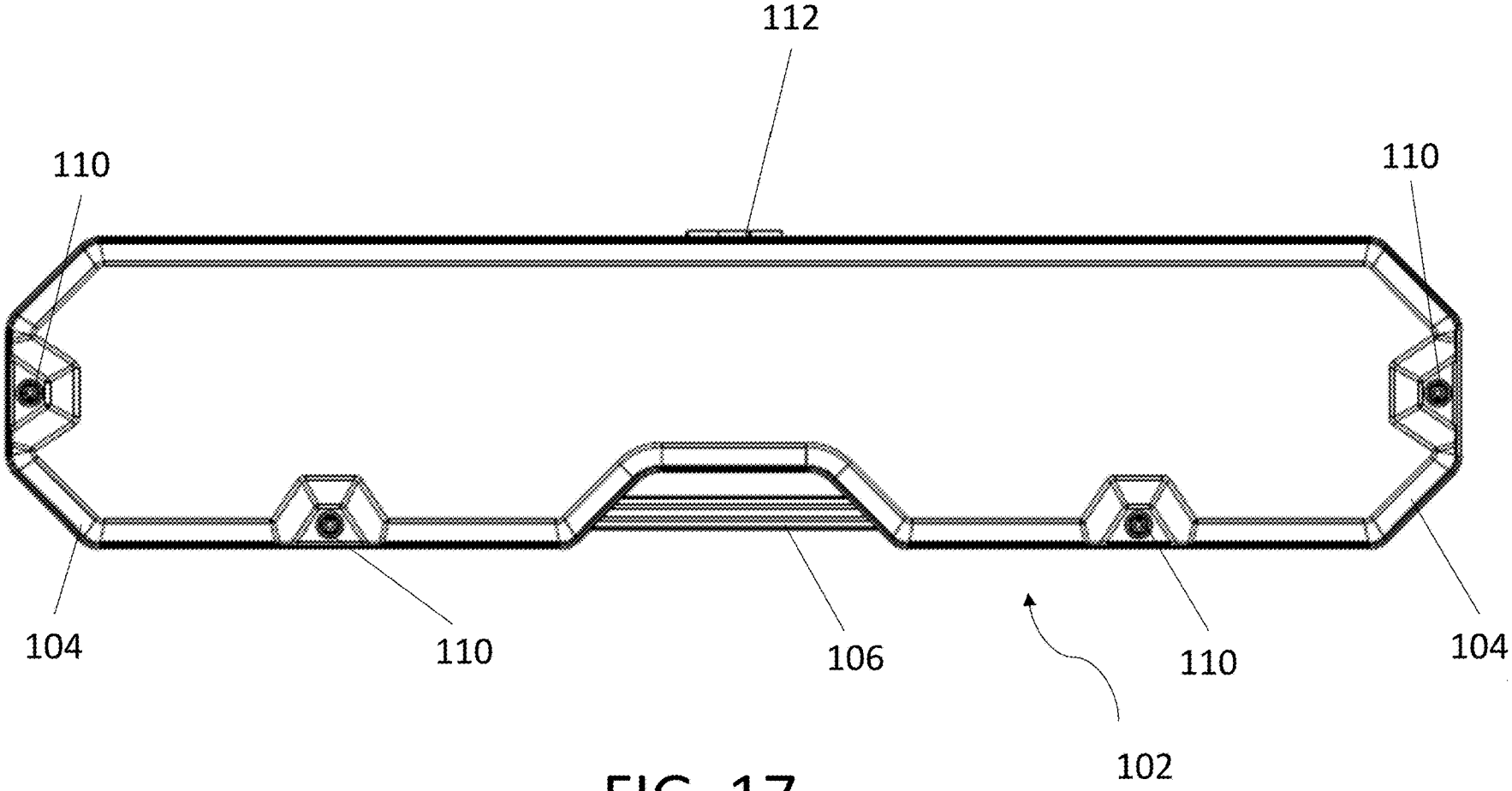
FIG. 17 illustrates a front view of an equipment case with a hinge according to one embodiment of the present invention.
Figure 18:
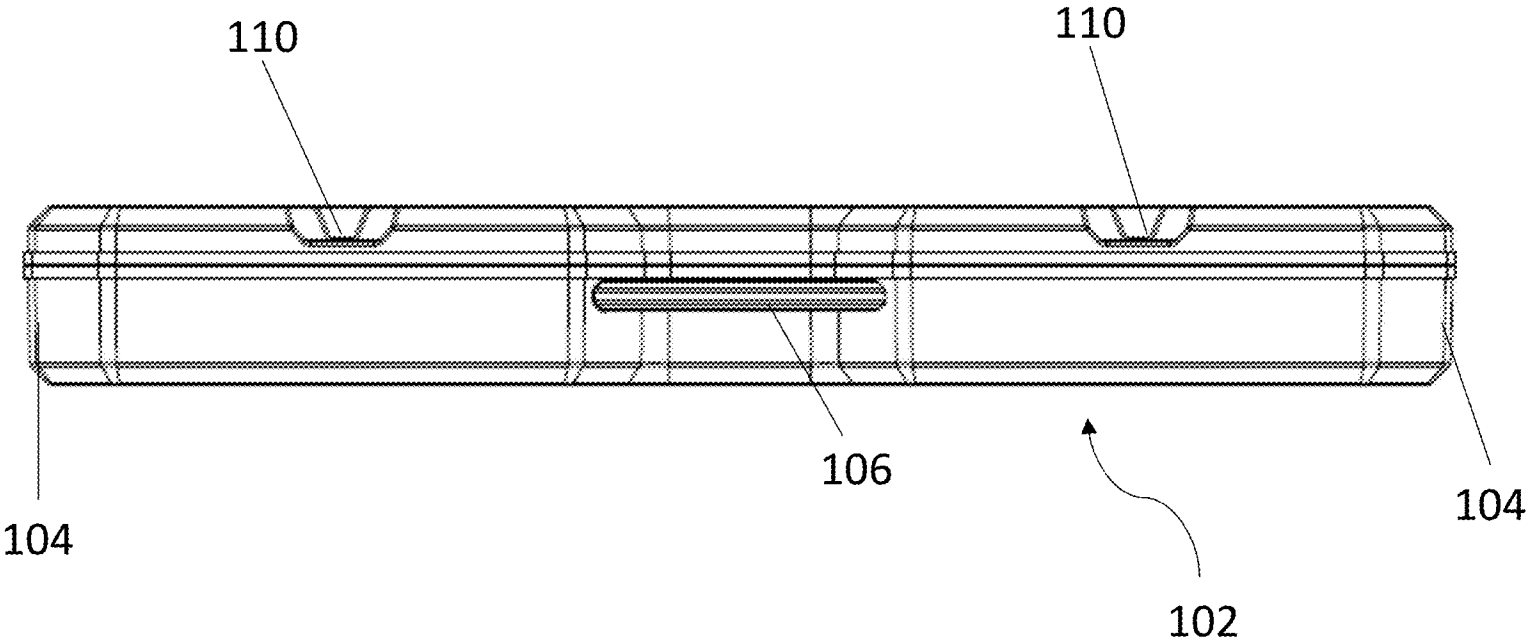
FIG. 18 illustrates a top orthogonal view of an equipment case with a hinge according to one embodiment of the present invention.
Figure 19:
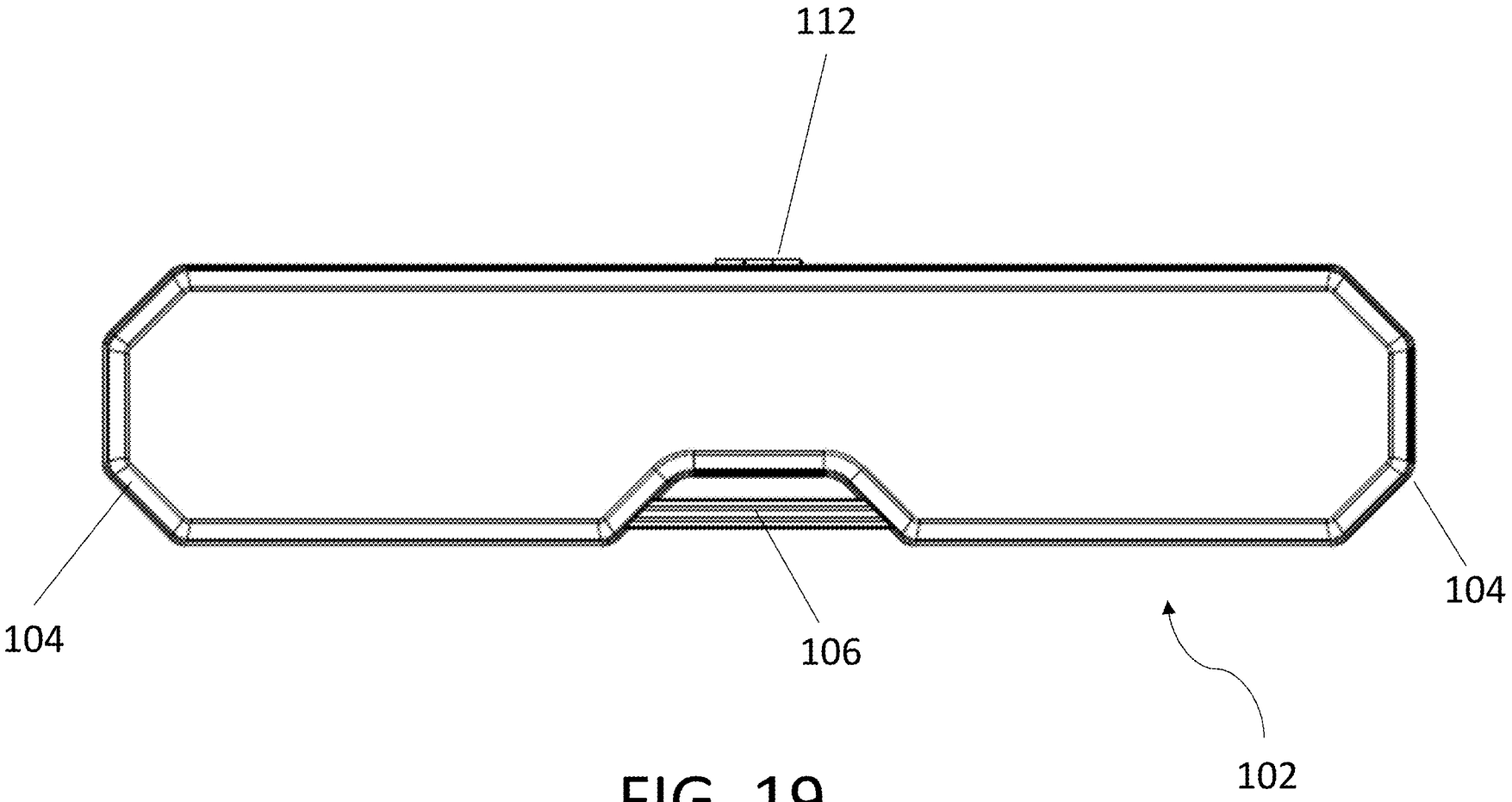
FIG. 19 illustrates a front orthogonal view of an equipment case with a hinge according to one embodiment of the present invention.
Figure 20:
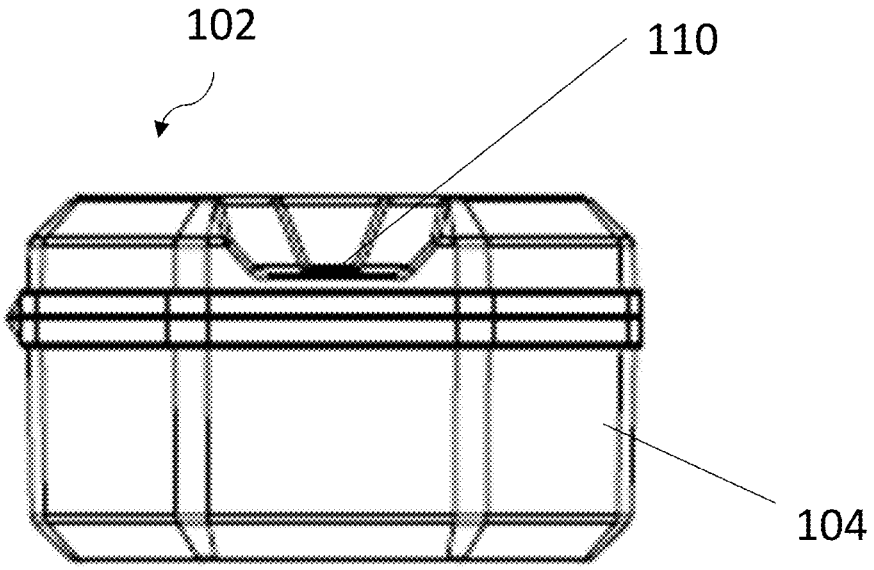
FIG. 20 illustrates an end orthogonal view of an equipment case with a hinge according to one embodiment of the present invention.
Figure 21:
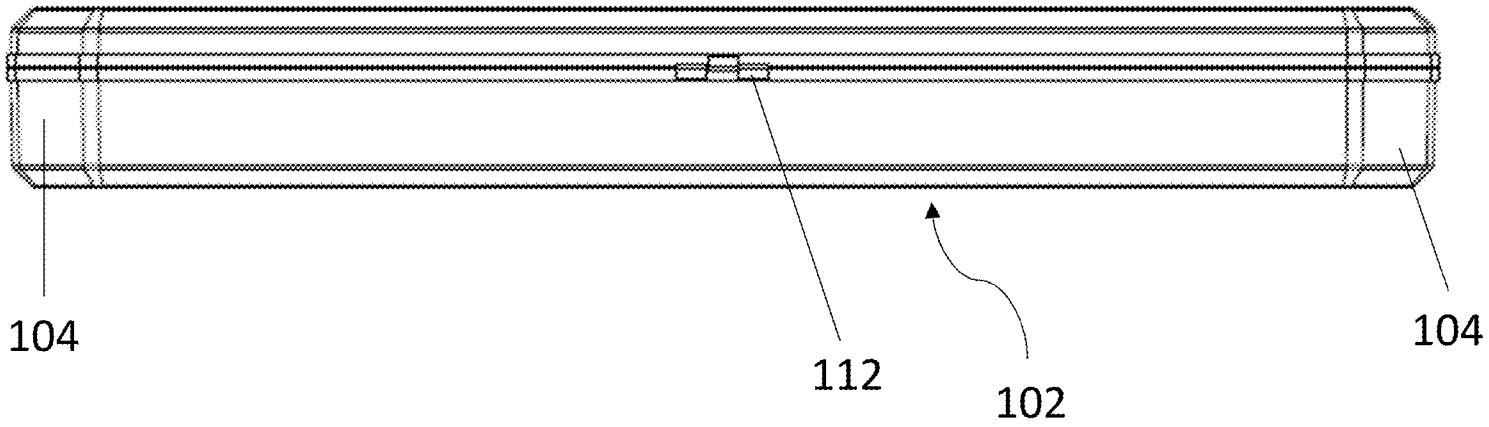
FIG. 21 illustrates a bottom orthogonal view of an equipment case with a hinge according to one embodiment of the present invention.

FIG. 13 illustrates the dimensions of the case with recesses in the top and in the ends of the case according to one embodiment of the present invention. The case has a length of about 120 cm (about 47.244 inches) and a width of about 24.9123 cm (9.9808 inches) in this embodiment. Alternatively, the case has a length of about 145 cm (about 57.0866 inches) and a width of about 40 cm (about 15.748 inches). The case includes a trapezoidal shaped section removed measuring about 3.556 cm (about 1.400 inches) from the edge of the case to the base of the trapezoid through which a handle 106 with a length of about 21.485 cm (about 8.459 inches) is attached. The width of the chamfered section around the edge of the exterior shell 102 is about 2.54 cm (about 1.000 inches).

Figure 28:
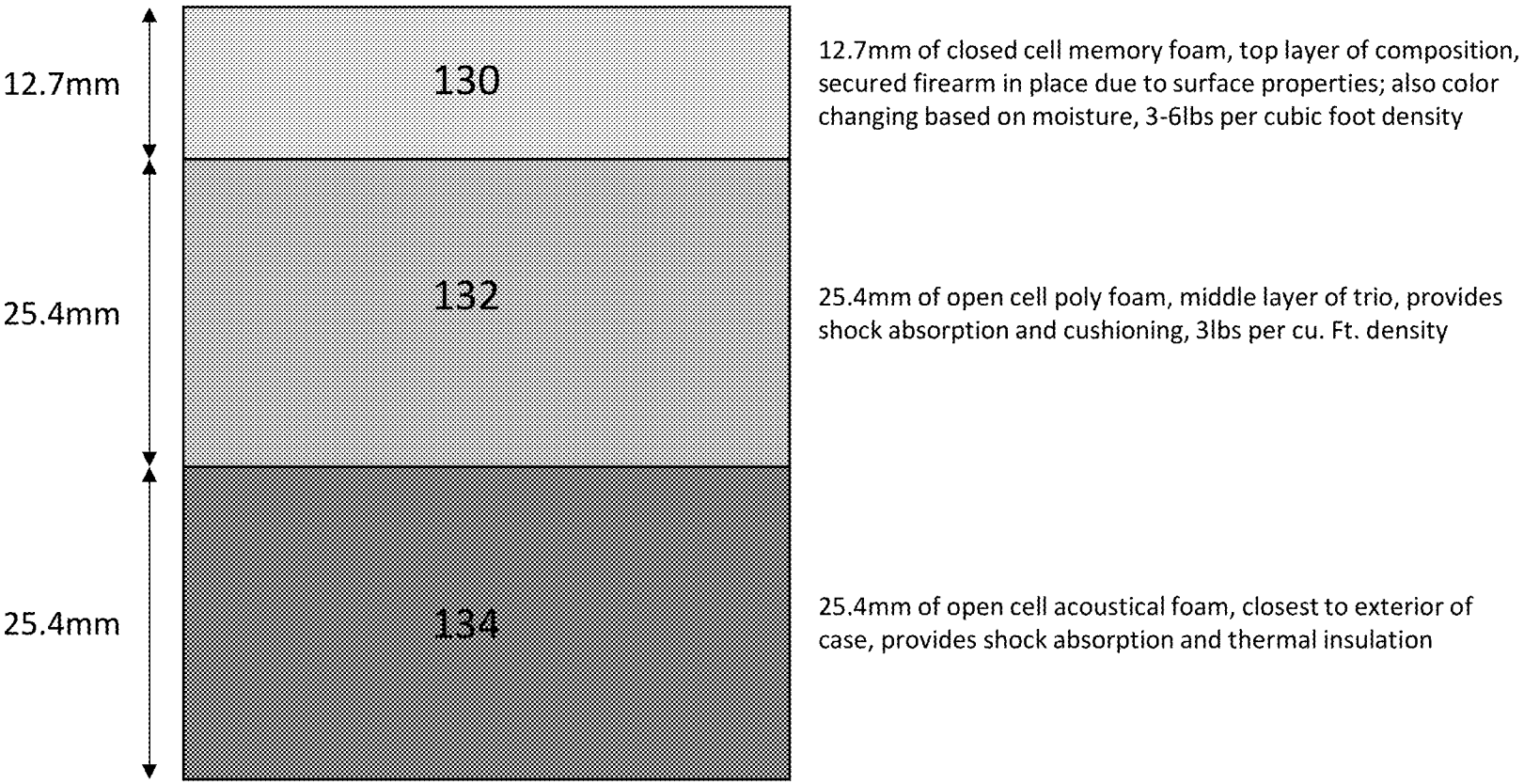
FIG. 28 illustrates a cross section of the three layers of foam included on the interior of the case in one embodiment of the present invention.
Figure 29:
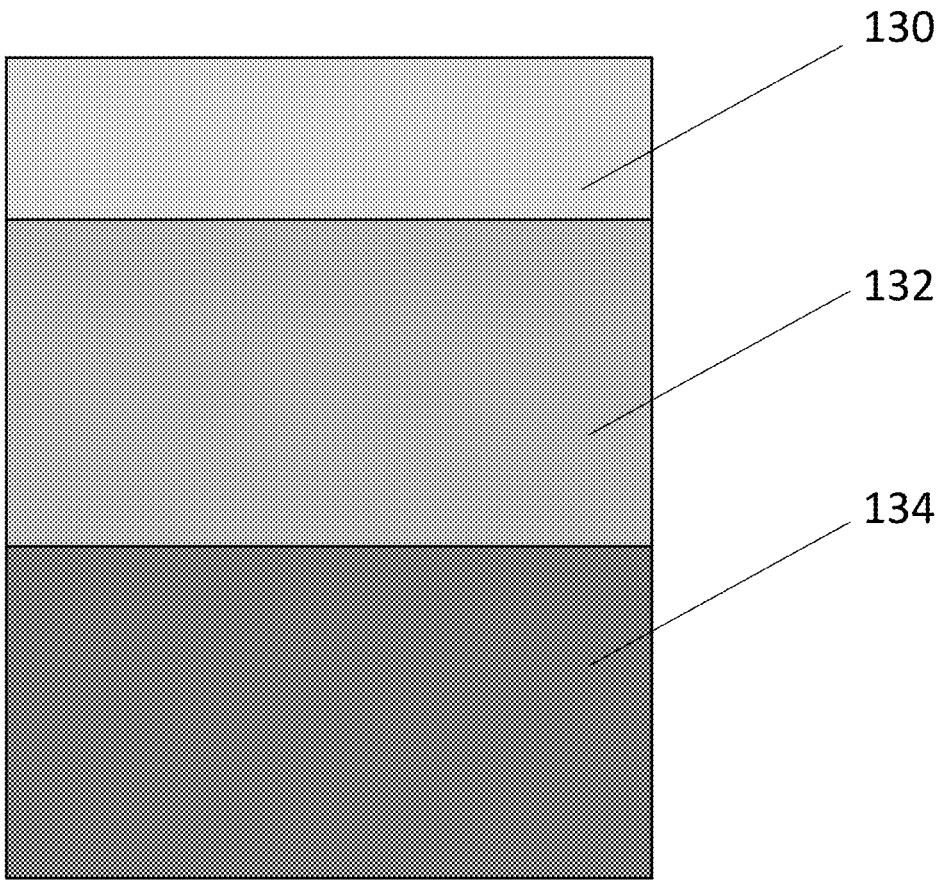
FIG. 29 illustrates a photograph of a cross section of the three layers of foam included on the interior of the case in one embodiment of the present invention.

FIGS. 17-21 illustrate various views of the case including a hinge 112. The hinge 112 of the case is formed of aluminum in one embodiment, and more specifically is a Computer Numerical Controlled (CNC) milled aluminum hinge. The hinge 112 is also operable to be a piano hinge in another embodiment. Preferably, a titanium rod is utilized in the center of the hinge and is integrated with the bezel. The interior of the case preferably includes three layers of foam. FIG. 28 illustrates a cross section of the three layers of foam including the innermost layer 130, the middle layer 132, and the outermost layer 134. FIG. 29 is a diagram of the three layers of foam including the innermost layer 130, the middle layer 132, and the outermost layer 134. The innermost layer 130 or top layer of foam which contacts the contents of the case is a dense, lightweight foam which provides shock protection for the contents of the case. The innermost layer 130 of foam is preferably about 12.7 mm (about 0.5 inches) thick. Alternatively, the innermost layer 130 of foam is about 5.08 cm (2 inches) thick or between about 12.7 mm and about 5.08 cm thick. The innermost layer 130 of foam is preferably viscoelastic polyurethane foam or low-resilience polyurethane foam (LRPu) such as memory foam. The innermost layer 130 of foam is preferably closed cell, but is open cell foam in other embodiments. A preferred density of the innermost layer 130 of foam is between about 48.0554 kg per cubic meter to about 96.1108 kg per cubic meter (or about 3 to 6 pounds per cubic foot). The innermost layer of foam is preferably between about 0.635 cm (about 0.25 inches) and about 1.27 cm (about 0.5 inches) thick. Notably, the innermost layer of foam is operable to change color when a predetermined amount of moisture condenses on the foam. In one embodiment, the innermost layer of foam includes anhydrous cobalt (II) chloride, which is integrated in the foam during manufacture. By way of example, isocyanates including di-isocyanates, tri-isocyanates, poly-isocyanates, etc. and polyols are combined to form a polyurethane foam. The anhydrous cobalt (II) chloride is preferably combined with the isocyanates and the polyols to form the foam during manufacture of the foam. Alternatively, the anhydrous cobalt (II) chloride is added to the foam after the isocyanates and polyols are combined to form the foam. In another embodiment, color changing desiccants such as silica are integrated into the foam during the reaction between the isocyanates and the polyols or after the isocyanates have reacted with the polyols to form the foam. Color changing desiccants change color when exposed to moisture.

The middle layer 132 of foam is preferably a silicone-based compressive or memory foam on the interior to provide cushioning for the contents of the case and to prevent movement of the contents during transport. The middle layer 132 of foam is preferably about 25.44 mm (1 inch) thick. Alternatively, the foam is about 5.08 cm (2 inches) thick. The middle layer 132 is preferably an open cell polyurethane foam with a density of about 48.0554 kg per cubic meter (about 3 pounds per cubic foot).

The outermost layer 134 of foam is preferably an open cell acoustical foam with a thickness of about 48.0554 kg per cubic meter (about 3 pounds per cubic foot). Alternatively, the outermost layer 134 is a memory foam with a high friction coefficient to prevent the contents of the case from moving during transport. The outermost layer 134 is operable to be any foam which provides for thermal insulation and shock absorption.

The case also preferably includes a Global Positioning System (GPS) tracker for tracking the location of the case. The GPS tracker is operable to be accessed and activated remotely using an electronic device, including by way of example, a mobile electronic device such as a smart phone, a tablet, or a wearable, a computer, a car, or any other electronic device. The GPS preferably sends out a signal periodically, such as every 30 minutes. Alternatively, the GPS sends out a signal every second, every five seconds, every 30 seconds, every minute, every 5 minutes, every 10 minutes, every 30 minutes, every hour, every two hours, etc. The electronic device receives the signal from the GPS tracker and determines the location of the case. In one embodiment, the case includes a port for charging the GPS tracker. Alternatively, the GPS tracker is removable from the case. One example of a tracker includes a GPS tracker with a battery life of 1-5 years which is operable to send between 1-4 location reports a day to a connected electronic device, such as the MOBILE-310 GPS TRACKER by LOGISTIMATICS.

Other examples of trackers utilized in the present invention also include crowd GPS devices such as TILE and TRACKR. Crowd GPS technology functions in combination with BLUETOOTH technology to provide the location of the tracker. The tracker emits a BLUETOOTH signal which is received by electronic devices including an application for communicating the location of the tracker to a device registered or associated with the tracker. In yet another embodiment, any GPS tracker can be utilized and synced with a tracking application installed on an electronic device. The electronic device scans a code such as a QR code or a bar code, which is preferably located on the interior of the case, to sync the tracker to the tracking application. Advantageously, the tracking application is operable to sync with tracking applications on other electronic devices with permission to receive the location of the tracker. In one embodiment, the permission of the other electronic devices to receive the location of the tracker is controlled by the application on the electronic device which is originally synced with the tracker. Additionally or alternatively, the application on the electronic device which is originally synced with the tracker provides for selective activation or deactivation of location notifications to emergency contacts via email, text message, or a feed within an application on another electronic device synced with the electronic device. This feature is particularly useful in providing updated location information for a user of the case who travels with the case to remote areas in case a search and rescue is needed. In another embodiment, the tracker includes an emergency mode activated by a button on the tracker or via a graphical user interface (GUI) of the application on the electronic device. Once the emergency mode is activated, the tracker emits distress signals which are received by search and rescue authorities. Preferably, the tracker emits the distress signals in emergency mode more frequently than during normal operation. In one example, activation of emergency mode includes activation of a device coupled to the tracker, such as an emergency beacon. Preferably, the emergency beacon is also synced to an electronic device via an application on the electronic device. Just as with the tracker, the electronic device is operable to sync with other electronic devices which include the application. Upon activation of emergency mode, the electronic device is also operable to send location notifications to emergency contacts via email, text message, or a feed within an application on another electronic device synced with the electronic device. By way of example, one emergency beacon is an Emergency Position Indicating Radio Beacon (EPIRB). The tracker and/or beacon is preferably located on the interior of the bottom portion of the exterior shell 102 of the case adjacent to the handle 106 of the case. The tracker and/or beacon is preferably reversibly mounted to the case in this location. Advantageously, this location allows for the battery of the tracker and/or beacon to be easily changed and/or recharged. In one embodiment, a charging port is integrated into the outside of the case to enable charging of the battery without the need to remove the battery.

The case is advantageously light-weight yet durable. Cases for rifles include dimensions of about 1300 mm (about 51.1811 inches) in length, about 350 mm (about 13.7795 inches) in width, and about 150 mm (about 5.90551 inches) in height. In another embodiment, cases for shotguns include dimensions of 775 mm (about 30.5118 inches) in length, about 250 mm (about 7.87402 inches) in width, and about 100 mm (about 3.93701 inches) in height. A take-down shotgun case which is operable to hold two firearms when broken down has dimensions of about 775 mm (about 30.5118 inches) in length, about 200 mm (about 7.87402 inches) in width, and about 75 mm (about 2.95276 inches) in height. A Short Barrel Rifle (SBR) case has dimensions of about 800 mm (about 31.4961 inches) in length, about 250 mm (about 9.84252 inches) in width, and about 100 mm (about 3.93701 inches) in height. A pistol case has dimensions of about 400 mm (about 15.748 inches) in length, about 250 mm (about 9.84252 inches) in width, and about 100 mm (about 3.93701 inches) in height.

Figure 32:
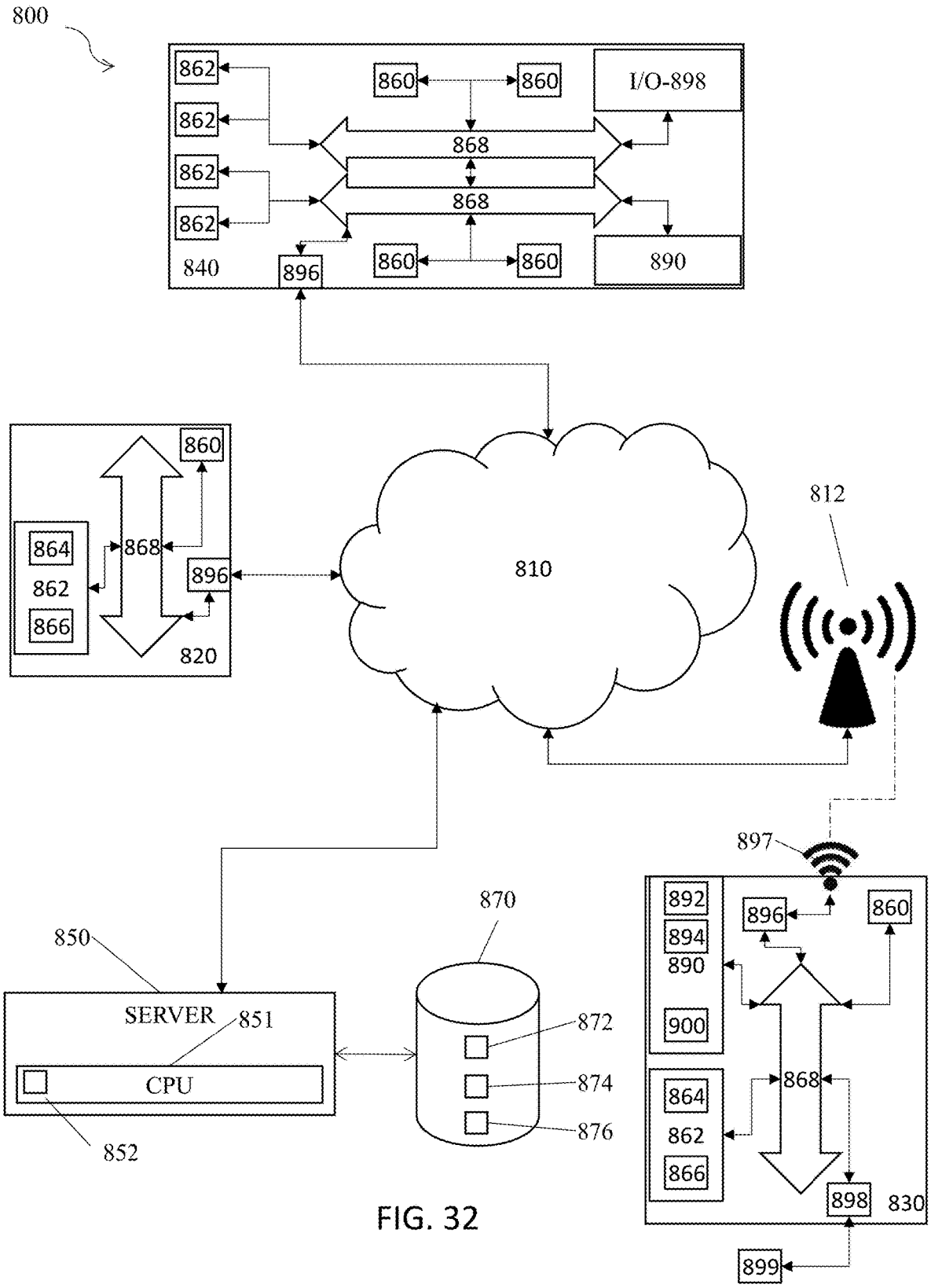
FIG. 32 is a schematic diagram of a cloud-based system of the present invention.

FIG. 32 is a schematic diagram of an embodiment of the invention illustrating a computer system, generally described as 800, having a network 810, a plurality of computing devices 820, 830, 840, a server 850, and a database 870. The computer system is implemented in one embodiment to facilitate communication between an electronic device such as a mobile phone or smart phone and a tracker such as a GPS tracker and/or a beacon such as an emergency beacon in the case.

The server 850 is constructed, configured, and coupled to enable communication over a network 810 with a plurality of computing devices 820, 830, 840. The server 850 includes a processing unit 851 with an operating system 852. The operating system 852 enables the server 850 to communicate through network 810 with the remote, distributed user devices. Database 870 may house an operating system 872, memory 874, and programs 876.

In one embodiment of the invention, the system 800 includes a cloud-based network 810 for distributed communication via a wireless communication antenna 812 and processing by at least one mobile communication computing device 830. Alternatively, wireless and wired communication and connectivity between devices and components described herein include wireless network communication such as WI-FI, WORLDWIDE INTEROPERABILITY FOR MICROWAVE ACCESS (WIMAX), Radio Frequency (RF) communication including RF identification (RFID), NEAR FIELD COMMUNICATION (NFC), BLUETOOTH including BLUETOOTH LOW ENERGY (BLE), ZIGBEE, Infrared (IR) communication, cellular communication, satellite communication, Universal Serial Bus (USB), Ethernet communications, communication via fiber-optic cables, coaxial cables, twisted pair cables, and/or any other type of wireless or wired communication. In another embodiment of the invention, the system 800 is a virtualized computing system capable of executing any or all aspects of software and/or application components presented herein on the computing devices 820, 830, 840. In certain aspects, the computer system 800 may be implemented using hardware or a combination of software and hardware, either in a dedicated computing device, or integrated into another entity, or distributed across multiple entities or computing devices.

By way of example, and not limitation, the computing devices 820, 830, 840 are intended to represent various forms of digital computers 820, 840, 850 and mobile devices 830, such as a server, blade server, mainframe, mobile phone, personal digital assistant (PDA), smartphone, desktop computer, netbook computer, tablet computer, workstation, laptop, and other similar computing devices. The components shown here, their connections and relationships, and their functions, are meant to be exemplary only, and are not meant to limit implementations of the invention described and/or claimed in this document In one embodiment, the computing device 820 includes components such as a processor 860, a system memory 862 having a random access memory (RAM) 864 and a read-only memory (ROM) 866, and a system bus 868 that couples the memory 862 to the processor 860. In another embodiment, the computing device 830 may additionally include components such as a storage device 890 for storing the operating system 892 and one or more application programs 894, a network interface unit 896, and/or an input/output controller 898. Each of the components may be coupled to each other through at least one bus 868. The input/output controller 898 may receive and process input from, or provide output to, a number of other devices 899, including, but not limited to, alphanumeric input devices, mice, electronic styluses, display units, touch screens, signal generation devices (e.g., speakers), or printers.

By way of example, and not limitation, the processor 860 may be a general-purpose microprocessor (e.g., a central processing unit (CPU)), a graphics processing unit (GPU), a microcontroller, a Digital Signal Processor (DSP), an Application Specific Integrated Circuit (ASIC), a Field Programmable Gate Array (FPGA), a Programmable Logic Device (PLD), a controller, a state machine, gated or transistor logic, discrete hardware components, or any other suitable entity or combinations thereof that can perform calculations, process instructions for execution, and/or other manipulations of information.

In another implementation, shown as 840 in FIG. 32, multiple processors 860 and/or multiple buses 868 may be used, as appropriate, along with multiple memories 862 of multiple types (e.g., a combination of a DSP and a microprocessor, a plurality of microprocessors, one or more microprocessors in conjunction with a DSP core).

Also, multiple computing devices may be connected, with each device providing portions of the necessary operations (e.g., a server bank, a group of blade servers, or a multiprocessor system). Alternatively, some steps or methods may be performed by circuitry that is specific to a given function.

According to various embodiments, the computer system 800 may operate in a networked environment using logical connections to local and/or remote computing devices 820, 830, 840, 850 through a network 810. A computing device 830 may connect to a network 810 through a network interface unit 896 connected to a bus 868. Computing devices may communicate communication media through wired networks, direct-wired connections or wirelessly, such as acoustic, RF, or infrared, through an antenna 897 in communication with the network antenna 812 and the network interface unit 896, which may include digital signal processing circuitry when necessary. The network interface unit 896 may provide for communications under various modes or protocols.

In one or more exemplary aspects, the instructions may be implemented in hardware, software, firmware, or any combinations thereof. A computer readable medium may provide volatile or non-volatile storage for one or more sets of instructions, such as operating systems, data structures, program modules, applications, or other data embodying any one or more of the methodologies or functions described herein. The computer readable medium may include the memory 862, the processor 860, and/or the storage media 890 and may be a single medium or multiple media (e.g., a centralized or distributed computer system) that store the one or more sets of instructions 900. Non-transitory computer readable media includes all computer readable media, with the sole exception being a transitory, propagating signal per se. The instructions 900 may further be transmitted or received over the network 810 via the network interface unit 896 as communication media, which may include a modulated data signal such as a carrier wave or other transport mechanism and includes any delivery media. The term "modulated data signal" means a signal that has one or more of its characteristics changed or set in a manner as to encode information in the signal.

Storage devices 890 and memory 862 include, but are not limited to, volatile and non-volatile media such as cache, RAM, ROM, EPROM, EEPROM, FLASH memory, or other solid state memory technology; discs (e.g., digital versatile discs (DVD), HD-DVD, BLU-RAY, compact disc (CD), or CD-ROM) or other optical storage; magnetic cassettes, magnetic tape, magnetic disk storage, floppy disks, or other magnetic storage devices; or any other medium that can be used to store the computer readable instructions and which can be accessed by the computer system 800.

It is also contemplated that the computer system 800 may not include all of the components shown in FIG. 32, may include other components that are not explicitly shown in FIG. 32, or may utilize an architecture completely different than that shown in FIG. 32. The various illustrative logical blocks, modules, elements, circuits, and algorithms described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application (e.g., arranged in a different order or partitioned in a different way), but such implementation decisions should not be interpreted as causing a departure from the scope of the present invention.

Figure 33:
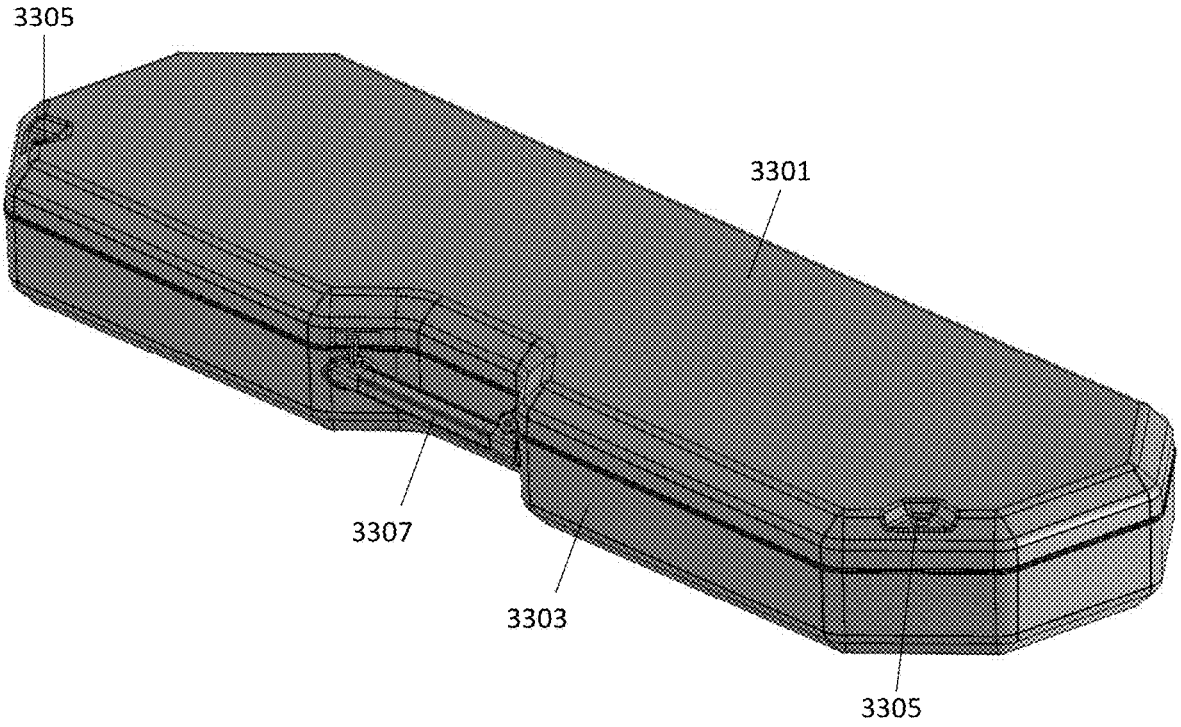
FIG. 33 illustrates a top perspective view of a protective case according to one embodiment of the present invention.

FIG. 33 illustrates one embodiment of an exterior shell of an equipment case. The shell includes, in one embodiment, a top component 3301 and a bottom component 3303, wherein the top component includes latches 3305. A handle 3307 is attached to the case. The illustrated embodiment includes two latches 3305. However, in another embodiment, the case includes one latch, four latches, no latches, or any other number of latches. In one embodiment, a first component of the equipment case is constructed with an exterior that has a matte carbon finish. Advantageously, this ensures durability and prevents heating and glare from sun exposure.

Figure 34:
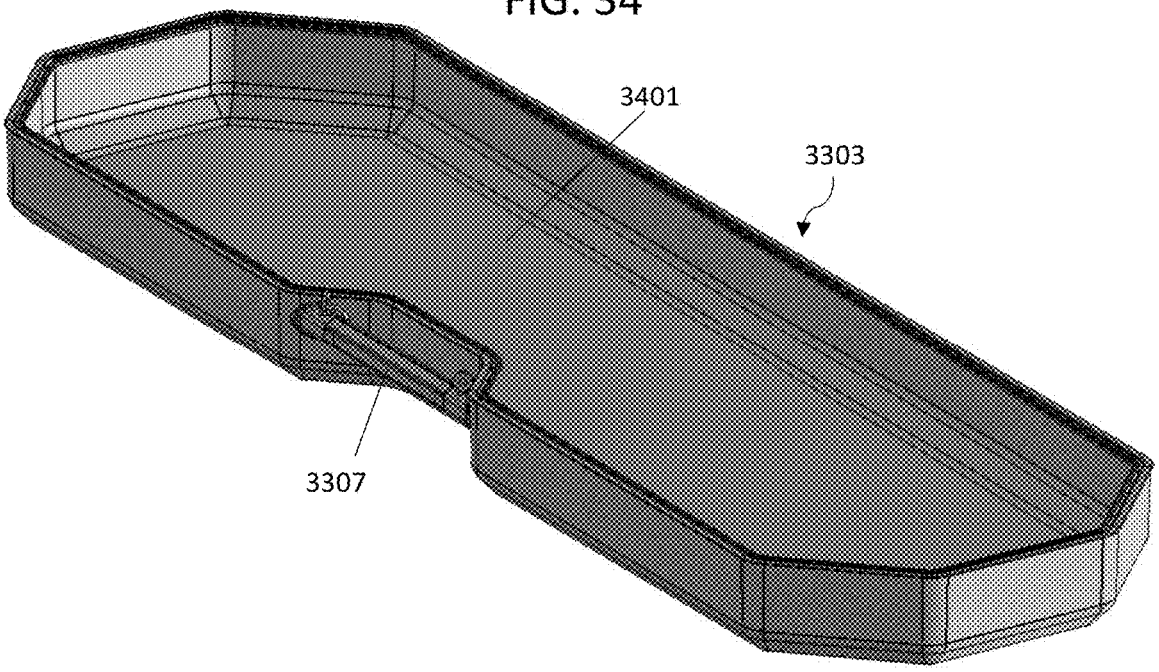
FIG. 34 illustrates a top perspective view of a bottom component of a protective case according to one embodiment of the present invention.

FIG. 34 illustrates a bottom component 3305 of the case, wherein the bottom component includes an interior surface 3401 and an attached handle 3307. The interior surface 3401, in one embodiment, is constructed completely from carbon fiber. In another embodiment, the interior surface includes a liner, padding, and/or one or more additional layers, including foam, rubber, plastic, silicone, cotton, polyester, polyethylene, polyurethane, and/or any other synthetic or natural textile or buffer material. In one embodiment, the interior surface 3401 includes one or more attachment points, attachment layers, or other mechanical, physical, or chemical method of attachment for attaching a layer or object within the case. For example, in one embodiment, the case includes one side of hook-and-loop tape or layers, wherein an object, layer, or insert with a corresponding second send of hook-and-loop tape or layers is operable to attach to an inside of the case. In one embodiment, the object, layer, or insert is a vacuum splint system, such as the one illustrated in FIGS. 42A-47C. In one embodiment, the object, layer, or insert is attached to an inside of the case via an adhesive. In another embodiment, it is attached to the case via hook-and-loop tape, pins, bolts, screws, latches, or other mechanical attachment mechanism. In another embodiment, it is welded, thermoformed, or otherwise physically attached. The handle 3307, in one embodiment, is attached to an exterior of the case and includes a first hinge mechanism. Preferably, a corresponding second hinge mechanism is attached to an exterior surface of the top component 3301.

Figure 35:
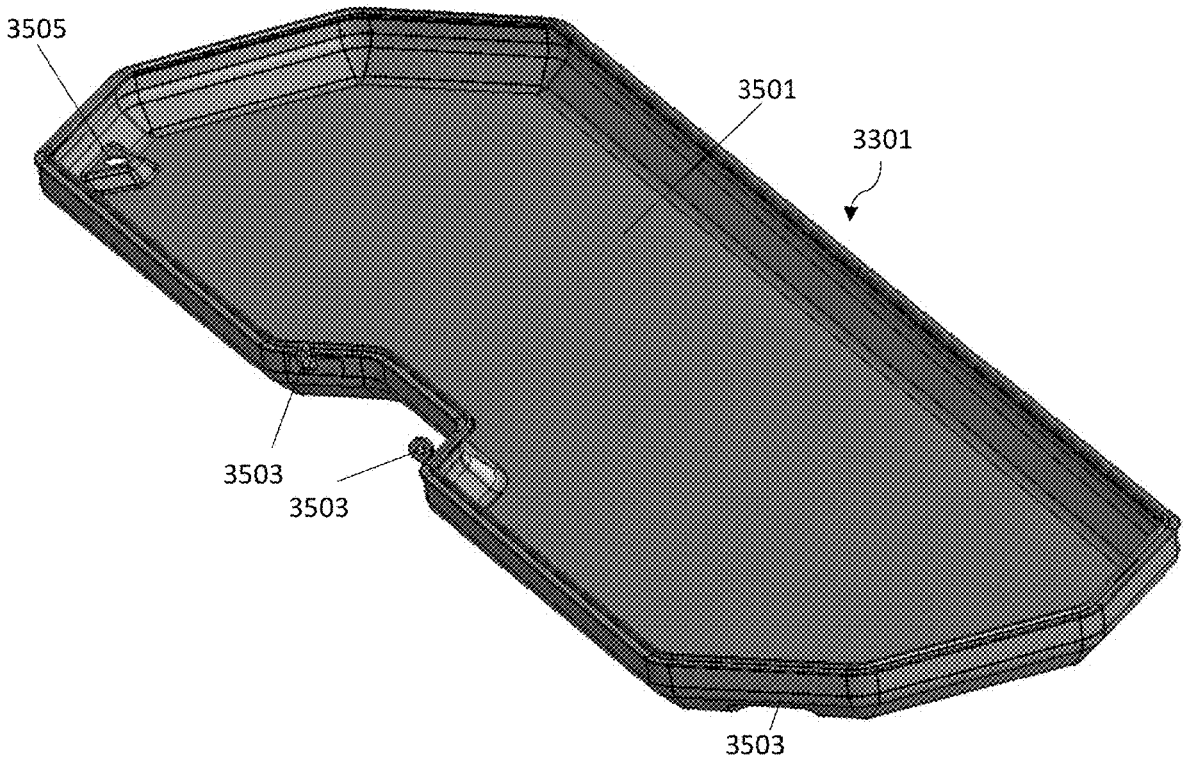
FIG. 35 illustrates a bottom perspective view of a top component of a protective case according to one embodiment of the present invention.

FIG. 35 illustrates one embodiment of a top component 3301 of the case, wherein the case includes an interior surface 3501, locking mechanisms 3503, and latch attachment slots 3505. The interior surface includes similar lining options to the bottom component 3303. The interior surface 3501, in one embodiment, is constructed completely from carbon fiber. In another embodiment, the interior surface includes a liner, padding, and/or one or more additional layers, including foam, rubber, plastic, silicone, cotton, polyester, polyethylene, polyurethane, and/or any other synthetic or natural textile or buffer material. In one embodiment, the interior surface 3501 includes one or more attachment points, attachment layers, or other mechanical, physical, or chemical method of attachment for attaching a layer or object within the case. For example, in one embodiment, the case includes one side of hook-and-loop tape or layers, wherein an object, layer, or insert with a corresponding second send of hook-and-loop tape or layers is operable to attach to an inside of the case. In one embodiment, "egg-crate" foam is attached to the interior surface 3501 to secure and protect any objects (e.g., equipment) contained within the case. The locking mechanisms 3503 are attached to an exterior surface of the top component 3301 of the case, wherein the handle hinges 3501 align with corresponding handle hinges on a bottom component 3303 of the case. In one embodiment, the handle hinges 3501 are attached to the corresponding handle hinges by a pin, bolt, screw, or nail. In another embodiment, the hinges are instead latches, snaps, screws, bolts, buckles, or any other attachment means known in the art that allow for disassembly and/or opening of a case.

Figure 36:
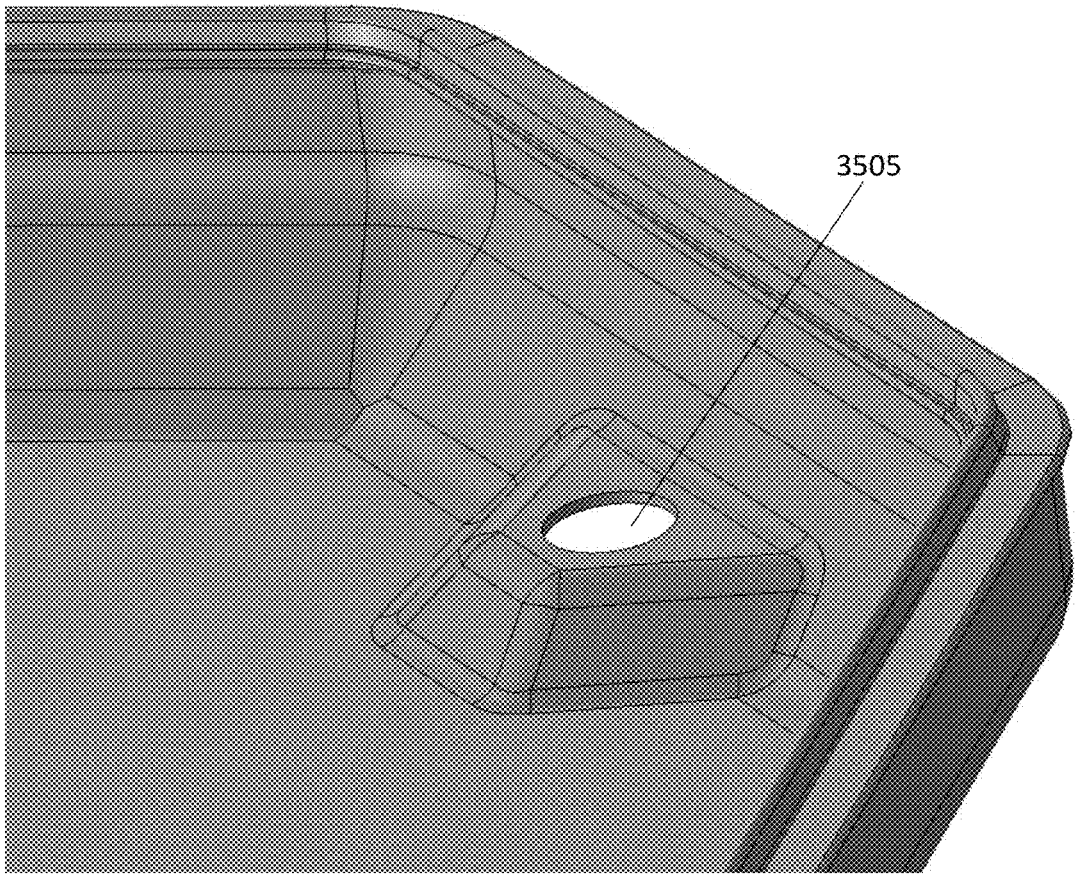
FIG. 36 illustrates a bottom perspective view of a latch bore according to one embodiment of the present invention.
Figure 37:
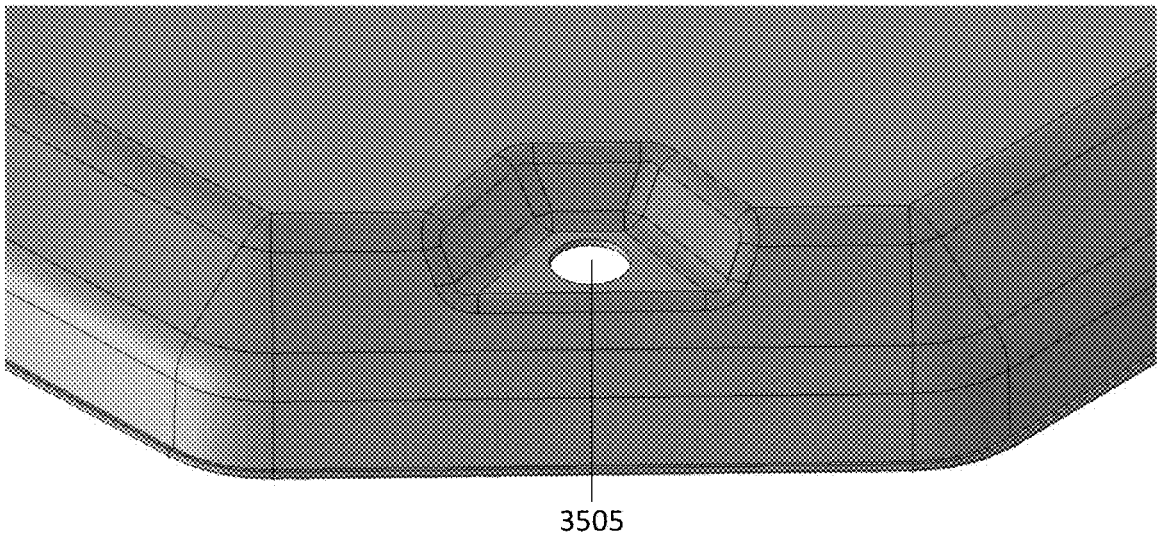
FIG. 37 illustrates a top perspective view of a latch bore according to one embodiment of the present invention.
Figure 48A:
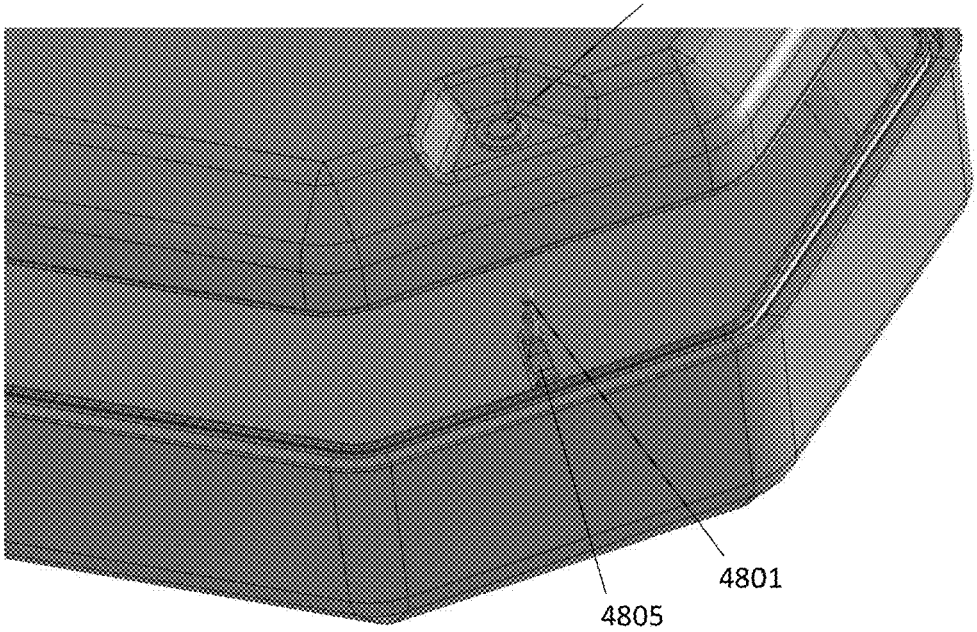
FIG. 48A illustrates an exploded view of a quick-release latch with an inserted retaining cylinder according to one embodiment of the present invention.
Figure 48B:
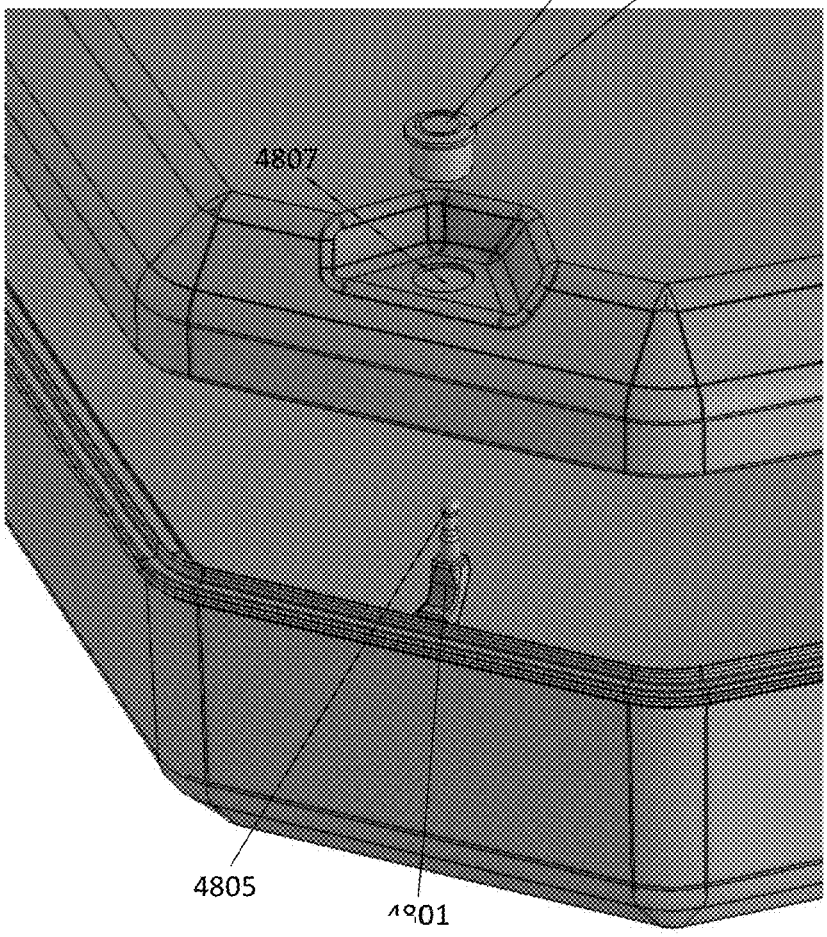
FIG. 48B illustrates a detail exploded view of a quick-release latch and a latch bore according to one embodiment of the present invention.
Figure 48C:
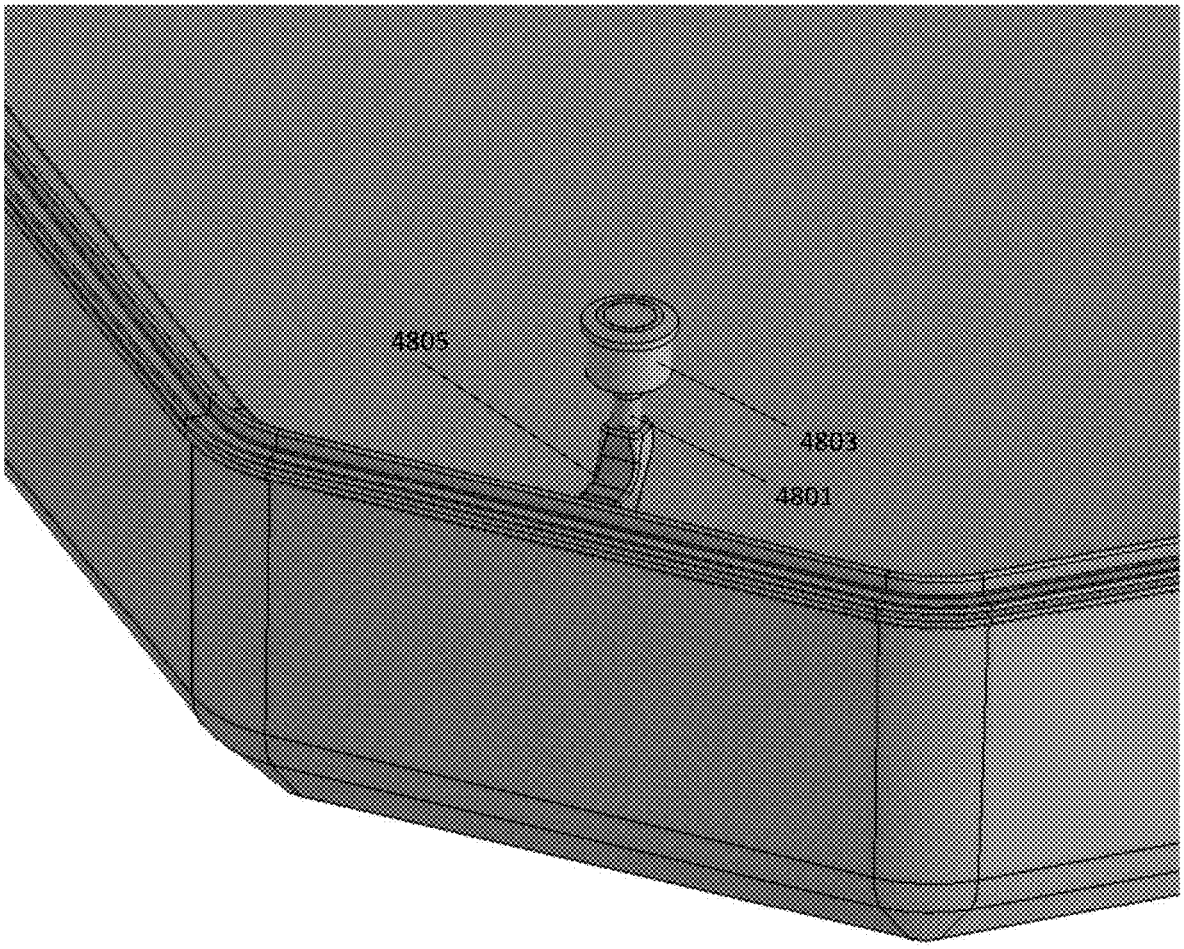
FIG. 48C illustrates a detail view of an engaged quick-release latch with a removed top component of the protective case according to one embodiment of the present invention.

The latch holes 3505, in one embodiment, provide a space within which a latch is operable to be positioned and secured, wherein the latch includes a retaining cylinder and a pin (illustrated in FIGS. 48A-48C). FIGS. 36 and 37 illustrate detail views of an inside and an outside of a latch hole 3505, respectively.

Figure 39:
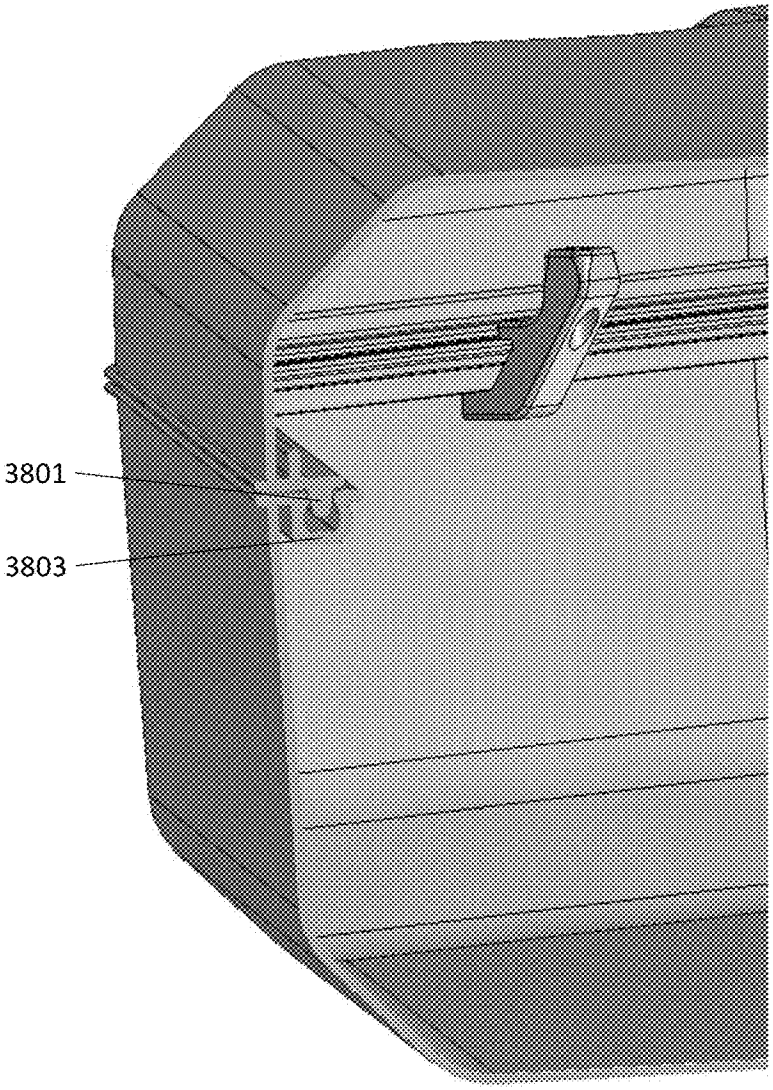
FIG. 39 illustrates a section view of a profile of a protective case according to one embodiment of the present invention.
Figure 38:
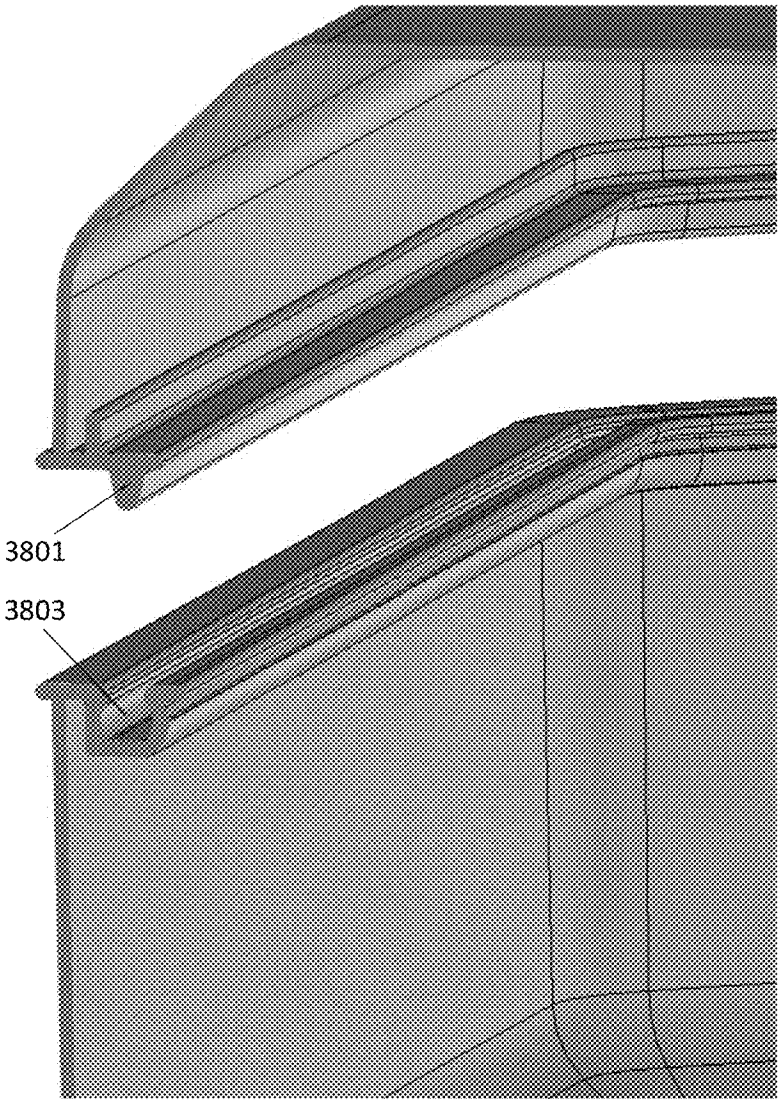
FIG. 38 illustrates a section, exploded view of a profile of a protective case according to one embodiment of the present invention.
Figure 40B:
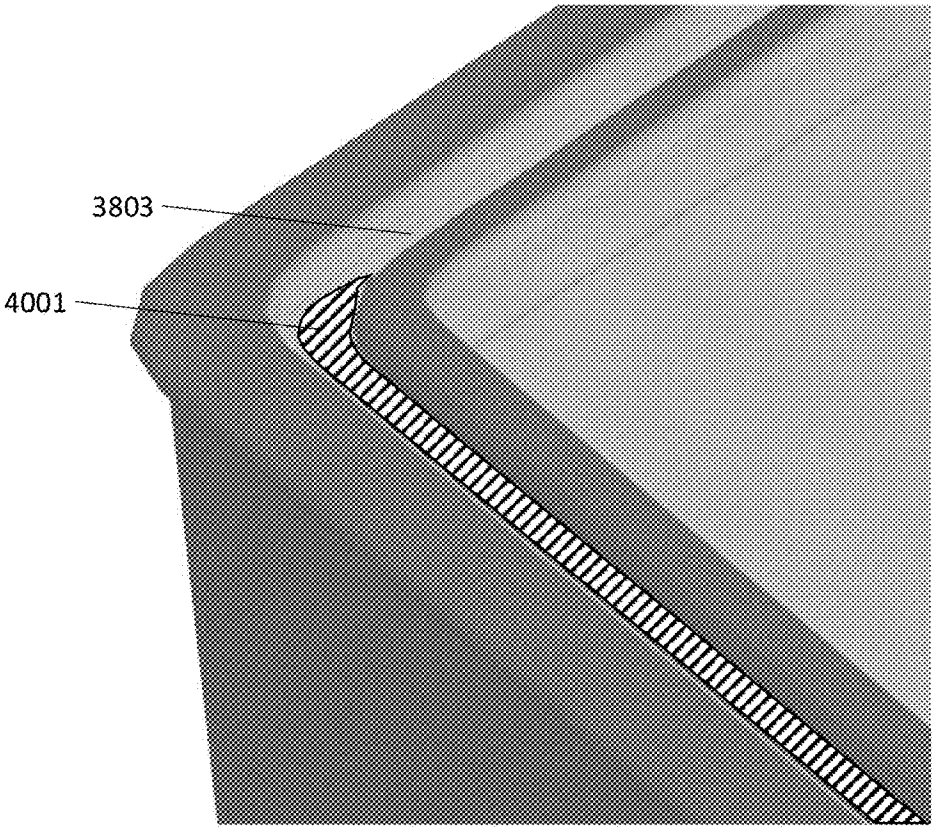
FIG. 40B illustrates detail top view of a protective case including a sealing element according to one embodiment of the present invention.
Figure 40A:
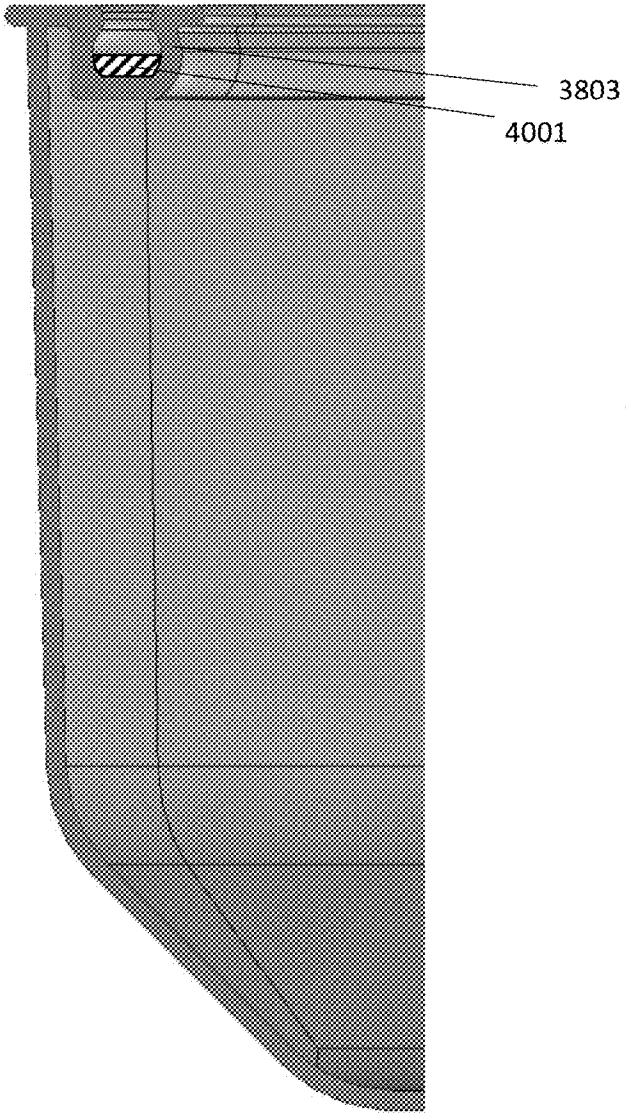
FIG. 40A illustrates a detail section view of a protective case including a sealing element according to one embodiment of the present invention.

FIG. 38 illustrates a cutaway exploded view of an inside of the case, illustrating a profile of the case. A top component profile includes a male lip 3801, and a bottom component profile includes a female lip 3803. The male lip 3801 and the female lip 3803 ensure that the top and bottom components remain securely mated when the case is closed and/or attached. FIG. 39 illustrates a connection of the male lip 3801 and the female lip 3803. In one embodiment, the male lip 3801 is constructed to snap into the female lip 3803 to mechanically secure the two components. In another embodiment, the male lip 3801 rests within the female lip 3803 without attaching the components. Preferably, the mating lips include at least one sealing element, including a liner, barrier, gasket and/or additional layer. For example, in one embodiment, the sealing element includes at least one layer of silicone, foam, polyvinyl chloride, rubber, elastomer, polyethylene, polypropylene, bitumen, polyvinyl chloride (PVC), polyurethanes, ethylene propylene diene monomer (M-class) rubber EPDM, silicate, bentonite clay, fabrics, fiberglass, cementitious high-build coatings, composite layers, resin coatings, plastic sheeting, polymer liners, mastics, and/or metal sheet. The sealing element provides and improves waterproofing and dust-resistance properties of the case. In one embodiment, the case meets the International Protection Rating (IP Rating) standards of the American National Standards Institute/International Electrotechnical Commission (ANSI/IEC) standards for solid and liquid object protrusion, including ANSI/IEC 60529, which is incorporated by reference herein in its entirety. In one embodiment, the case meets IP5, IP6, or higher protection from solids and 1-9 or higher protection from liquids (i.e., IP51, IP52 . . . IP58, IP69K, etc.). FIG. 40A illustrates a detail section view of a profile of the bottom component, wherein the female lip 3803 includes a sealing element 4001. FIG. 40B illustrates a detail perspective view of the female lip 3803 of the bottom component, wherein the sealing element 4001 is embedded within the female lip 3803. In one embodiment, the female lip 3803 has an embedded sealing element 4001. In another embodiment, the sealing element covers 4001 an entire top surface of the rim and lip of the bottom component. In another embodiment, the sealing element 4001 is part of the top component. In a further embodiment, the sealing element 4001 is a separate component from the top component and the bottom component. Preferably, the sealing element 4001 is attached to the case via at least one mechanical, physical, or chemical means, including by way of an adhesive. In one embodiment, the sealing element is between 1/16 inches (1.5875 millimeters) and 1 inch (25.4 millimeters) thick. In another embodiment, the sealing element is approximately 1/8 inches (3.175 millimeters) thick. Preferably, the sealing element includes at least one desiccant component (e.g., a desiccant bag) that is embedded within the sealing element. In one embodiment, the sealing element includes four desiccant bags, which are embedded within and/or retained by the sealing element. Preferably, the desiccant components are removable for easy replacement.

The edges of the case are, in one embodiment, constructed from a metallic material. For example, in one embodiment, the case edges are constructed from aluminum, such as Aluminum 7075 or Aluminum 5052. In another embodiment, the edges are constructed from steel, copper, carbon fiber, or a combination or metallic and/or other reinforcing materials.

Figure 41:
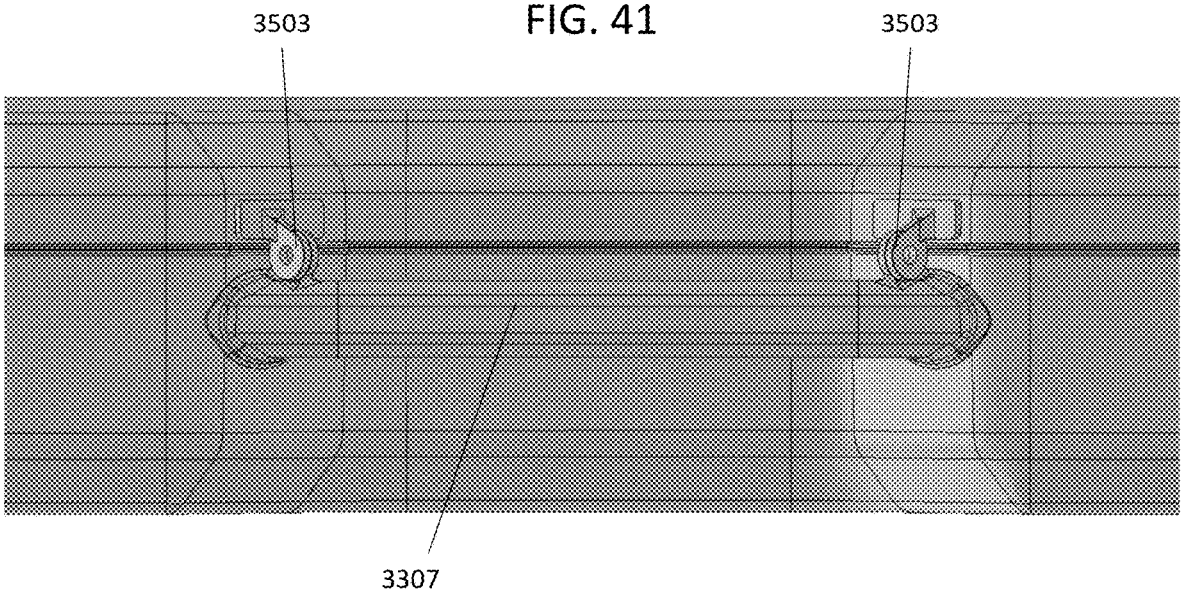
FIG. 41 illustrates a side view of a handle according to one embodiment of the present invention.

FIG. 41 illustrates a detail view of a handle 3307, wherein the handle 3307 is attached to a side exterior surface of the bottom component of the case. The handle 3307 includes a locking mechanism 3503, wherein a first component of the locking mechanism 3503 is attached to the handle 3307, and wherein a second component of the locking mechanism 3503 is attached to a side exterior surface of the top component of the case. In one embodiment, the first component of the locking mechanism 3503 is a lug with a bore, wherein the second component of the locking mechanism 3503 is a hasp with a corresponding bore such that a lock, pin, or other object is operable to be inserted to secure the top component and the bottom component together. The locking mechanism 3503 and each of the individual components of the locking mechanism 3503 are attached via chemical, physical, or mechanical means, including a bolt, screw, rivet, adhesive, or other attachment mechanism. In one embodiment, the locking mechanism is constructed from a metallic material, such as aluminum, steel, or titanium. In another embodiment, the locking mechanism is constructed from plastic, carbon fiber, carbon-fiber reinforced metal, or carbon-fiber reinforced plastic.

In one embodiment, an interior of the equipment case includes microbead retaining element containing a microbead filling that secures an equipment. The microbead filling is, in one embodiment, contained within at least one layer, wherein the at least one layer is constructed from any malleable natural or synthetic material, either woven or non-woven, such as cotton, polyester, polyurethane, cellophane, or any other material that is suitable for containing microbead filling. The retaining element employs principles of "vacuum splints," "granular jamming," or similar negative pressure packaging mechanisms with granular particles. When in a normal pressure state, particles are loosely contained. The retaining element is constructed to receive and surround an object (e.g., a firearm, a sword, a surfboard, or a camera) when the object is placed on top of the retaining element. For example, in one use case, equipment is positioned on top of and pressed into the retaining element such that the contained microbeads rearrange to allow the equipment to sink into the retaining element and such that the microbeads and retaining element surround at least part of a side of the equipment. The retaining element includes at least one air valve for adjusting an amount of air contained in addition to the microbeads. As air is evacuated from the retaining element, the containing layers and microbeads condense, resulting a in much firmer structure. Advantageously, the retaining element allows for adjustability in an amount of air evacuated, such that resulting a strength of the retaining element and pressure on an object matches the level of security desired.

FIG. 42 illustrates one embodiment of a retaining element 4201, wherein the retaining element 4201 secures an object 4203 via vacuum splinting. Notably, the retaining element 4201 is rigid when air is evacuated and the object 4203 secured. The retaining element 4201 preferably secures a bottom at least one side of the object 4203. However, in one embodiment, the retaining element 4201 does not perfectly fit a shape of the object 4203, but instead the retaining element 4201 provides some contact and support to the bottom and at least one side of the object 4203. An air valve 4205 regulates air within the retaining element 4201 and allows for the retaining element to be manually or automatically filled with air or evacuated of air.

The air valve 4205, in one embodiment, is a nozzle with a manually or automatically controlled pump. For example, in one embodiment, the nozzle interfaces with a pump integrated and/or attached with the equipment case, wherein upon manual or automatic activation of the pump, air is removed from the retaining element. In another embodiment, the nozzle interfaces with a manual hand pump, wherein air is manually extracted from the retaining element. In another embodiment, the nozzle includes an adapter for attaching to an external pump, including an adapter for connection to a home vacuum cleaner. The equipment case is further operable to include one or more sensors, wherein one or more sensors detect, individually or in combination, any number of variables measurable within the retaining element, including pressure, temperature, moisture level, contact, or other variables. In one embodiment, the equipment case is operable to detect that the case was shut and automatically activate a pump and evacuate the retaining element.

The microbeads are preferably any high or medium strength material, including rubber, polystyrene, wood, metal, wherein the material is any that withstands compression through evacuation while providing stability to surrounded objects. In an alternative embodiment, the microbeads are millet shells, coffee grounds, rice grains, buckwheat hulls or any other organic material. Notably, the microbeads are any shape, size or dimensions that effectively perform the retaining functions, such as spheres, ellipsoids, cubes, prisms, other polygons, or any non-uniform shape, such as that exhibited by shredded rubber or natural or synthetic fibers. In one embodiment, the microbeads are polystyrene beads, wherein the polystyrene beads are between 0.0197 inches (0.5 millimeters) and 0.394 inches (10 millimeters). In a preferred embodiment, the polystyrene beads are between 0.0197 inches (0.5 millimeters) and 0.197 inches (5 millimeters).

Figure 42A:
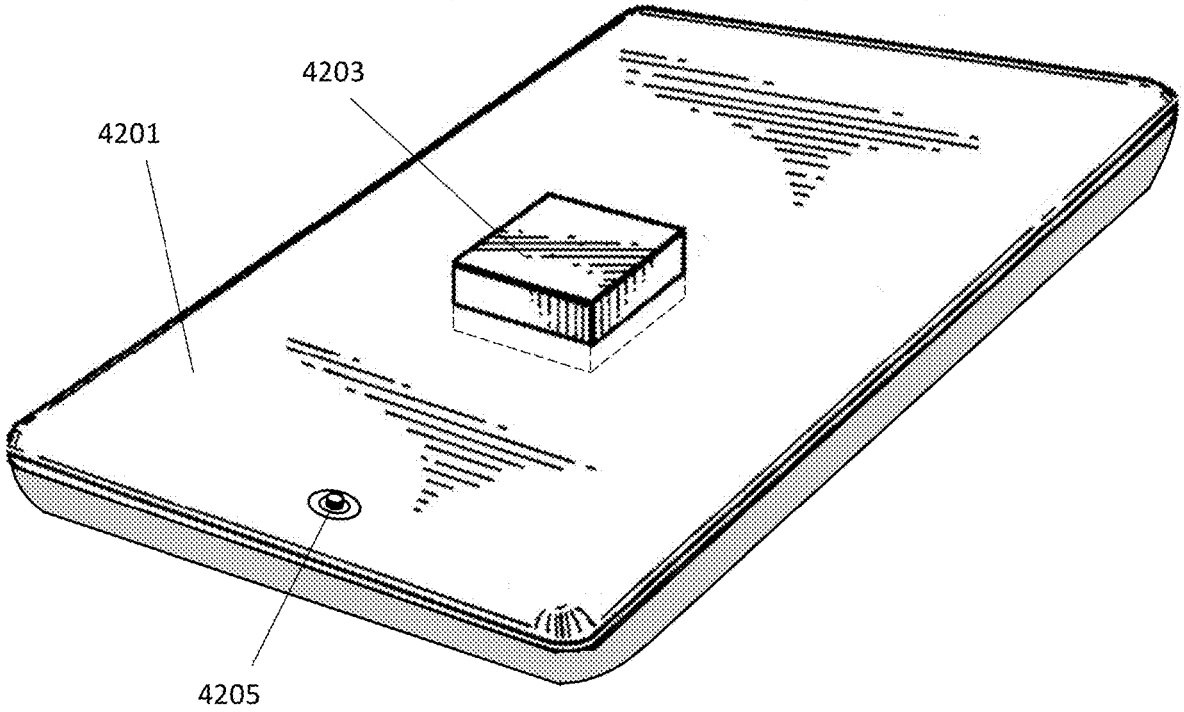
FIG. 42A illustrates a top perspective view of a retaining element with a retained object according to one embodiment of the present invention.
Figure 42B:
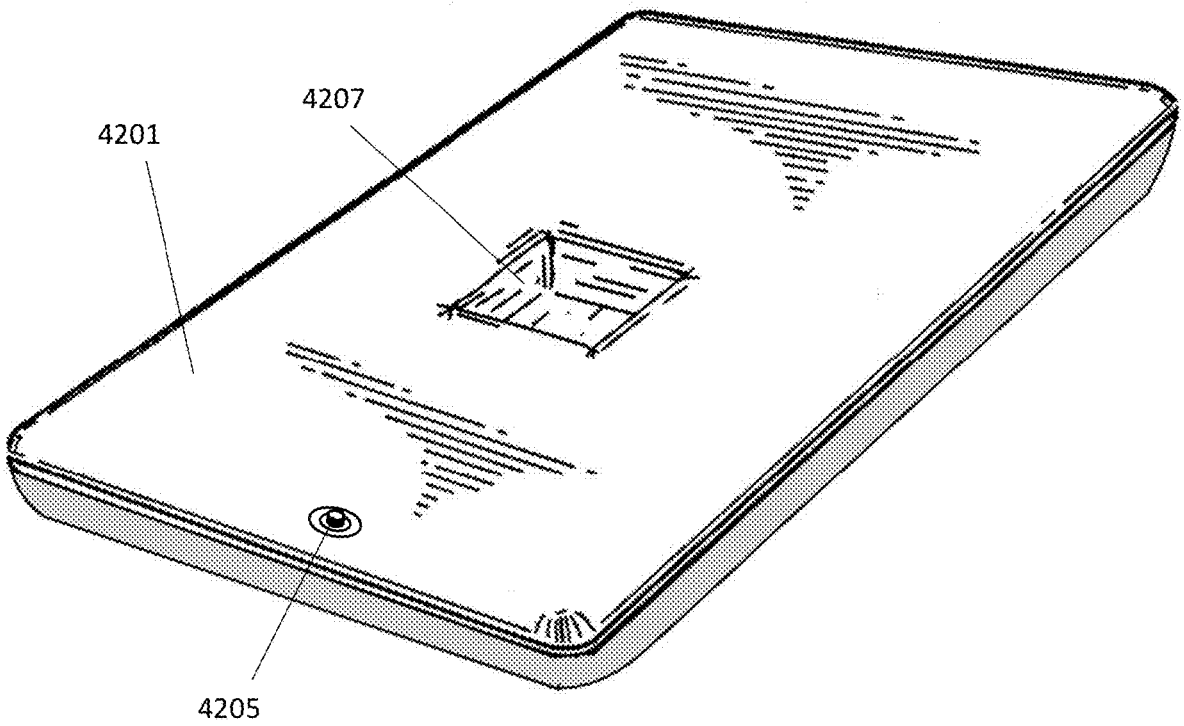
FIG. 42B illustrates a top perspective view of a retaining element with a maintained structural shape corresponding to a removed object according to one embodiment of the present invention.
Figure 43A:
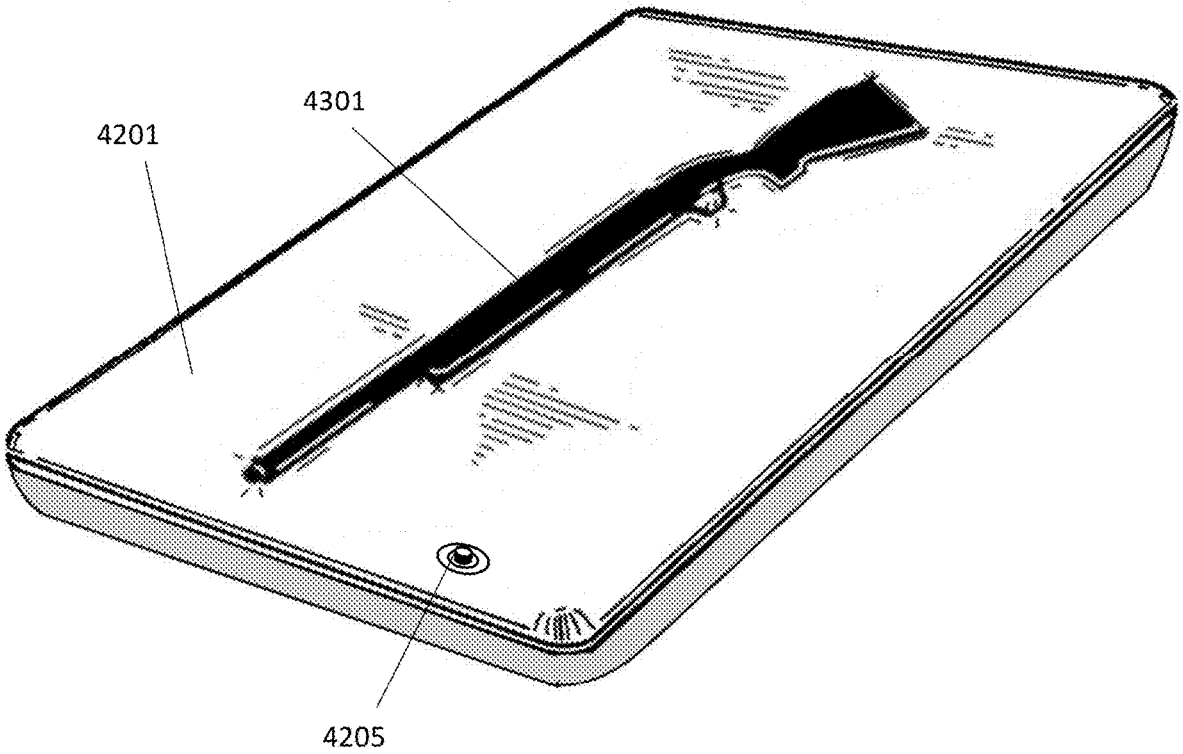
FIG. 43A illustrates a top perspective view of a retaining element with a retained equipment according to one embodiment of the present invention.
Figure 43B:
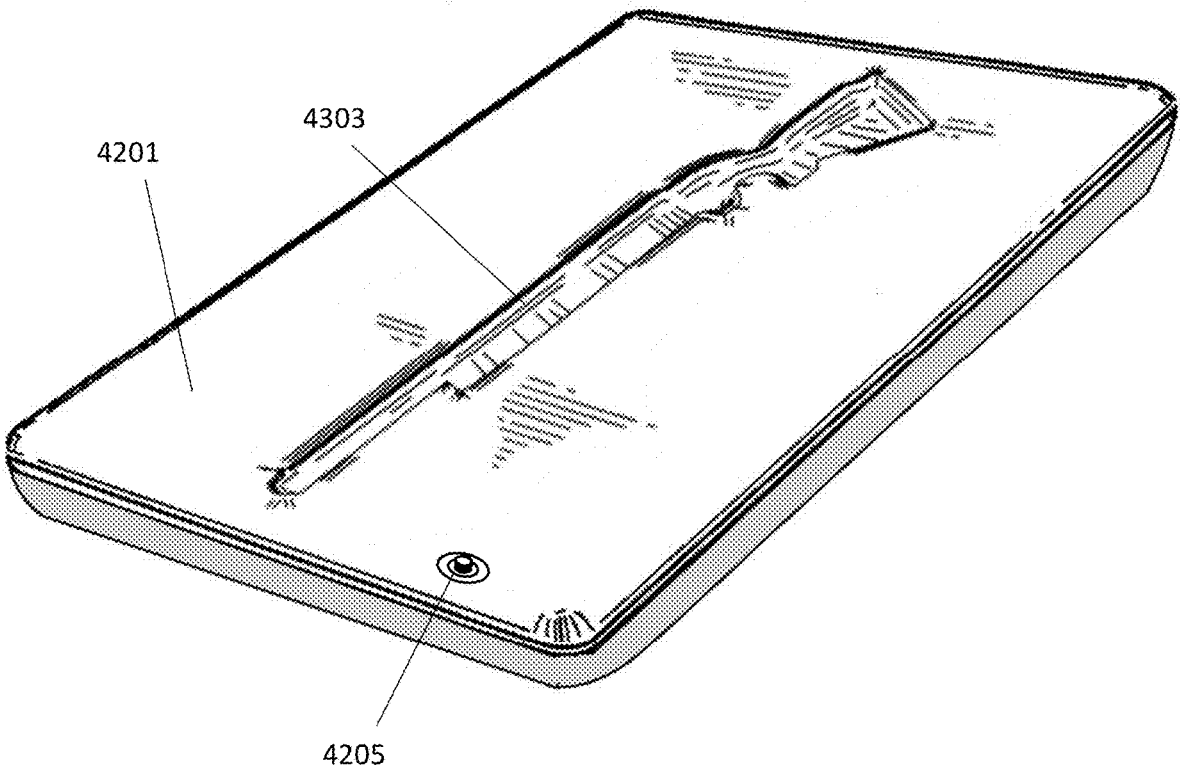
FIG. 43B illustrates a top perspective view of a retaining element with a maintained structural shape corresponding to a removed equipment according to one embodiment of the present invention.

In one embodiment, the retaining element 4201 is operable to retain its shape over hours, days, weeks, or years without adjustment from the air valve 4205. FIG. 42B illustrates one embodiment, wherein upon removal of an object 4203, the retaining element 4201 maintains its structural shape 4207. This advantageously provides for an alternative to foam-based retaining structures, such as polyurethane or polyethylene foam with cut-outs or indentions for objects, which are commonly used within traditional cases, such as those for cameras, firearms, or fragile items. In contrast to these traditional cases, the combination of a retaining element with a hard-shell exterior allows for both improved object retention as well as customizable and adaptable organization. Since the retaining element has an adjustable level of rigidity corresponding to an amount of contained air, the retaining element is operable to accommodate a wide number of uses per a single case. For example, protecting some objects during transportation requires a softer feel with more allowed movement while being transported. Protecting other objects during transportation requires more rigidity to minimize movement. The retaining element is fully adjustable for any desired rigidity setting. Additionally, since the retaining element is operable to mold to and secure most objects, users are not limited to a single layout for objects, as is the case with foam-based traditional cases. Instead, the case is operable to accept objects in any pattern, order, or layout and secure these objects in place. If users wish to add additional objects to the case and/or rearrange secured objects, the retaining element is operable to be filled with air, the objects resituated, and the air evacuated. This provides a high level of customization that is currently not available in protective cases. FIG. 43A illustrates one embodiment of a firearm 4301 secured in the retaining element 4201, and FIG. 43B illustrates a structural shape 4303 maintained by the firearm upon removal. In one embodiment, the retaining element 4201 secures the object but allows slight movement to promote easy removal of a retained object. In another embodiment, the retaining element secures objects through combination with one or more additional padding or securing layers, such as foam that secures a top side of the object embedded within the retaining element.

Figure 44:
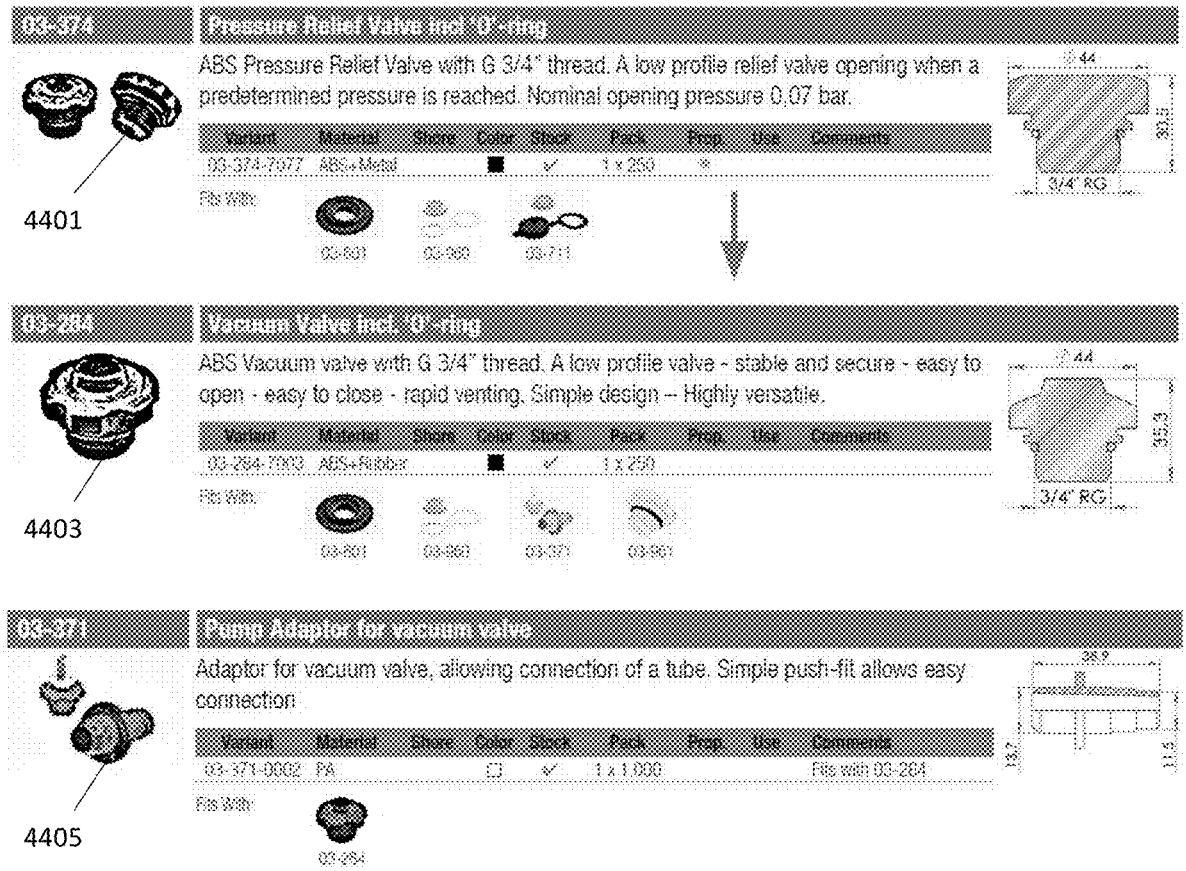
FIG. 44 illustrates valves and adapters for a retaining element according to one embodiment of the present invention.
Figure 45A:
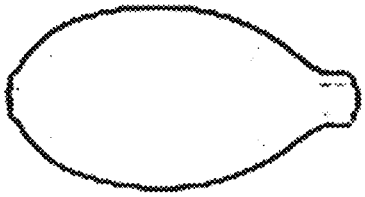
FIG. 45A illustrates a first manual pump for the retaining element according to one embodiment of the present invention.
Figure 45B:
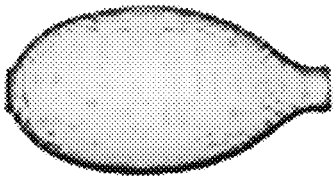
FIG. 45B illustrates a second manual pump for the retaining element according to one embodiment of the present invention.
Figure 45C:
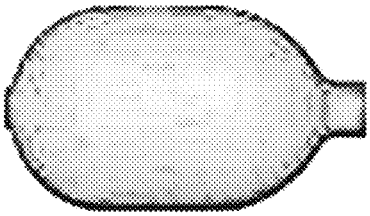
FIG. 45C illustrates a third manual pump for the retaining element according to one embodiment of the present invention.
Figure 45D:
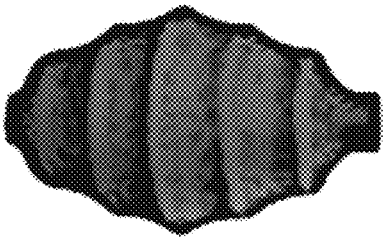
FIG. 45D illustrates a fourth manual pump for the retaining element according to one embodiment of the present invention.
Figure 45E:
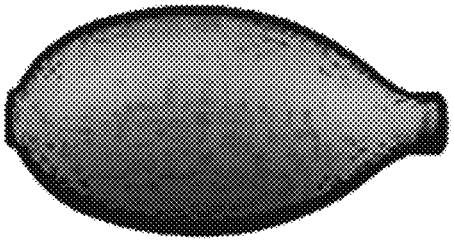
FIG. 45E illustrates a fifth manual pump for the retaining element according to one embodiment of the present invention.

FIG. 44 illustrates three different embodiments of valves operable to maintain and regulate air within a retaining element. In one embodiment, the valve is a pressure relief valve 4401 with a G ¾ inch (19.05 millimeter) thread, a low profile relief valve that opens when a predetermined pressure is reached, and a nominal opening pressure at 0.07 bar. In another embodiment, the valve is a vacuum valve 4403 with a G ¾ inch (19.05 millimeter) thread, a low profile valve that is easy to open and close and exhibits rapid venting. In another embodiment, the vacuum valve 4403 includes an adapter 4405, wherein the adapter 4405 allows connection of a small tube and attaches to the vacuum vale 4403 with a push-fit connection. FIGS. 45A-E illustrate five different embodiments of manual pump adapters operable to be used in combination with the vacuum valve adapter 4405. Preferably, a valve is a one-way valve, wherein the valve is operable to allow any remaining air escape from the retaining element once some air has been evacuated, but wherein the valve does not allow air to enter the retaining element.

Figure 46A:
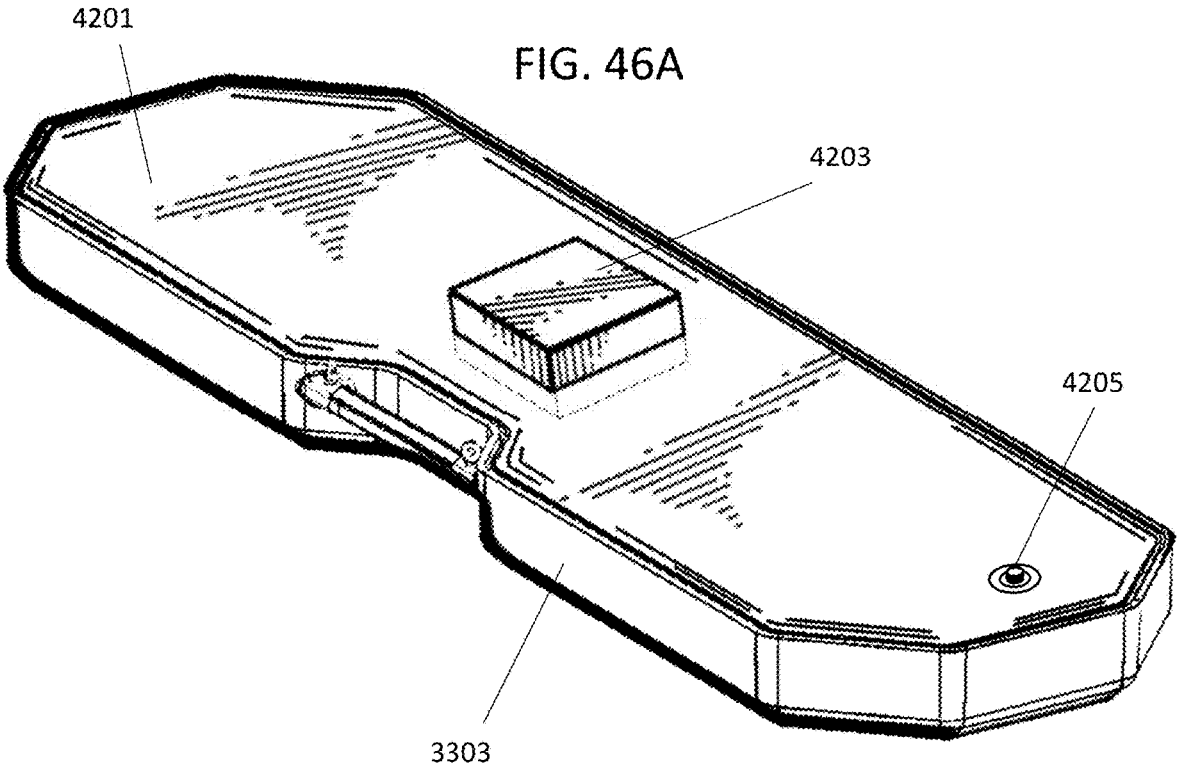
FIG. 46A illustrates a top perspective view of a protective case with a retaining element and a retained object according to one embodiment of the present invention.
Figure 46B:
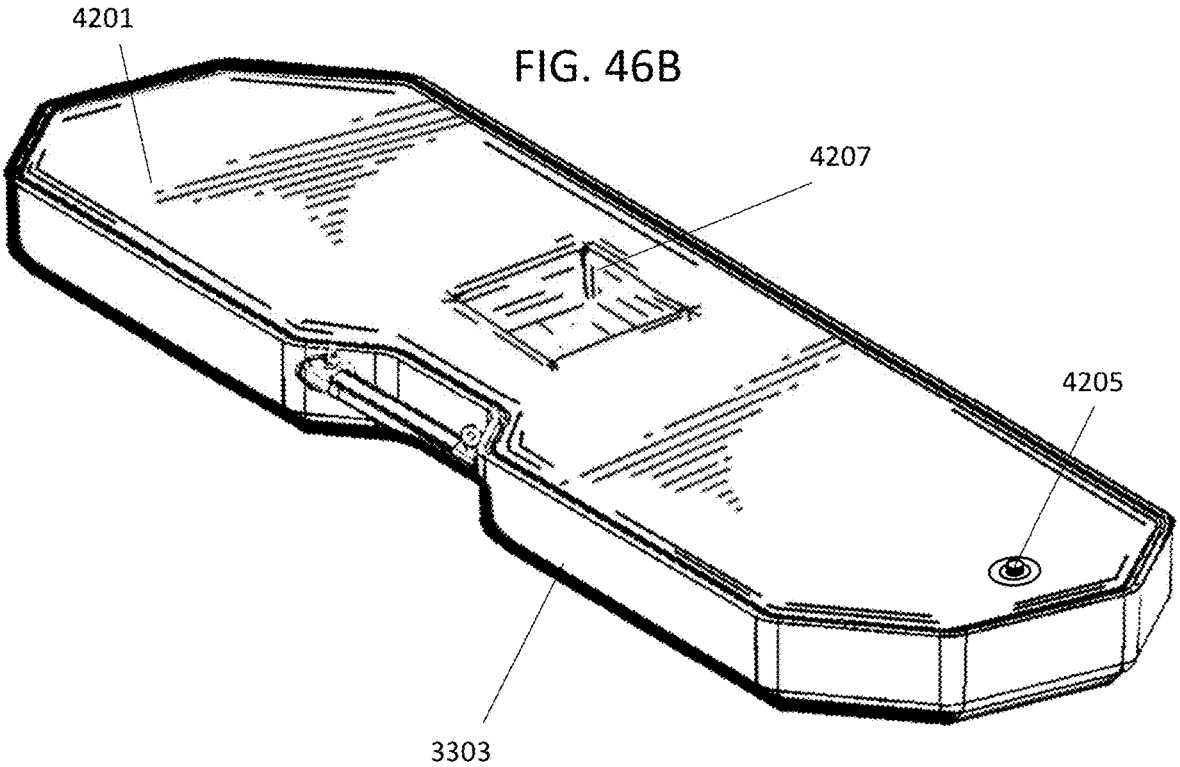
FIG. 46B illustrates a top perspective view of a protective case with a retaining element and maintained structural shape corresponding to a removed object according to one embodiment of the present invention.

FIG. 46A illustrates one embodiment of the retaining element 4201 in positioned within a bottom component 3303 of the case. In one embodiment, the retaining element 4201 is attached to the case via a hook-and-loop mechanism. In another embodiment, the retaining element 4201 is attached via an adhesive. In a further embodiment, the retaining element 4201 is attached via mechanical means, such as bolts, screws, latches, snaps, and/or buckles. In yet another embodiment, the retaining element 4201 merely sits in the case without attachment. FIG. 46B illustrates one embodiment of the retaining element 4201 with the object 4203 removed and the maintained structural shape 4207.

Figure 47A:
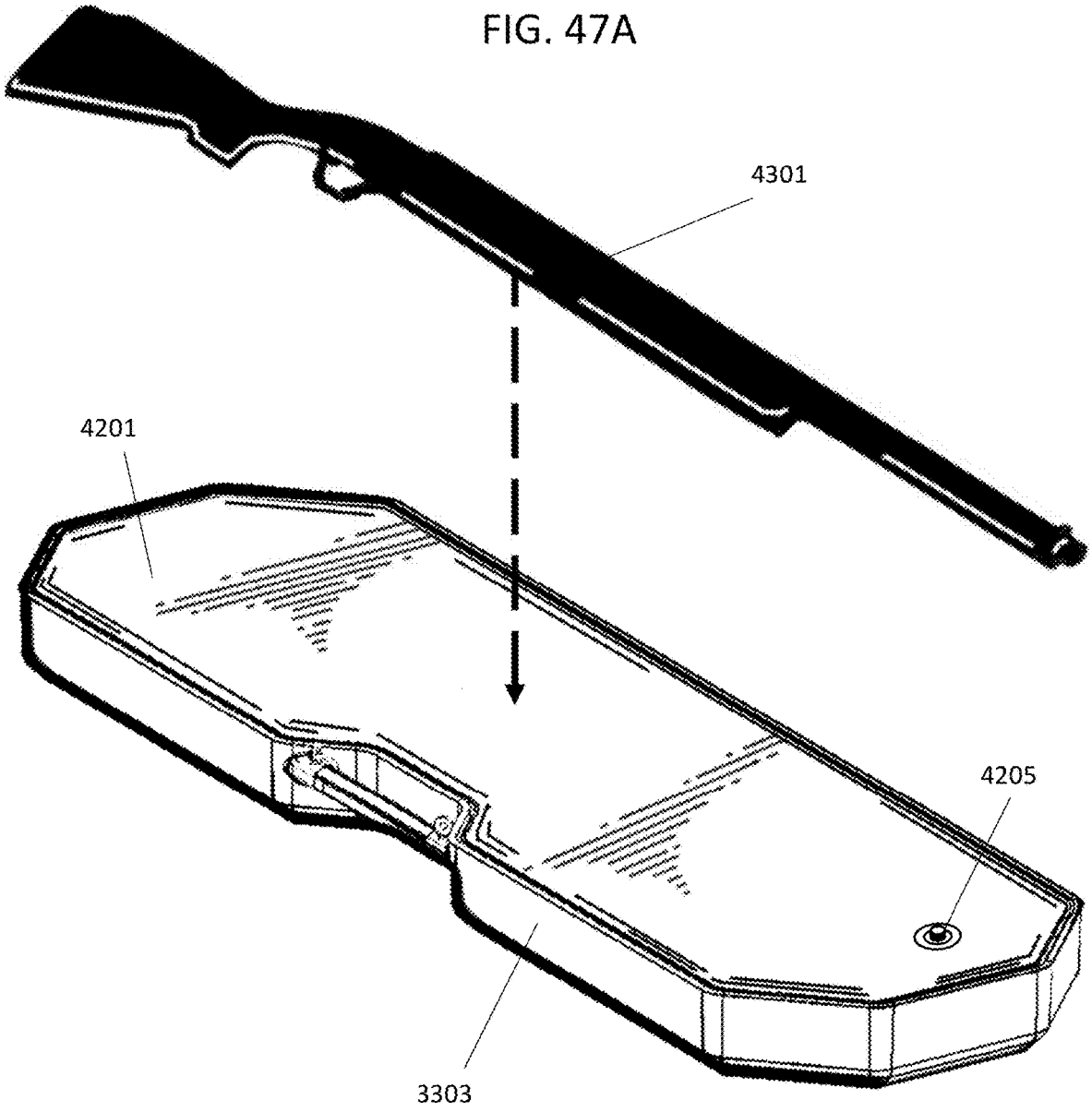
FIG. 47A illustrates a diagram of an equipment being inserted into a protective case with a retaining element according to one embodiment of the present invention.
Figure 47B:
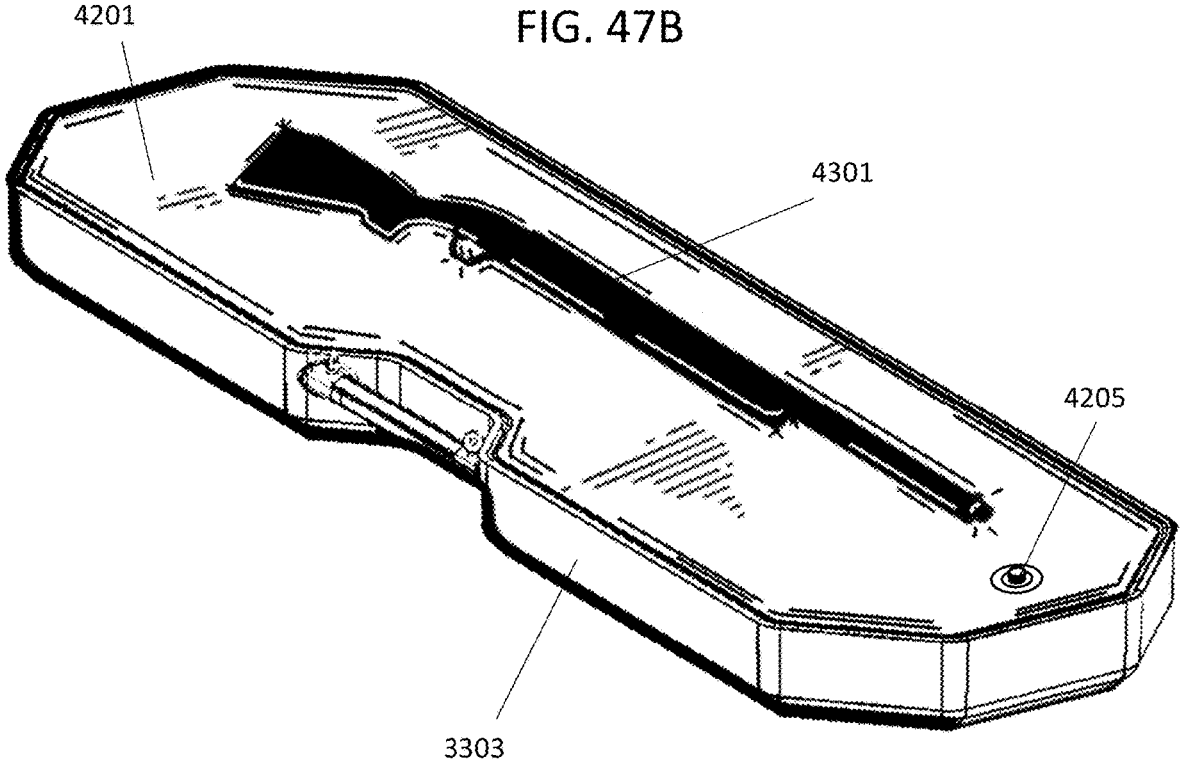
FIG. 47B illustrates a top perspective view of a protective case with a retaining element and a retained equipment according to one embodiment of the present invention.
Figure 47C:
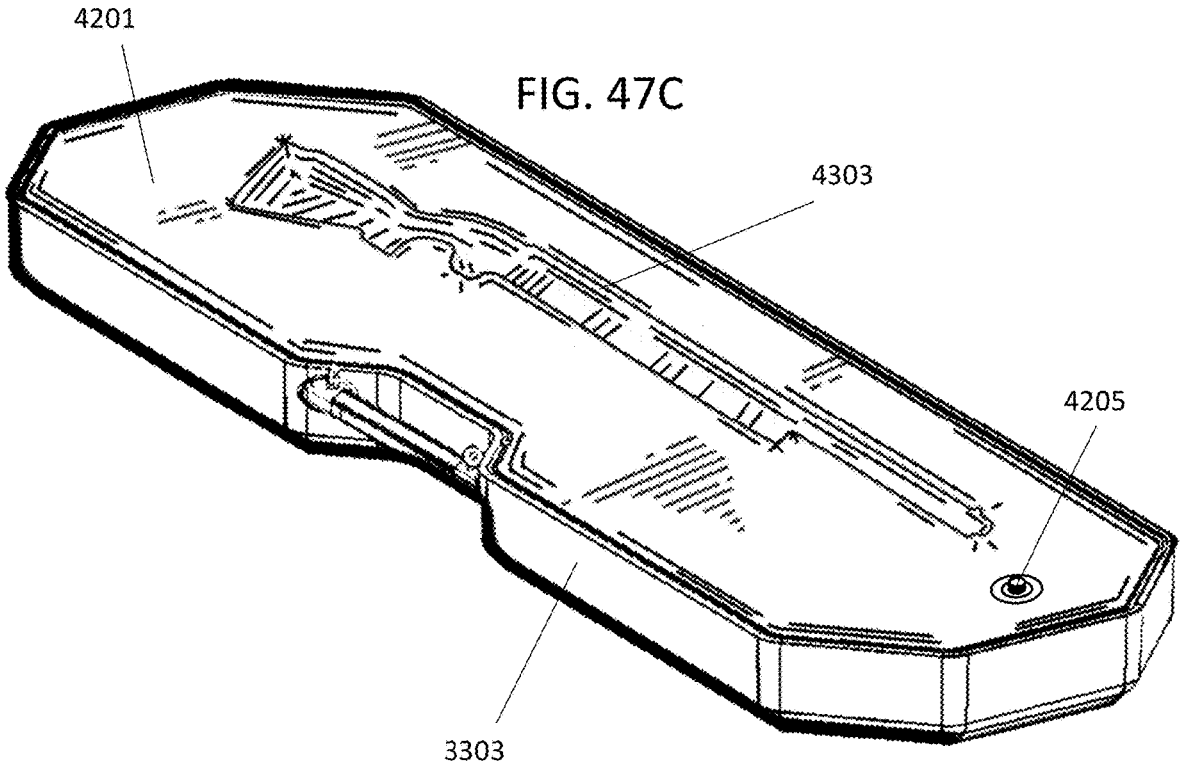
FIG. 47C illustrates a protective case with a retaining element and maintained structural shape corresponding to a removed equipment according to one embodiment of the present invention.

FIG. 47A illustrates a firearm 4301 being embedded and/or placed on the retaining element 4201. FIG. 47B illustrates the firearm 4301 embedded within the retaining element 4201, and FIG. 47C illustrates the firearm 4301 removed with a maintained structural shape 4303 of the retaining element 4201.

Figure 47D:
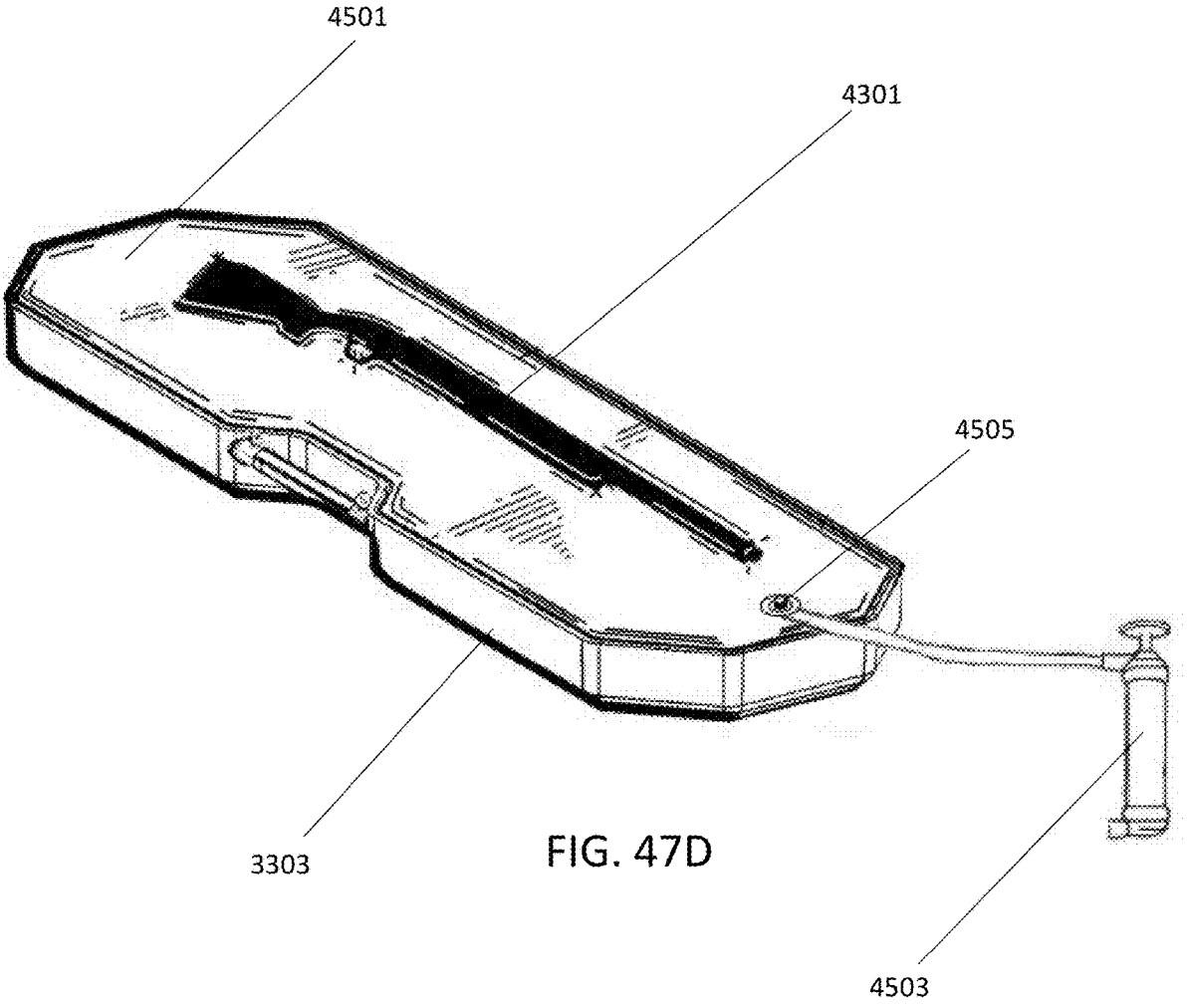
FIG. 47D illustrates a protective case with a retaining element connected to a pump and a retained equipment according to one embodiment of the present invention.
Figure 47E:
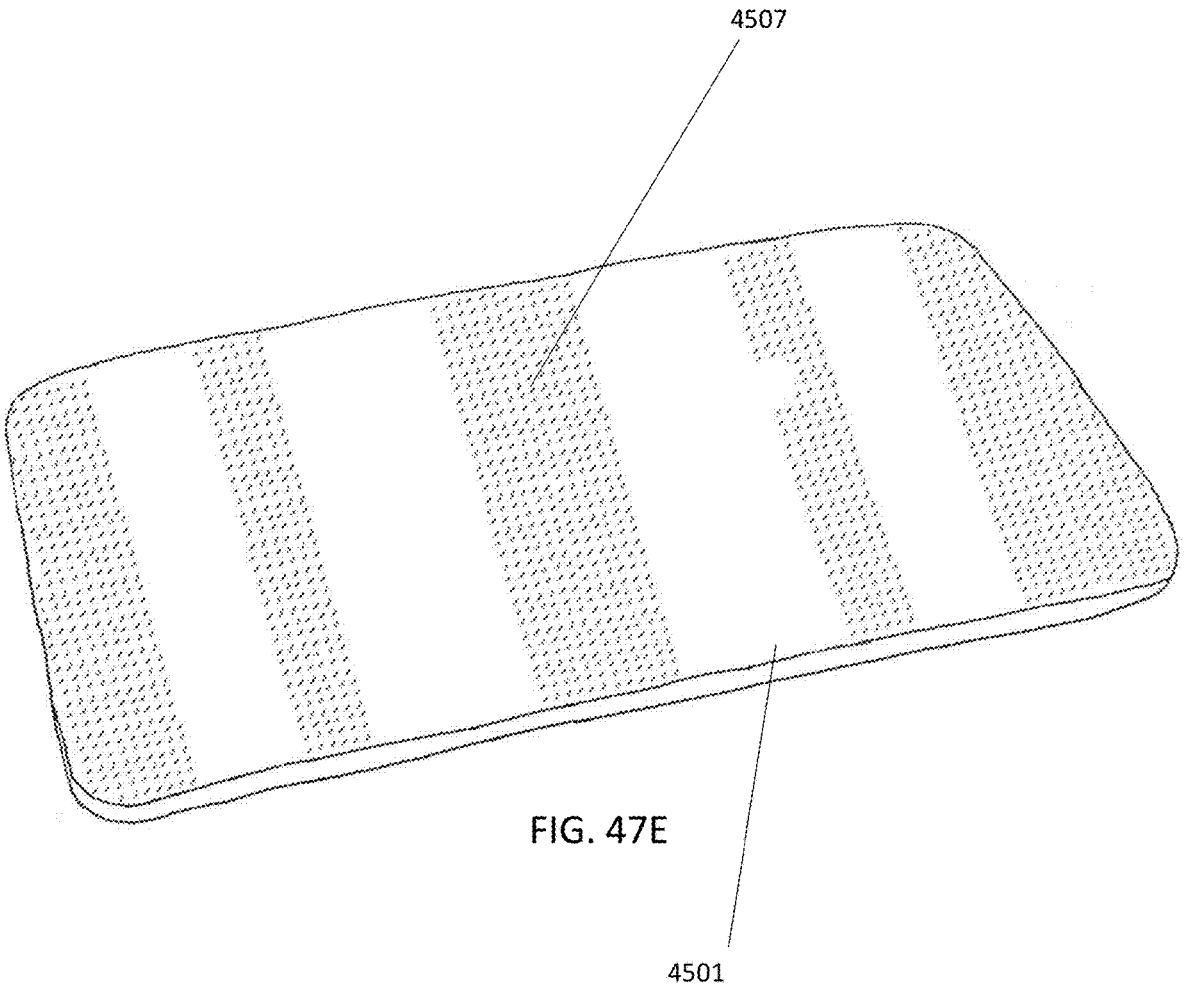
FIG. 47E illustrates a retaining element including a surface with hook and loop elements according to one embodiment of the present invention.
Figure 47F:
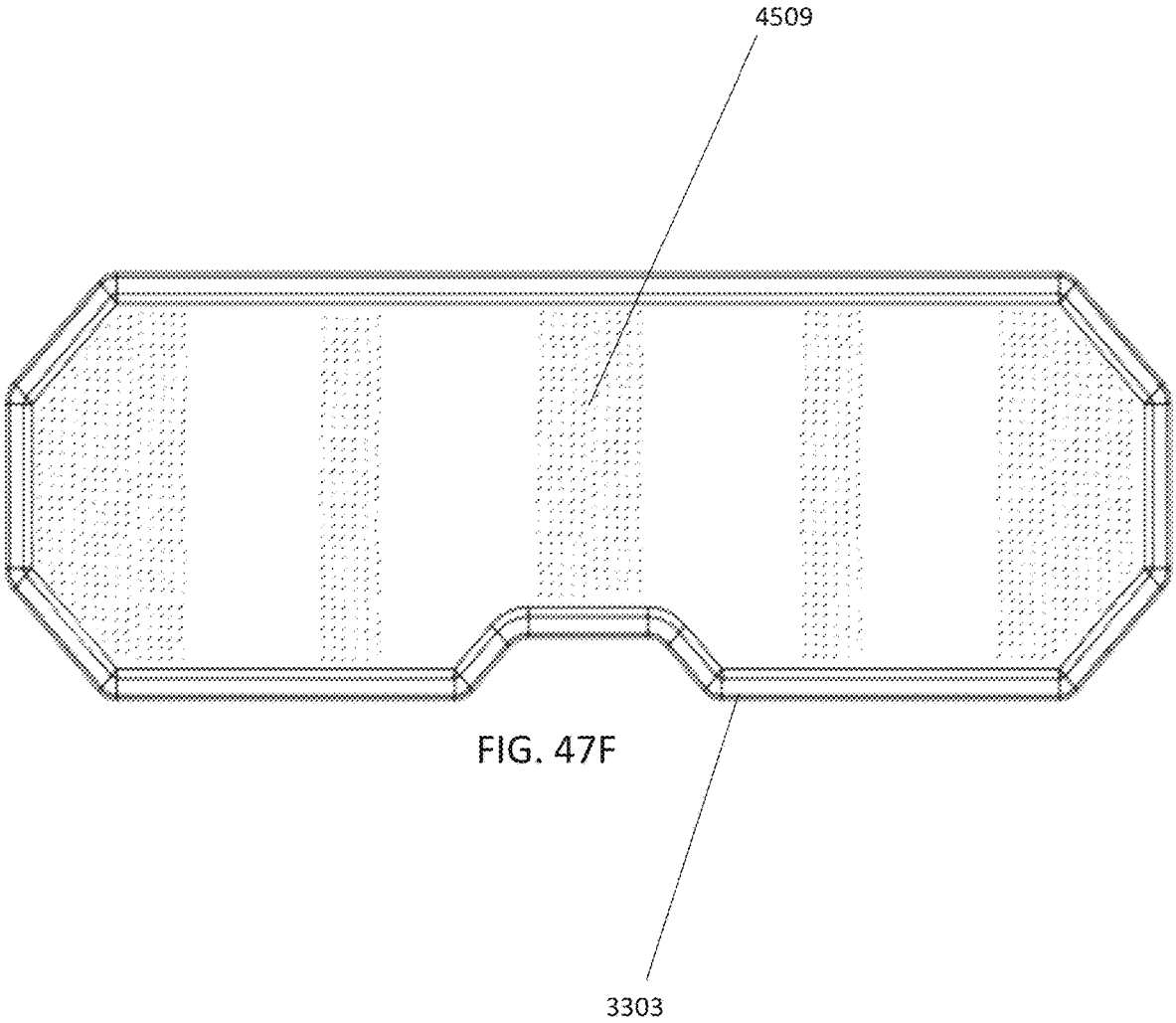
FIG. 47F illustrates a bottom component of a protective case with hook and loop elements according to one embodiment of the present invention.
Figure 47G:
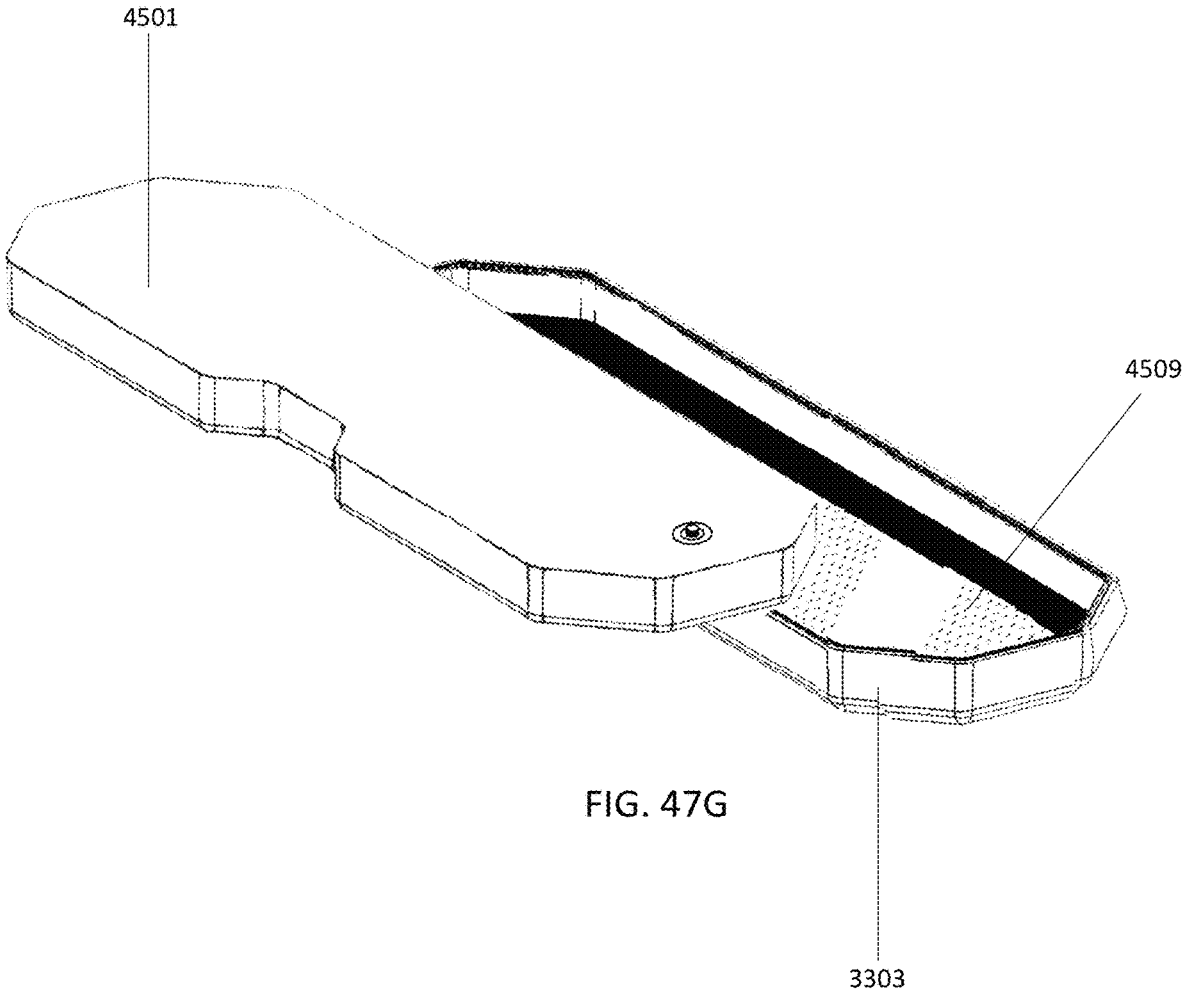
FIG. 47G illustrates an exploded view of a retaining element and a protective case, each having hook and loop elements according to one embodiment of the present invention.

In one embodiment, as shown in FIG. 47D, a retaining bag 4501 is inserted into the bottom component 3303 of the case and filled with air in order to serve as a retaining element. FIG. 47E illustrates a retaining element including a surface with hook and loop elements according to one embodiment of the present invention. FIG. 47F illustrates a bottom component of a protective case with hook and loop elements according to one embodiment of the present invention. FIG. 47G illustrates an exploded view of a retaining element and a protective case, each having hook and loop elements according to one embodiment of the present invention.

In one embodiment, at least a portion of the external surface of the retaining bag 4501 is covered with hook elements 4507. Loop elements 4509 line a portion of the internal surface of the bottom component 3303 of the case, such that the retaining bag 4501 is securely connected with the bottom component 3303 case via a hook and loop mechanism. In one embodiment, the hook and loop mechanism includes DUAL LOCK fasteners. DUAL LOCK fasteners utilize interlocking mushroom-shaped heads and have five times the tensile strength of traditional hook and loop products. Additionally, DUAL LOCK fasteners reduce vibration, meaning that the firearm is less likely to shift within the case as the hook and loop mechanism will move and shift less while in use. In another embodiment, the retaining bag 4501 is connected to the top component 3301 of the case. In still another embodiment, a portion of the external surface of the retaining bag 4501 is covered with loop elements, while a portion of the internal surface of the bottom component 3303 of the case is covered with hook elements. In yet another embodiment, connection methods other than a hook and loop mechanism are used to secure the retaining bag 4501 to the bottom component 3303 of the case, such as an adhesive tape, a plurality of buttons, at least one zipper, twist ties, and/or other retaining features. Because the retaining bag 4501 is not integrally formed with the case, it is able to be transferred to other cases or used in other applications, allowing for greater flexibility. In addition, if the retaining bag 4501 breaks, it is able to be replaced, while if it is shifted out of position, it is able to be detached and reattached with ease. Furthermore, as the retaining bag 4501 is flexible, a single retaining bag 4501 is able to be adapted to cases of a variety of sizes and shapes.

In one embodiment, the hook elements 4507 are sewn onto the retaining bag 4501 after the retaining bag 4501 has been closed and sealed. In another embodiment, the loop elements 4509 are attached to the bottom component 3303 of the case via an acrylic adhesive. In still another embodiment, the hook elements 4507 are attached to the retaining bag 4501 via means other than sewing, such as welding of a metal backing component, an adhesive backing, or screws. In yet another embodiment, the loop elements 4509 are attached to the bottom component 3303 of the case via means other than an acrylic adhesive, such as screws, bolts, or welding of a metal backing component.

Once the retaining bag 4501 is positioned within the case, a pump 4503 is then used to deliver air into the retaining bag 4501 via an intake valve 4505. As the retaining bag 4501 includes an airtight sealed interior, the action of the pump 4503 causes the retaining bag 4501 to inflate. In one embodiment, the intake valve 4505 is rotated by the user in order to open the intake valve 4505 and allow air to flow in without the use of the pump 4503. Once the retaining bag 4501 is fully inflated, at least one firearm 4301 is laid across the retaining bag 4301. A pump 4503 is then used to suction air out of the retaining bag 4501, causing it to deflate. In one embodiment, the retaining bag is filled with a packaging material, such as Styrofoam, polystyrene beads, and/or polylactic acid beads. When air is removed from the retaining bag 4501, the packaging material becomes more compact, causing it to more closely surround and retain the at least one firearm 4301. In one embodiment, the retaining bag 4501 is smoothed by a user before placing the at least one firearm 4301 on the retaining bag 4501 so as to ensure a more even distribution of packaging material. In one embodiment, the retaining bag 4501 is made of a polymer, including a thermoplastic polyurethane.

In one embodiment, when at least one firearm 4301 is placed on top of the retaining bag 4501, the packaging material within the retaining bag 4501 become displaced, forming an impression in the shape of the firearm 4301 on the surface of the retaining bag 4501. Furthermore, displacement of the packaging material causes the packaging material to then condense around the firearm 4301. After the packaging material has condensed around the firearm 4301, the firearm 4301 is kept in position within the case, even if the case is rotated or turned over.

In an alternative embodiment, the case includes two or more retaining elements. For example, in one embodiment, the case includes two retaining elements that are positioned side-by-side. In another embodiment, the case includes dividers and/or separators that contain and separate two or more retaining elements. In a further embodiment, the case includes multiple compartments of differing sizes and individual retaining elements and/or adjustable separators. The case is further operable to contain and secure two or more retaining elements stacked within the case. For example, in one embodiment, a first retaining element secures a first firearm, a second retaining element is positioned on top of the first firearm, and a second firearm is embedded within the second retaining element. In another embodiment, a divider or barrier, such as a sheet of plastic, metal, wood, or other material, is positioned below the second retaining element. Alternatively, a top and a bottom component of the case each include at least one retaining element.

Figure 48D:
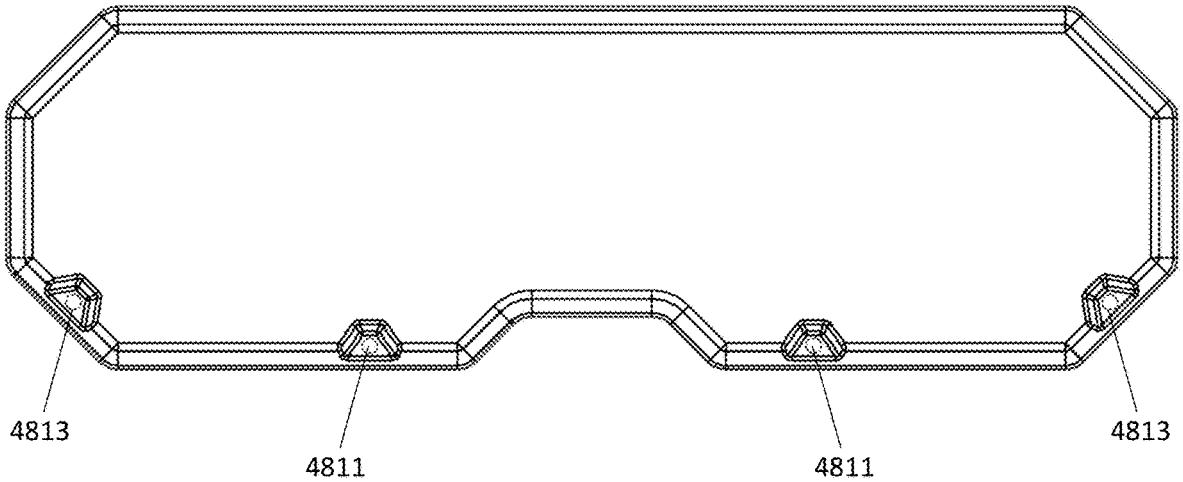
FIG. 48D illustrates a top view of a case with four quick-release latches according to one embodiment of the present invention.

FIGS. 48A, 48B, and 48C illustrate exploded perspective views of a corner latch according to one embodiment of the present invention. The latch includes a pin 4801, a retaining cylinder 4803, and a support arm 4805. Preferably, the pin 4801 is attached to the support arm 4805, wherein the support arm 4801 is attached to an inside of a bottom component of the case. The retaining cylinder 4803 is attached to a top component of the case and locks to the pin 4801. The retaining cylinder 4803 is operable to tighten and secure around a ball of the pin 4801 to secure the top component of the case to the bottom component of the case. In one embodiment, the retaining cylinder 4803 includes a key-lock mechanism. In one embodiment, the case includes one or more latches, wherein the one or more latches are located on a corner of the case. In another embodiment, the latches are located anywhere that is operable to secure a top component to the bottom component, such as a latch in the middle of the case, multiple latches along an edge of the case, or external latches along outside exterior surfaces of the top and bottom components of the case. Preferably, the latch is a quick-release latch as illustrated in FIGS. 48A-48C and FIGS. 30 and 31. In another embodiment, the latches are instead any other form of locking mechanism and/or fastener known in the art, including latches, buckles, snaps, sliders, or hooks. Notably, the locking mechanisms and/or fasteners are attached to the case via any physical, chemical, or mechanical means, including by way of an adhesive, friction, or clasp. FIG. 48B illustrates a top perspective exploded view of the latch, illustrating a bore 4807 within which the retaining cylinder 4803 is operable to sit and through which the retaining cylinder is operable to attach to the pin 4801. Notably, the retaining cylinder includes a lip 4809 that is wider than the bore 4807, wherein the lip is operable to catch on the top component and provide compressive force when the latch is secured. FIG. 48C illustrates a detail perspective view of the retaining cylinder 4803 attached to the pin 4801 when secured. The top component of the case is removed in this view to illustrate the attachment mechanism of the latch. FIG. 48D illustrates a top view of one embodiment of a case, wherein the case includes four latches (4811, 4813), wherein a first two of the latches 4811 are locking latches, and wherein a second two of the latches 4813 are non-locking latches. In another embodiment, the first two of the latches 4811 are non-locking latches, and a second two of the latches 4813 are locking latches. In further embodiments, the case is operable to include any number of locking or non-locking latches. The latches, in one embodiment, are locked via a key. In another embodiment, the latches are locked via a dial combination, a push-button combination, wireless credentials, biometric identification, or any mechanical and/or electronic lock mechanism known in the art. In one embodiment, centers of the first two of the latches 4811 are between 300 and 1000 millimeters (11.81 and 39.37 inches) apart. In another embodiment, the centers of the first two of the latches 4811 are between 500 and 600 millimeters (19.69 and 23.62 inches) apart. In a further embodiment, the centers of the first two of the latches 4811 are approximately 550 millimeters apart (21.65 inches). In one embodiment, centers of the second two of the latches 4811 are between 300 and 1550 millimeters (11.81 and 61.02 inches) apart. In another embodiment, the centers of the second two of the latches 4811 are between 1000 and 1500 millimeters (39.37 and 59.06 inches) apart. In a further embodiment, the centers of the second two of the latches 4811 are approximately 1283 millimeters (50.51 inches) apart.

Figure 49A:
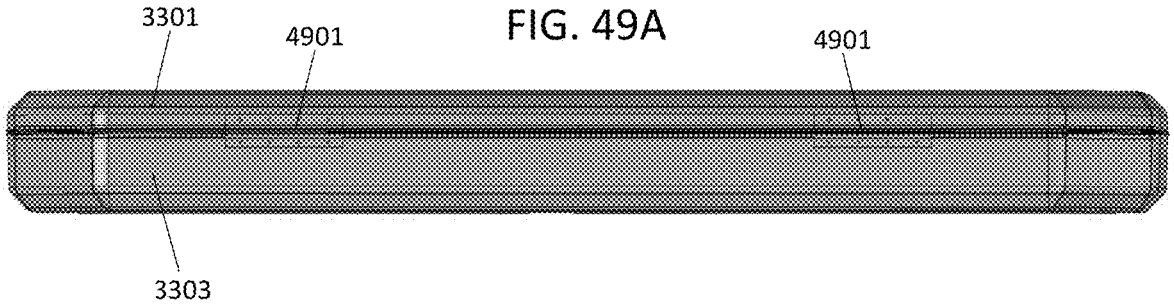
FIG. 49A illustrates a side view of hinges according to one embodiment of the present invention.
Figure 49B:
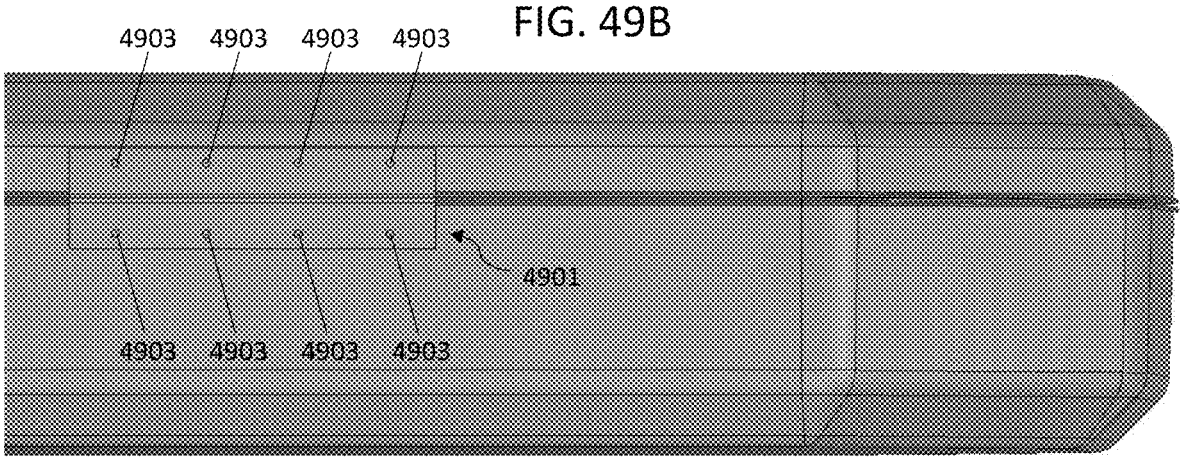
FIG. 49B illustrates a detailed side view of a hinge with rivets according to one embodiment of the present invention.

FIGS. 49A and 49B illustrate hinges 4901 and rivets 4903 of the case, wherein the hinges provide a pivot point to the case and secure a top component 3301 to a bottom component 3303. FIG. 49A illustrates one embodiment of hinge 4901 positions, wherein two hinges 4901 are symmetrically positioned along a side of the case and attach the top component 3301 of the case to the bottom component 3303 of the case. FIG. 49B illustrates a detail view of the hinge 4901 with rivets 4903, which attach the hinge to the case. In one embodiment, the hinges 4901 are constructed from carbon fiber and/or aramid fibers (e.g., KEVLAR, TWARON, or NOMEX). The carbon fiber hinge provides a secure connection between the top component and the bottom component without the need for breakable, moving components. In another embodiment, the hinge 4901 is constructed from a carbon fiber-reinforced metallic material. The hinge is, in one embodiment, riveted to the case, wherein a subsequent layer of carbon fiber is attached to an outside of the hinge to reinforce the component. Notably, one, two, three, or more hinges 4901 are operable to secure the top component 3301 to the bottom component 3303, and the hinges 4901 are operable to be positioned at any location along one or more sides of the case. For example, in one embodiment, the hinges 4901 are positioned at a top or bottom end of the case. In another embodiment, the hinges are positioned at a left or right edge of the case.

In another embodiment, the hinge 4901 is constructed with poly-para-phenylene terephthalamide bead (i.e. KEVLAR bead) or another aramid and includes a carbon leaf on either side of the KEVLAR. Ensuring the KEVLAR section is starved and void of any carbon advantageously allows the hinge 4901 to flex with the intended hinging functionality. In one embodiment, the hinge 4901 is a 25 mm Carbon Fibre hinge with a thickness between 1.6 millimeters and 5.5 millimeters (0.063 inches and 0.2165 inches) from TALON TECHNOLOGY.

Figure 49C:
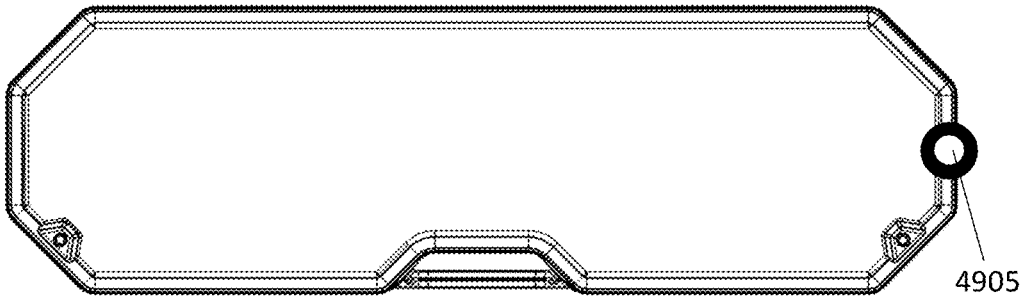
FIG. 49C illustrates a top view of a protective case with wheels according to one embodiment of the present invention.
Figure 49D:
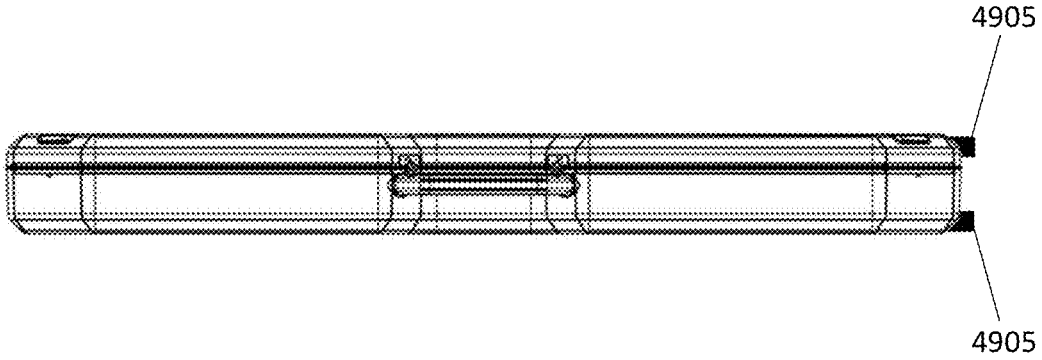
FIG. 49D illustrates a side view of a protective case with wheels according to one embodiment of the present invention.

In another embodiment, the case includes wheels that are integrated on a top component and/or a bottom component of the lid. For example, in one embodiment, the top component and the bottom component each include at least one wheel on an end of each of the components, wherein the wheel is constructed substantially parallel to the exterior surfaces of the components, and wherein the case is thereby operable to roll on its end. In another embodiment, the wheels are attached perpendicular to the top and bottom surfaces, wherein the case is operable to roll on its long side. The wheels are preferably attached to the case via a two-component mechanism, including a rotary fastener, wherein a socket on the case is bonded and/or otherwise attached to the case, and wherein a wheel component includes at least one plate with at least one handle. The wheels are operable to be secured within the socket via a rotary mechanism, e.g., a quarter turn or a full turn. The wheels are advantageously operable to be easily removed for storage or customizability. In one embodiment, the case includes a skid pad attached to a portion of the external surface of the case surrounding the wheels. If during rolling the case, the angle is case is shifted such that both wheels are not on the ground, the skid pad helps prevent damage or scuffing of the case caused by frictional contact with the ground. FIGS. 49C and 49D illustrate one embodiment of wheels 4905 attached to an end of a case, wherein the wheels are attached to the case via a rotary fastener.

Figure 50A:
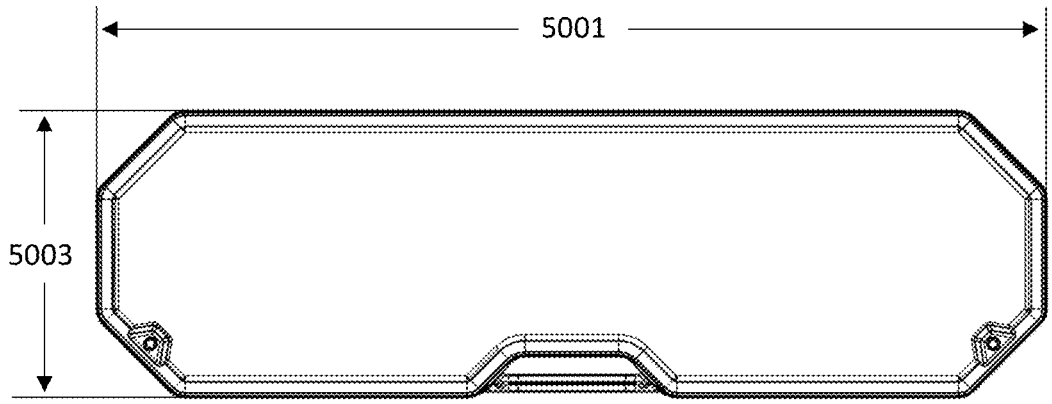
FIG. 50A illustrates a top view of a closed case with marked length and width dimensions according to one embodiment of the present invention.
Figure 50B:
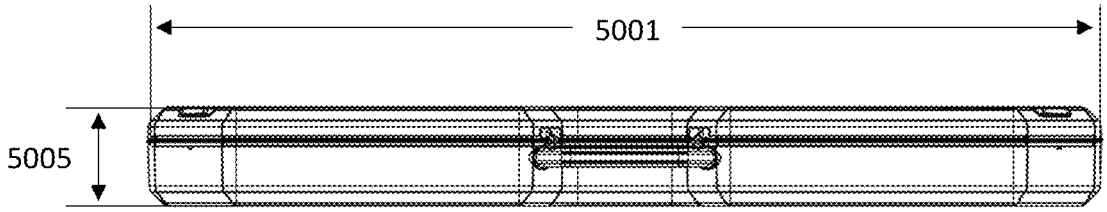
FIG. 50B illustrates a side view of a closed case with marked length and height dimensions according to one embodiment of the present invention.

FIGS. 50A, 50B illustrate a top view and a side view, respectively of one embodiment of a case. The case preferably includes at least three different size embodiments. In a first size embodiment, a length 5001 of the case is between 1300 and 1400 millimeters (51.18 and 55.12 inches), a width 5003 is between 300 and 400 millimeters (11.81 and 15.75 inches), and a height 5005 is between 100 and 200 millimeters (3.94 and 7.87 inches). In a preferred embodiment, the length 5011 is approximately 1350 millimeters (53.15 inches), the width 5003 is approximately 360 millimeters (14.17 inches), and the height 5005 is approximately 150 millimeters (5.91 inches). In a second size embodiment, a length 5001 of the case is between 750 and 850 millimeters (29.53 and 33.46 inches), a width 5003 is between 250 and 350 millimeters (9.84 and 13.78 inches), and a height 5005 is between 50 and 100 millimeters (1.97 and 3.94 inches). In a preferred embodiment, the length 5011 is approximately 800 millimeters (31.50 inches), the width 5003 is approximately 275 millimeters (10.83 inches), and the height 5005 is approximately 75 millimeters (2.95 inches). In a third size embodiment, a length 5001 of the case is between 750 and 850 millimeters (29.53 and 33.46 inches), a width 5003 is between 500 and 600 millimeters (19.69 and 23.62 inches), and a height 5005 is between 50 and 100 millimeters (1.97 and 3.94 inches). In a preferred embodiment, the length 5011 is approximately 800 millimeters (31.50 inches), the width 5003 is approximately 550 millimeters (21.65 inches), and the height 5005 is approximately 75 millimeters (2.95 inches). In a fourth size embodiment, a length 5001 of the case is between 1300 and 1550 millimeters (51.18 and 61.02 inches), a width 5003 is between 300 and 550 millimeters (11.81 and 21.65 inches), and a height 5005 is between 100 and 200 millimeters (3.94 and 7.87 inches). In a preferred embodiment, the length 5011 is approximately 1450 millimeters (57.09 inches), the width 5003 is approximately 450 millimeters (17.72 inches), and the height 5005 is approximately 150 millimeters (5.91 inches). In one embodiment, each of the disclosed measurements are modified approximately +/−200 millimeters (7.87 inches).

In one embodiment, the case provides weight benefits, wherein a nominal, total weight of the case is between 8 pounds and 30 pounds (3.63 kilograms and 13.61 kilograms). In the first embodiment described above, the case is between approximately 15 pounds and 30 pounds (6.80 kilograms and 13.61 kilograms). Preferably, the first embodiment described above is approximately 18.8 pounds (8.53 kilograms). In the second embodiment described above, the case is between approximately 8 pounds and 15 pounds. Preferably, the second embodiment described above is approximately 14 pounds. The retaining element of the case provides some weight benefits, wherein the retaining element weighs between 1 and 8 ounces, and wherein the retaining element preferably weighs approximately 2 ounces.

Figure 51A:
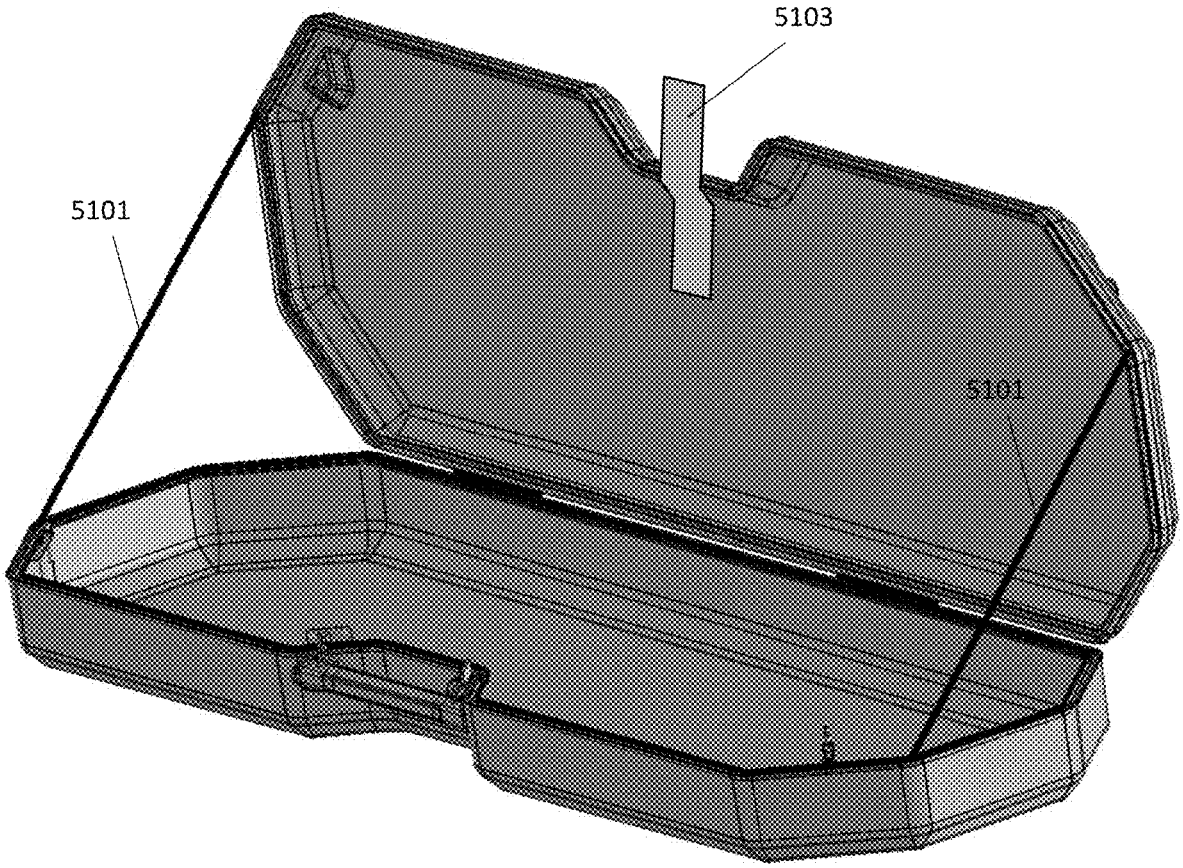
FIG. 51A illustrates a perspective view of a case open to 90 degrees with guide cords and a pull tab according to one embodiment of the present invention.
Figure 51B:
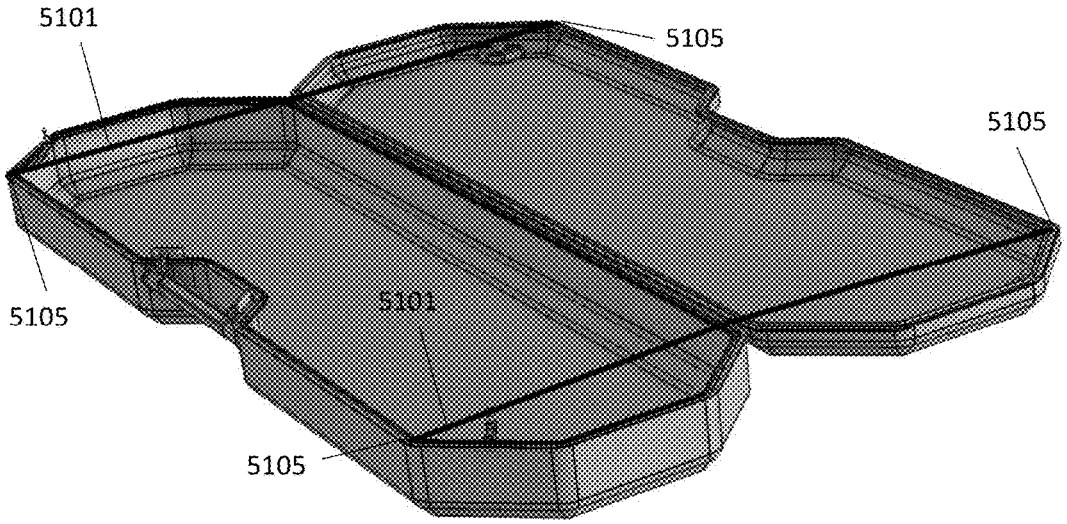
FIG. 51B illustrates a perspective view of a case open flat with guide cords according to one embodiment of the present invention.

FIG. 51A illustrates one embodiment of a case with a pull tab 5103 and guide cords 5101. In the illustrated embodiment, the case includes a pull tab 5103, which aids in opening and lifting the lid of the case. The pull tab 5103 is preferably attached to an inside of the case through any physical, mechanical, and/or chemical means, and is preferably adhered to an inside of the top component. The pull tab 5103 is constructed from any material that is operable to maintain a secure seal when the case is closed. For example, in one embodiment, the pull tab 5103 is constructed from silk. In another embodiment, the pull tab 5103 is constructed from cotton, polyester, wool, nylon, or any natural or synthetic textile material. In a further embodiment, the pull tab 5103 is constructed from a hard material, such as a thermoplastic, metal, or carbon fiber-reinforced materials, and the pull tab 5103 is directly formed from or attached to the top or bottom component of the case.

The guide cords 5101 allow for a component of the case to remain open without completely lying flat. This enables easy open and closing during usage. In one embodiment, the guide cords 5101 are constructed with a length that allows a 90-degree opening between the top component and the bottom component of the case. In another embodiment, the guide cords 5101 are constructed with a length that allows an opening between 90-degrees and 135-degrees. The guide cords 5101 are operable, in one embodiment, to match a weight of the top component with a tension of the guide cords 5101. The tension, in one embodiment, retains the case at 90-degrees, but the guide cords 5101 are operable to stretch to allow a full opening of the case. Once the case is flat, the angle of tension preferably keeps the case from closing. In another embodiment, the guide cords 5101 must be unhooked in order to allow the case to lay flat. While in the illustrated embodiment, the case includes two guide cords 5101, further embodiments include a single guide cord or more than two guide cords.

Figure 51C:
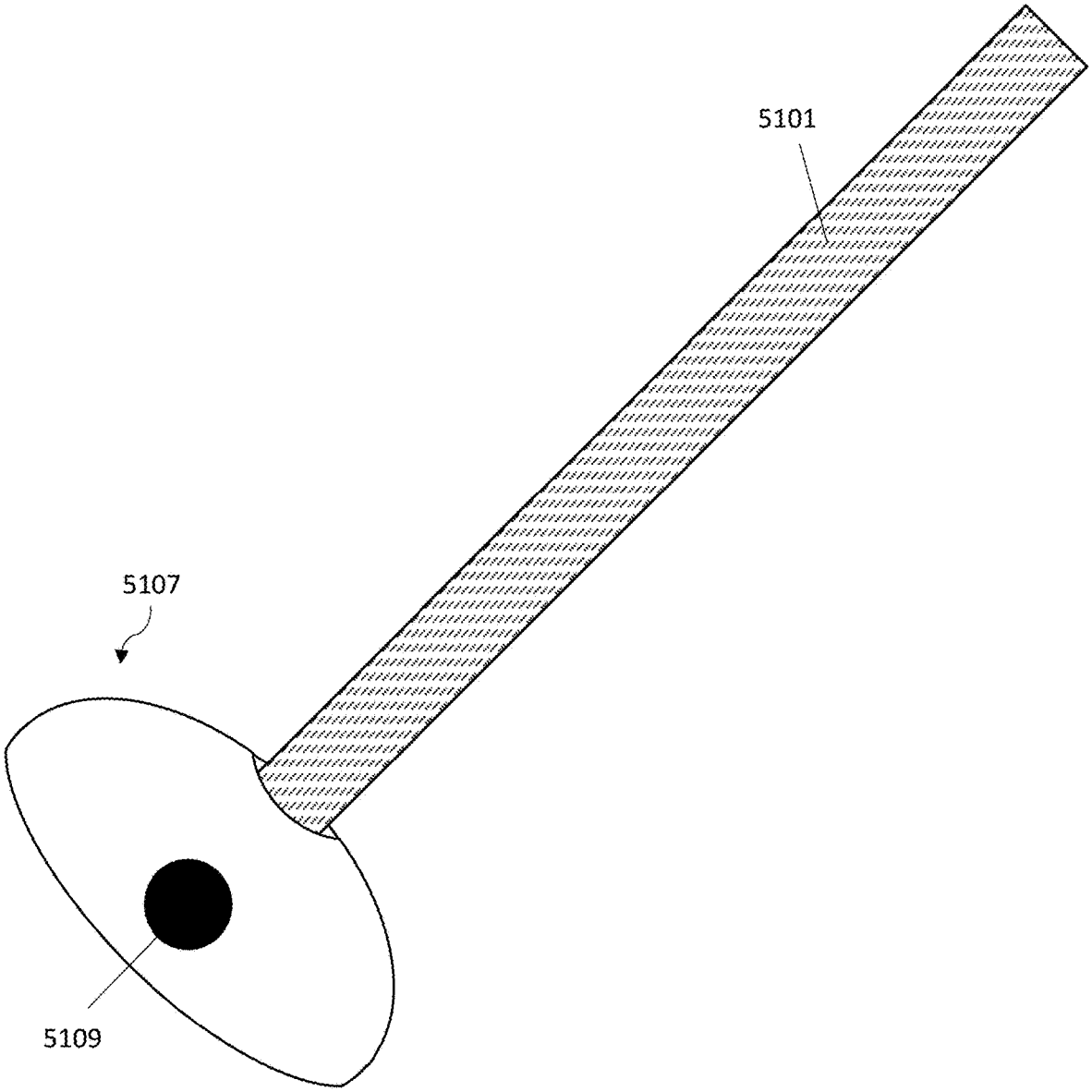
FIG. 51C illustrates a guide cord buckle according to one embodiment of the present invention.

Additionally, positioning and attachment of the guide cords 5101 is at any location that allows the case to remain open at a desired angle. In the illustrated embodiment, the guide cords 5101 are attached to corners 5105 between semi-hexagonal regions of the case and flat sides of the case. In another embodiment, the guide cords 5101 are connected to a center of each of the components of the case, to front sides of the components of the case, or to right and left sides of the components of the case. Preferably, the guide cords 5101 are operable to detach from at least one component to allow for the case to open fully. FIG. 51C illustrates one embodiment of a guide cord buckle 5107, wherein the guide cord buckle 5107 receives a guide cord 5101 and is operable to release the cable based on the press of a button 5109. Notably, the guide cord buckle 5107 is any physical or mechanical method of securing the guide cord 5101, including a snap, buckle, latch, or fastener.

Figure 52A:
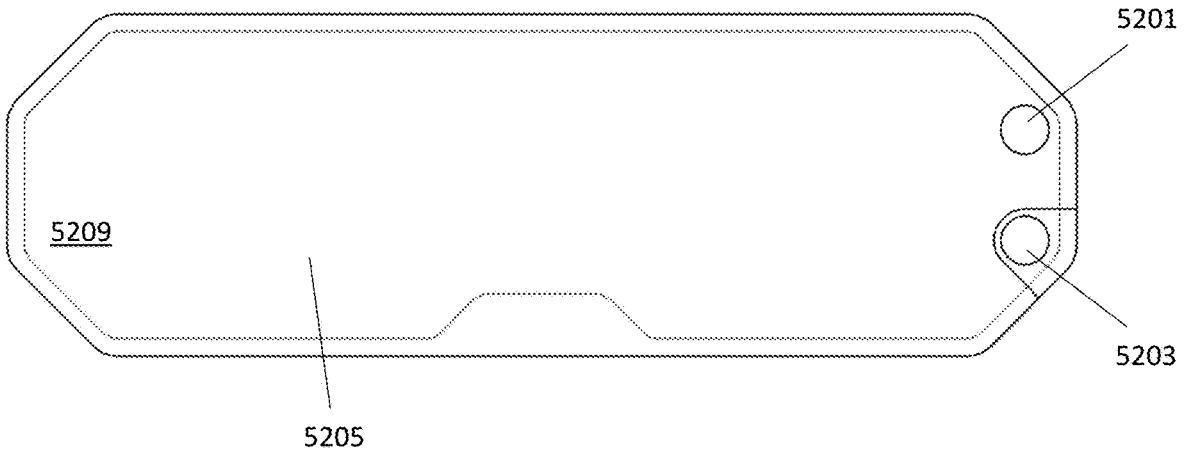
FIG. 52A illustrates a top view of a dual-compartment retaining element according to one embodiment of the present invention.
Figure 52B:
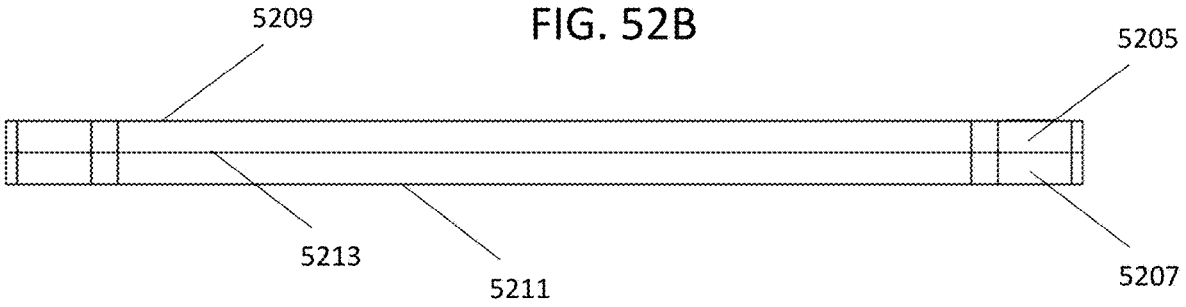
FIG. 52B illustrates a side view of a dual-compartment retaining element according to one embodiment of the present invention.

FIGS. 52A-52B illustrate one embodiment of a retaining element with dual compartments for increased security and support within the case. FIG. 52A illustrates a top view of a retaining element with a top valve 5201 and a bottom valve 5203. The top valve 5201 controls a level of pressure within a top compartment 5205 of the retaining element, wherein the top compartment 5205 is filled with microbeads and is preferably constructed to be deflated (evacuated). The bottom valve 5203 controls an amount of air in the bottom compartment (5207, FIGS. 52B-52C). FIG. 52B illustrates a side view of a retaining element, wherein the top compartment 5205 includes microbeads and a bottom compartment 5207 is preferably constructed to receive air for extra support and cushioning for any retained elements. During usage, the top valve 5201 is preferably used to evacuate air from the top compartment 5205 of the retaining element, and the bottom valve 5203 is used to add air to the bottom compartment 5207 of the retaining element. The bottom compartment 5207 thus provides a bladder for further cushioning and support, wherein the extra volume of fluid ensures that internal components of the case are compressed (e.g., a retaining element, a firearm, and a top layer of foam) and decreases movement normal to the retaining element. Notably, each of the compartments are operable to be individually inflated or deflated according to a desired level of security and support. The retaining element in the illustrated embodiment is constructed with three different layers, including a top layer 5209, a middle layer 5213, and a bottom layer 5211. In one embodiment, the compartments are constructed together into a single retaining element. This advantageously decreases the number of components that must be attached together and provides ease of use for a user. In another embodiment, the compartments are separate. The middle layer 5213, in one embodiment, is a foam layer. In another embodiment, the middle layer 5213 is constructed from the same material as the top or bottom layers (i.e., those described in reference to FIG. 41). Alternatively, the top compartment 5205 and the bottom compartment 5207 are separate, wherein the bottom valve 5203 is attached to the bottom compartment 5207, and wherein an intermediate layer, such as a layer of foam, is positioned between the top compartment 5205 and the bottom compartment 5207. Preferably, the adjustable retaining element fluid is air. In another embodiment, the retaining element is filled with any gas or liquid, including water.

Figure 52C:
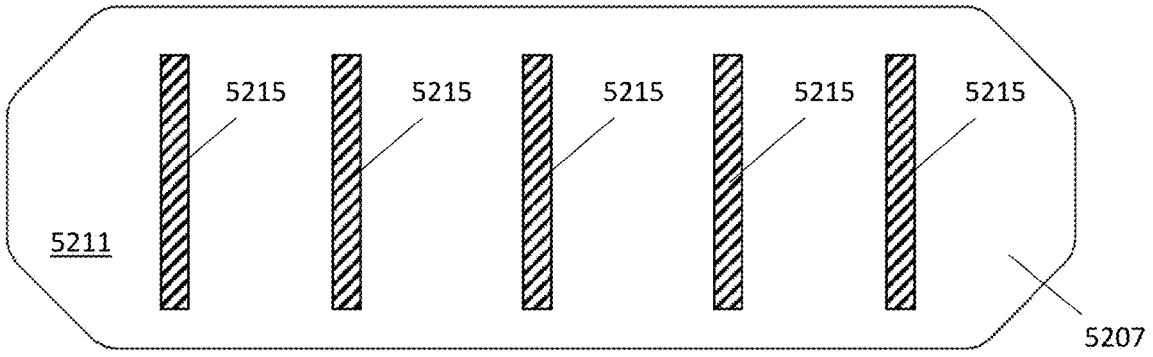
FIG. 52C illustrates a bottom view of a dual-compartment retaining element according to one embodiment of the present invention.

FIG. 52C illustrates a bottom view of the retaining element, including a second compartment 5207 and a bottom layer 5211, wherein the bottom layer 5211 includes hook-and-loop attachments 5215. The hook-and-loop attachments 5215 are illustrated as strips. However, in another embodiment, the hook-and-loop attachments 5215 are constructed in any shape, size, or pattern, such as sheets of hook-and-loop, circles, rectangles, or checkered patterns. In one embodiment, hook-and-loop attachments 5215 and/or corresponding mating components are positioned perpendicular to a length of the retaining element and/or parallel to a length of the retaining element. A corresponding mating component is attached to an internal surface of a bottom component of the case and/or to one or more layers (e.g., a foam layer) positioned underneath the retaining element. Preferably, the hook-and-loop fasteners are welded to a bottom component of the case. In another embodiment, the hook-and-loop attachments 5215 are instead any other physical, mechanical, or chemical means of attachment.

Figure 53:
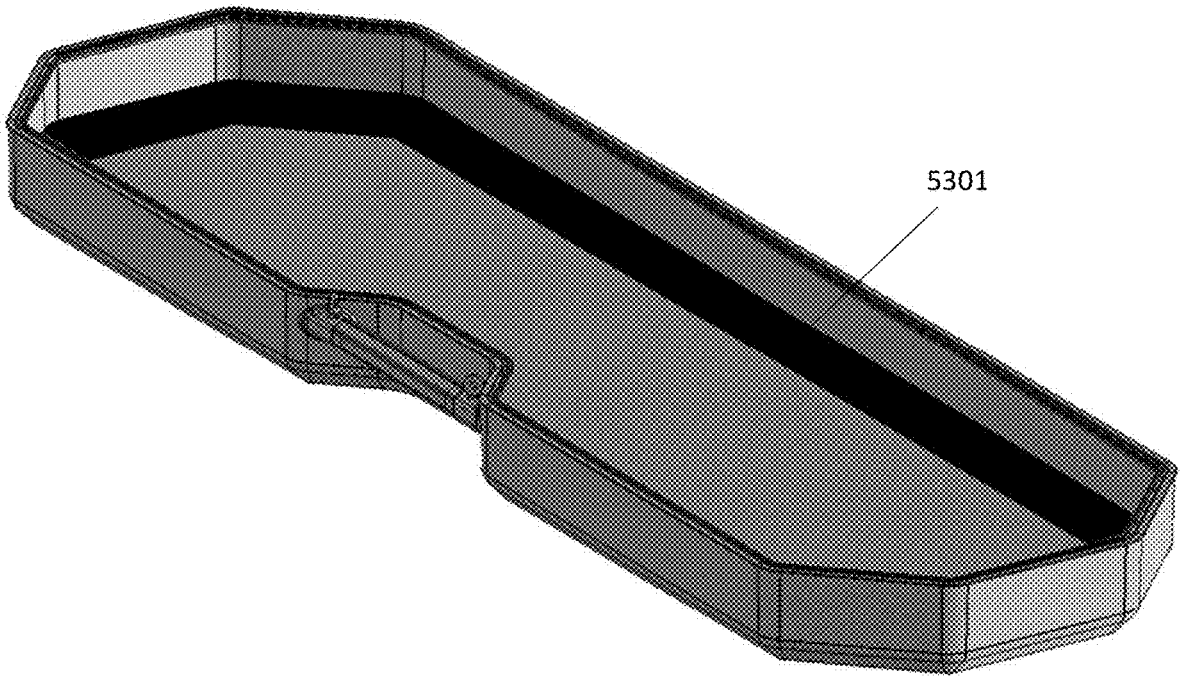
FIG. 53 illustrates a perspective view of a bottom component of a case with internal foam lining according to one embodiment of the present invention.

In one embodiment, a bottom component of the case includes a foam layer, wherein the internal foam layer is constructed to cover the interior of the bottom component and provide a layer of cushioning and protection between the bottom component and the retaining element. In one embodiment, a mating component of the hook-and-loop attachments are preferably attached to the foam layer. Alternatively, the foam layer is any other padding and protection material, including silicone, rubber, carbon fiber, plastic, or a textile material. In a further embodiment, the foam layer does not cover a full internal surface of a bottom component or a top component but instead is positioned along internal edges of a top or bottom component of the case. FIG. 53 illustrates one embodiment of a bottom component of a case, wherein the bottom component of the case includes a foam liner 5301 around an internal edge of the case.

Figure 54:
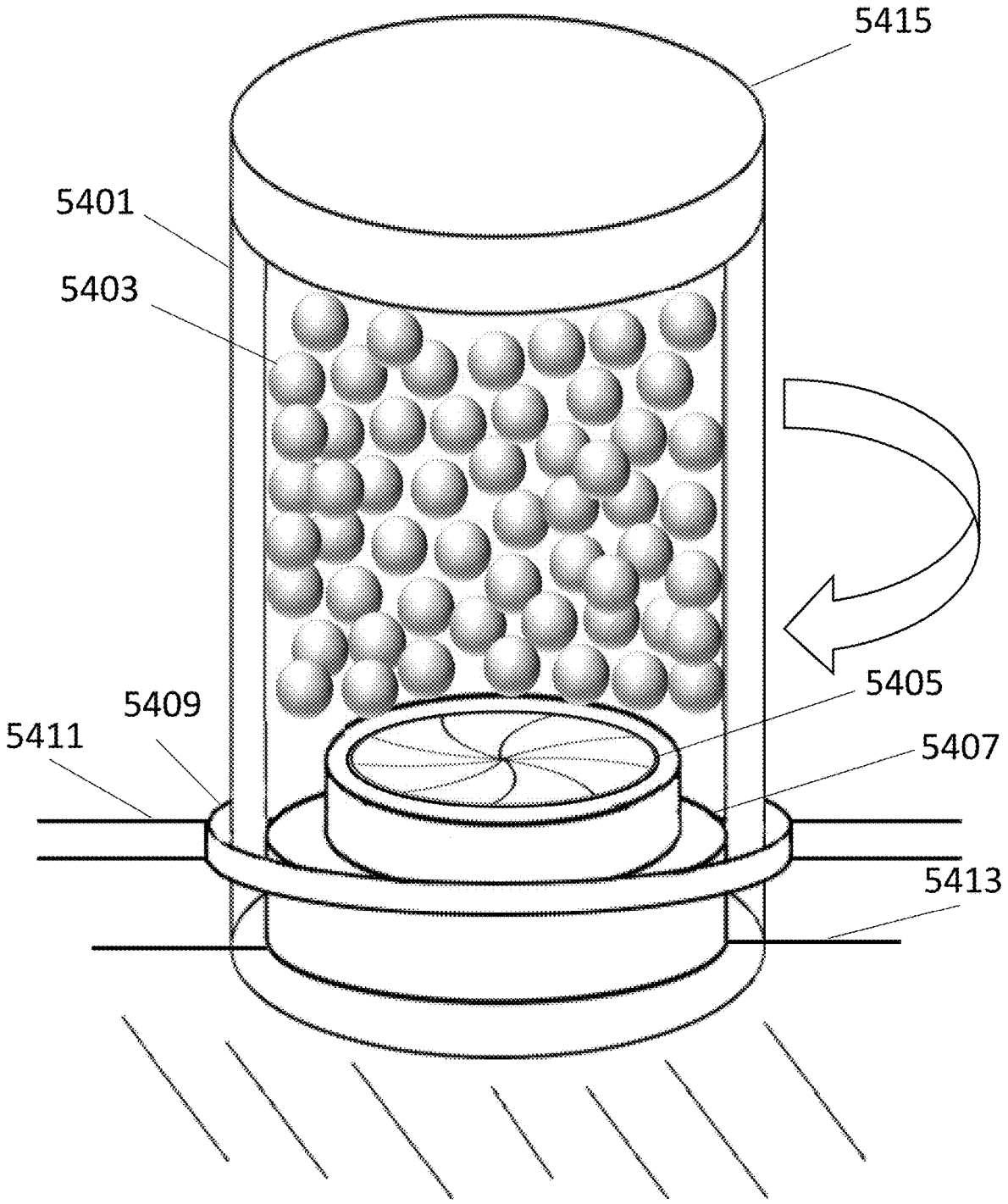
FIG. 54 illustrates a side perspective view of pod-based bead refill mechanism for a retaining element according to one embodiment of the present invention.

FIG. 54 illustrates a side perspective view of pod-based bead refill mechanism for a retaining element according to one embodiment of the present invention. In one embodiment, a retaining element 5413 includes an opening 5405 for receiving additional beads into the retaining element 5413 or for removing beads from the retaining element 5413. The opening 5405 includes a short cylinder extending upwardly from the surface of the retaining element 5413. In one embodiment, in a closed state, the opening 5405 is sealed by an iris mechanism as shown in FIG. 54. In an open state, the iris opens, allowing beads to flow into or out of the retaining element 5413. In one embodiment, the short cylinder of the opening 5405 extends through an opening 5409 of an outer case 5411, such that the retaining element 5413 is still able to be filled or emptied while the case is closed, providing additional convenience. In another embodiment, the short cylinder of the opening 5405 does not extend through an outer case 5411 and the outer case 5411 must instead be open in order to fill or empty the retaining element 5413.

Figure 55:
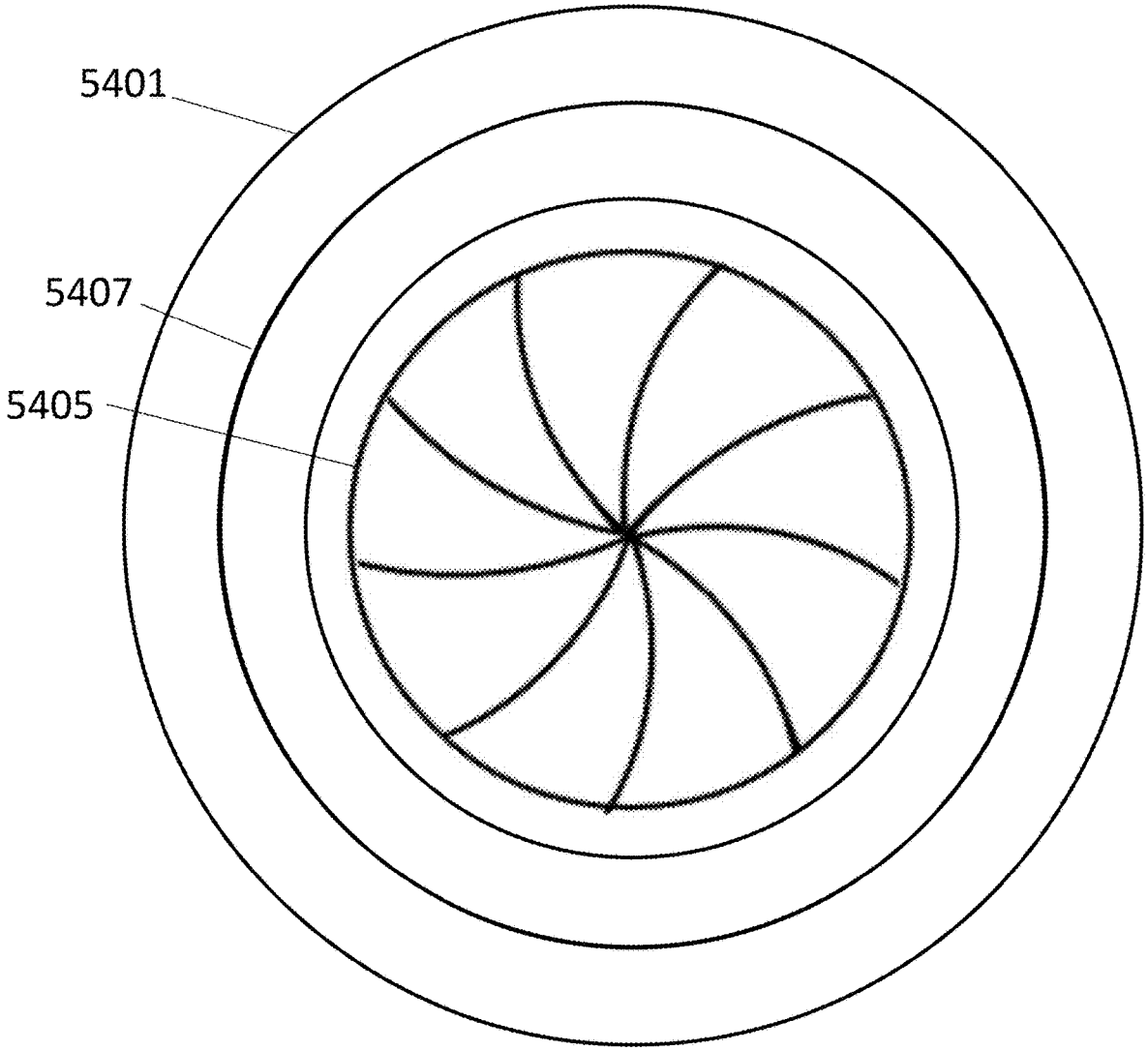
FIG. 55 illustrates a top orthogonal view of a bead refill mechanism for a retaining element according to one embodiment of the present invention.

In one embodiment, a twist mechanism 5407 circumferentially surrounds the short cylinder of the opening 5405, as shown in FIG. 55. The twist mechanism 5407 is rotatably coupled to the short cylinder, such that the twist mechanism is able to freely rotate at least some amount around the short cylinder upon the application of torque. When the twist mechanism 5407 is rotated, the iris mechanism of the opening 5405 opens or closes. In one embodiment, whether the iris mechanism of the opening 5405 opens or closes depends upon the directionality (e.g., clockwise or counterclockwise) of the applied torque. In another embodiment, whether the iris mechanism of the opening 5405 opens or closes depends on the amount that the twist mechanism 5407 is rotated.

In one embodiment, a bead management tube 5401 is a hollow tube, open on one end, wherein the open end of the bead management tube 5401 is configured to tightly fit around the twist mechanism 5407. In one embodiment, the bead management tube 5401 is configured to frictionally, sealingly engage with the twist mechanism 5407. Therefore, rotation of the bead management tube 5401 causes the twist mechanism 5407 to also rotate, allowing the iris mechanism of the opening 5405 to open or close. This conveniently allows the opening 5405 to be opened or closed without risk of spilling beads. In one embodiment, the bead management tube 5401 is configured to fit through the hole 5409 in the outer case 5411 in order to access and fit around the twist mechanism 5407. In another embodiment, there is no hole in the case and the bead management tube 5401 must instead engage with the twist mechanism 5407 when the case is opened. The bead management tube 5401 is able to be used to either fill or empty the retaining element. In one embodiment, prior to being connected to the twist mechanism 5407, the bead management tube 5401 is filled with beads 5403 or other filling material. When the twist mechanism is then actuated, the beads 5403 are able to flow into the retaining element 5413 in order to refill it. Alternatively, in one embodiment, the bead management tube 5401 is not filled with beads prior to connection to the twist mechanism 5407. After the bead management tube 5401 is attached and the twist mechanism 5407 is actuated, the beads within the retaining element 5413 are gravity fed into the bead management tube 5401. In one embodiment, at least one vacuum pump is operable to connect to the bead management tube 5401. When the bead management tube 5401 is attached and the twist mechanism 5407 is actuated, the beads within the retaining element 5413 are sucked into the bead management tube 5401 via the at least one vacuum pump.

In one embodiment, a cap 5415 of the bead management tube 5401 opposite the open end of the bead management tube 5401 is removable. Therefore, once the bead management tube 5401 is connected to the twist mechanism 5407, the cap 5414 is able to be removed such that beads are able to be added into the bead management tube 5401 and ultimately into the retaining element 5413. The use of a removable cap 5415 also allows for more beads to be a removed in an organized and deliberate manner. Because the bead management tube 5401 is a known volume, the bead management tube 5401 is able to be, for example, filled, the iris mechanism of the opening 5405 closed, the cap 5415 removed, the beads 5403 removed, and then the process repeated, all without removing the bead management tube 5401. In another embodiment, the cap 5415 of the bead management tube 5401 is not removable or is integrally formed with the bead management tube 5401.

One of ordinary skill in the art will understand that the present invention is not limited as to the number of openings 5405 of the retaining element 5413, and the present invention therefore allows for the existence of one or a multiplicity of openings 5405.

Figure 56:
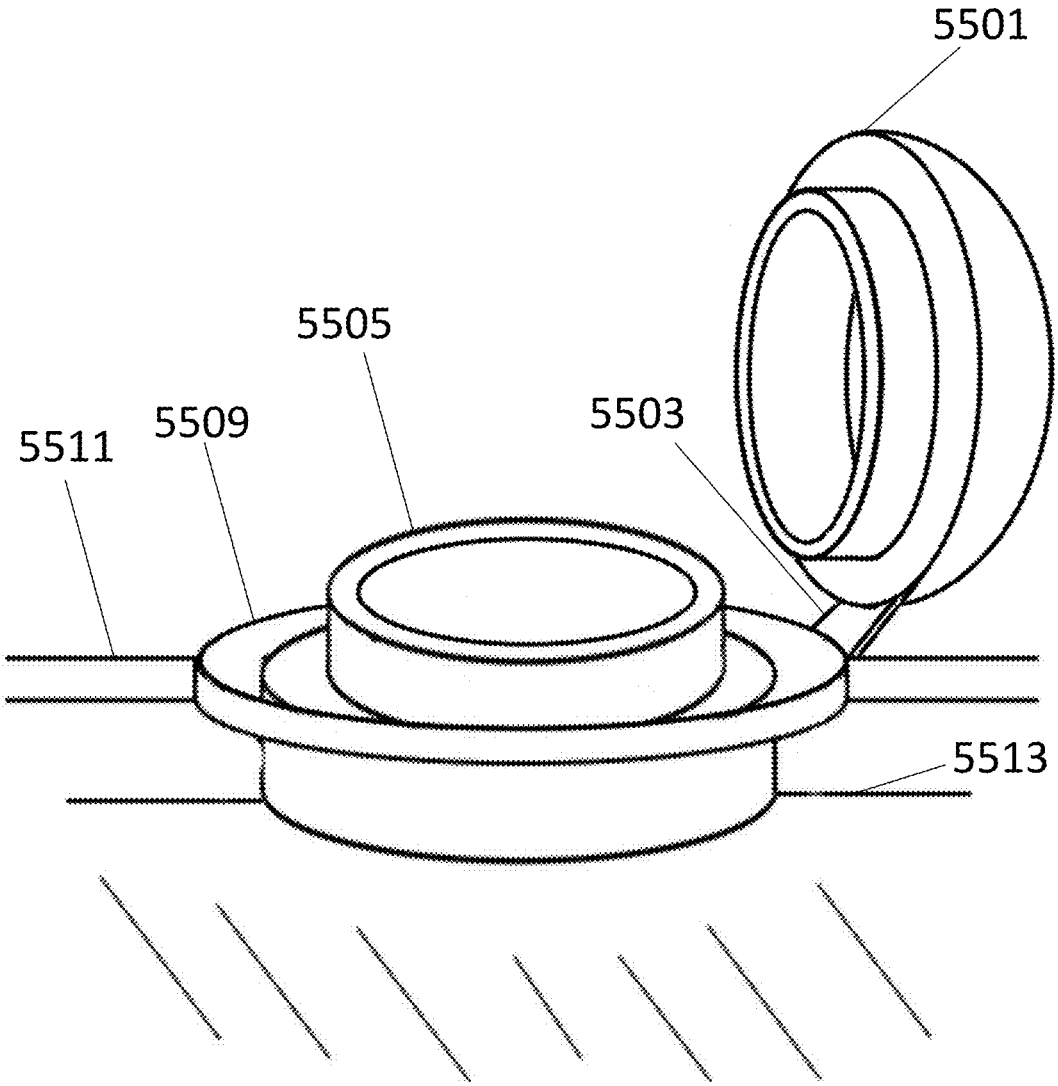
FIG. 56 illustrates a side perspective view of a bead refill mechanism with a cap connected by a living hinge according to one embodiment of the present invention.

FIG. 56 illustrates a side perspective view of a bead refill mechanism with a cap connected by a living hinge according to one embodiment of the present invention. In one embodiment, the retaining element 5513 includes an opening 5505. In one embodiment, a short cylinder of the opening 5505 extends through an opening 5509 in an outer case 5511, such that the retaining element is able to be filled or emptied while the case 5511 is closed. In another embodiment, the short cylinder of the opening 5505 does not extend through the outer case 5511 and the case must instead be opened in order to fill or empty the retaining element 5513. In one embodiment, the retaining element 5513 does not include an iris mechanism. Instead, the opening 5505 is able to be closed by covering the opening 5505 with a mating cap 5501. In one embodiment, the mating cap 5501 is attached to the short cylinder of the opening 5505 by at least one living hinge. In another embodiment, the mating cap 5501 attaches to an exterior of the outer case 5511 by at least one living hinge 5503.

Figure 57:
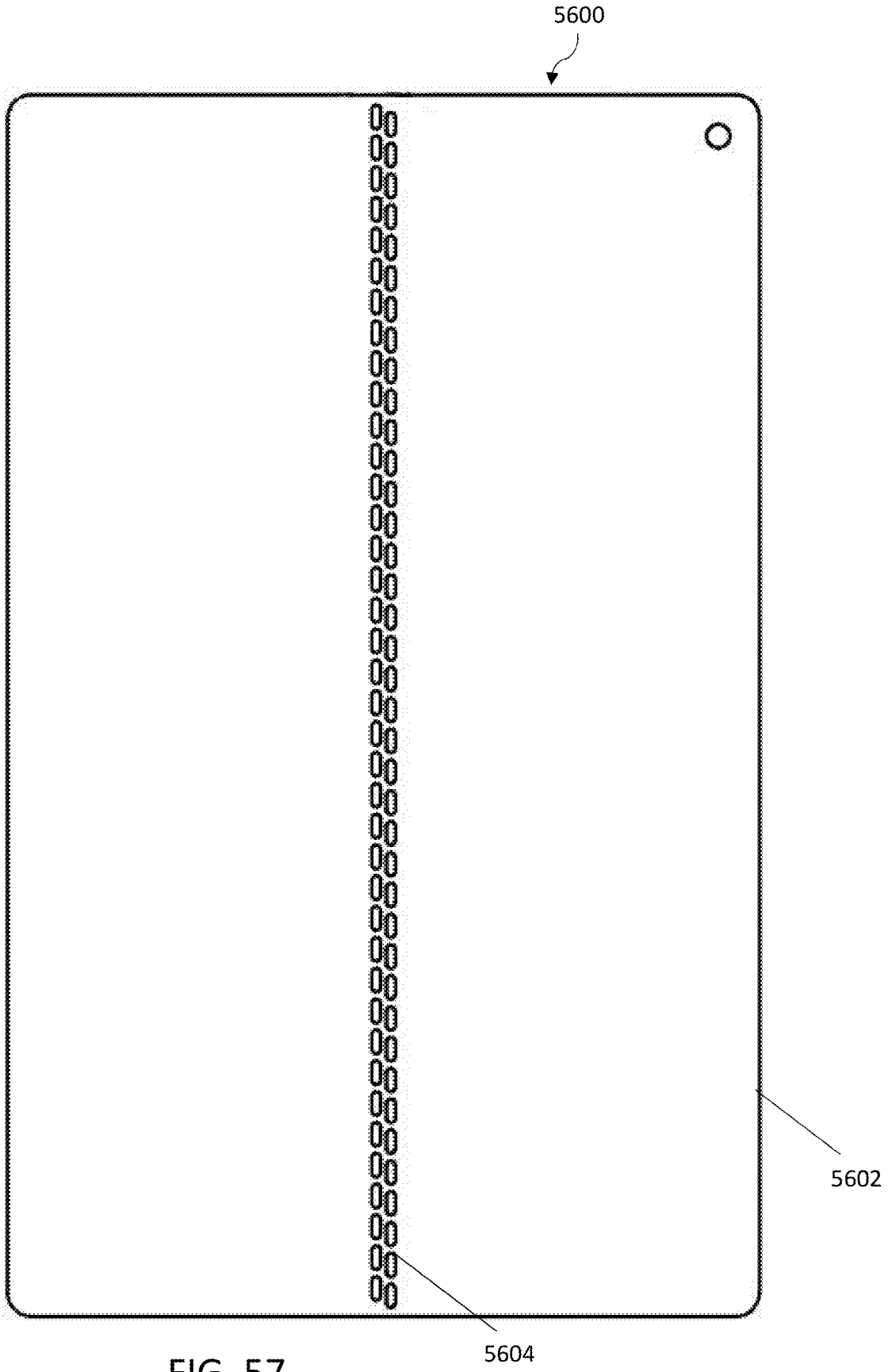
FIG. 57 illustrates a top view of a folding, dual-compartment retaining element according to one embodiment of the present invention.

FIG. 57 illustrates a top view of a folding, dual-compartment retaining element according to one embodiment of the present invention. The retaining element 5600 includes at least two chambers 5602, each filled with packaging material (e.g., microbeads) and each separated by at least one seam 5604. In one embodiment, the at least one seam 5604 is formed from at least one nonwoven strip of material welded to the seam 5604 and separating the at least two chambers 5602. In one embodiment, the at least one non-woven strip of material is ultrasonically welded.

In one embodiment, at least one compartment 5602 of the retaining element 5600 rests on the bottom of a case, with medical equipment and/or other objects (e.g., aerospace components, firearms, scientific instruments, etc.) placed on top of the at least one compartment 5602. The retaining element 5600 is then folded that at least one second compartment 5602 rests on top of the medical equipment and/or other objects. Air is then able to be released from each compartment 5602 such that the packaging material in each compartment 5602 condenses around the medical equipment and/or other objects, holding the objects in place. In one embodiment, each of the at least two compartments 5602 is connected to able to be independently connected to an air pump for selectively removing air from each compartment 5602. In another embodiment, two or more of the at least two compartments 5602 are connected to the same air pump, which is operable to remove air from the two or more compartments 5602 at the same time.

One of ordinary skill in the art will understand that while FIG. 54 shows the ultrasonic weld 5604 running along the longer side of the retaining element 5600, the ultrasonic weld 5604 is also able to run along a shorter side of the retaining element 5600 (if the length and width of the retaining element 5600 are not equal). Furthermore, one of ordinary skill in the art will understand that the retaining element 5600 is able to have a plurality of ultrasonic welds, running in the same or different directions, and therefore the retaining element 5600 is able to have greater than two compartments 5602.

In one embodiment, each case is attached with at least one radiofrequency identification (RFID) tag, at least one near-field communication (NFC) tag, at least one barcode, at least one QR code, and/or at least one other unique identification means. By tracking the case with a unique identifier and logging which instruments are in which case, the system is able to more easily track which cases have properly reached the destination and which items are potentially missing. In one embodiment, each time the RFID tag, NFC tag, barcode, QR code, or other unique identification means is scanned or initialized, information such as geolocation, the identification number of the scanning device, the time, the date, and/or other information is automatically recorded on a blockchain or another distributed ledger. By using blockchain identification for each medical device, the system is better able to keep a history of the movement and transportation of each device. Alternatively, cases are tracked using a cloud-based or edge-based inventory management system. In one embodiment, the RFID tag, NFC tag, at least one barcode, at least one QR code, and/or at least one other unique identification means is removably attached to the case, such that new unique identifiers are added whenever a new item is placed in the case, such that items within the case, rather than or in addition to the case itself, are tracked. In one embodiment, the RFID tag is a RFID tag produced by RAIN, such as the EM-1, EM-2, EM-3, EM-4, impinj-1, impinj-2, impinj-3, impinj-4, NXP-1, NXP-2, NXP-3, NXP-4, NXP-5, and/or NXP-6, details of which published in the white paper RAIN RFID Test Procedure for RAIN Reader Tag Reporting Round Robin in March 2022, which is incorporated herein by reference in its entirety.

Data Stored on a Distributed Ledger

In a preferred embodiment, the platform is operable to store data on a distributed ledger, e.g., a blockchain. Distributed ledger technology refers to an infrastructure of replicated, shared, and synchronized digital data that is decentralized and distributed across a plurality of machines, or nodes. The nodes include but are not limited to a mobile device, a computer, a server, and/or any combination thereof. Data is replicated and synchronized across a network of nodes such that each node has a complete copy of the distributed ledger. The replication and synchronization of data across a distributed set of devices provides increased transparency over traditional data storage systems, as multiple devices have access to the same set of records and/or database. Additionally, the use of distributed ledgers eliminates the need for third party and/or administrative authorities because each of the nodes in the network is operable to receive, validate, and store additional data, thus creating a truly decentralized system. Eliminating the third party and/or administrative authorities saves time and cost. A decentralized database is also more secure than traditional databases, which are stored on a single device and/or server because the decentralized data is replicated and spread out over both physical and digital space to segregated and independent nodes, making it more difficult to attack and/or irreparably tamper with the data. Tampering with the data at one location does not automatically affect the identical data stored at other nodes, thus providing greater data security.

In addition to the decentralized storage of the distributed ledger, which requires a plurality of nodes, the distributed ledger has further advantages in the way that data is received, validated, communicated, and added to the ledger. When new data is added to the distributed ledger, it must be validated by a portion of the nodes (e.g., 51%) involved in maintaining the ledger in a process called consensus. Proof of work, proof of stake, delegated proof of stake, proof of space, proof of capacity, proof of activity, proof of elapsed time, and/or proof of authority consensus are all compatible with the present invention, as are other forms of consensus known in the art. In one embodiment, the present invention uses fault-tolerant consensus systems. Each node in the system is operable to participate in consensus, e.g., by performing at least one calculation, performing at least one function, allocating compute resources, allocating at least one token, and/or storing data. It is necessary for a portion of the nodes in the system (e.g., 51% of the nodes) to participate in consensus in order for new data to be added to the distributed ledger. Advantageously, requiring that the portion of the nodes participate in consensus while all nodes are operable to participate in consensus means that authority to modify the ledger is not allocated to one node or even a group of nodes but rather is equally distributed across all of the nodes in the system. In one embodiment, a node that participates in consensus is rewarded, e.g., with a digital token, in a process called mining.

The blockchain is a commonly used implementation of a distributed ledger and was described in Satoshi Nakamoto's whitepaper *Bitcoin: A Peer-to-Peer Electronic Cash System*, which was published in October 2008 and which is incorporated herein by reference in its entirety. In the blockchain, additional data is added to the ledger in the form of a block. Each block is linked to its preceding block with a cryptographic hash, which is a one-way mapping function of the data in the preceding block that cannot practically be computed in reverse. In one embodiment, a timestamp is also included in the hash. The computation of the cryptographic hash based on data in a preceding block is a computationally intensive task that could not practically be conducted as a mental process. The use of cryptographic hashes means that each block is sequentially related to the block before it and the block after it, making the chain as a whole immutable. Data in a block in a preferred embodiment cannot be retroactively altered after it is added to the chain because doing so changes the associated hash, which affects all subsequent blocks in the chain and which breaks the mapping of the preceding block. The blockchain is an improvement on existing methods of data storage because it connects blocks of data in an immutable fashion. Additionally, the blockchain is then replicated and synchronized across all nodes in the system, ensuring a distributed ledger. Any attempted changes to the blockchain are propagated across a decentralized network, which increases the responsiveness of the system to detect and eliminate fraudulent behavior compared to non-distributed data storage systems. The blockchain and the distributed ledger solve problems inherent to computer networking technology by providing a secure and decentralized way of storing data that is immutable and has high fault tolerance. The distributed ledger stores digital data and is thus inextricably tied to computer technology. Additional information about the blockchain is included in *The Business of Blockchain* by William Mougavar published in April 2016, which is incorporated herein by reference in its entirety.

In one embodiment, the data added to the distributed ledger of the present invention include digital signatures. A digital signature links a piece of data (e.g., a block) to a digital identity (e.g., a user account). In one embodiment, the digital signature is created using a cryptographic hash and at least one private key for a user. The content of the piece of data is used to produce a cryptographic hash. The cryptographic hash and the at least one private key are used to create the digital signature using a signature algorithm. The digital signature is only operable to be created using a private key. However, the digital signature is operable to be decoded and/or verified using a public key also corresponding to the user. The separation of public keys and private keys means that external parties can verify a digital signature of a user using a public key but cannot replicate the digital signature since they do not have a private key. Digital signatures are not merely electronic analogs of traditional physical signatures. Physical signatures are easily accessible and easily replicable by hand. In addition, there is no standard algorithm to verify a physical signature except comparing a first signature with a second signature from the same person via visual inspection, which is not always possible. In one embodiment, the digital signatures are created using the data that is being linked to the digital identity whereas physical signatures are only related to the identity of the signer and are agnostic of what is being signed. Furthermore, digital signatures are transformed into a cryptographic hash using a private key, which is a proof of identity of which there is no physical or pre-electronic analog. Digital signatures, and cryptographic hashes in general, are of sufficient data size and complexity to not be understood by human mental work, let alone verified through the use of keys and corresponding algorithms by human mental work. Therefore, creating, decoding, and/or verifying digital signatures with the human mind is highly impractical.

Public, private, consortium, and hybrid blockchains are compatible with the present invention. In one embodiment, the blockchain system used by the present invention includes sidechains wherein the sidechains run parallel to a primary chain. Implementations of distributed ledger and/or blockchain technology including, but not limited to, BITCOIN, ETHEREUM, HASHGRAPH, BINANCE, FLOW, TRON, TEZOS, COSMOS, and/or RIPPLE are compatible with the present invention. In one embodiment, the platform includes at least one acyclic graph ledger (e.g., at least one tangle and/or at least one hashgraph). In one embodiment, the platform includes at least one quantum computing ledger.

In one embodiment, the present invention further includes the use of at least one smart contract, wherein a smart contract includes a set of automatically executable steps and/or instructions that are dependent on agreed-upon terms. The smart contract includes information including, but not limited to, at least one contracting party, at least one contract address, contract data, and/or at least one contract term. In one embodiment, the at least one smart contract is deployed on a blockchain such that the at least one smart contract is also stored on a distributed node infrastructure. In one embodiment, the terms of the at least one smart contract are dependent on changes to the blockchain. For example, a provision of the at least one smart contract executes when a new block is added to the blockchain that meets the terms of the at least one smart contract. The smart contract is preferably executed automatically when the new block is added to the blockchain. In one embodiment, a first smart contract is operable to invoke a second smart contract when executed. A smart contract is operable to capture and store state information about the current state of the blockchain and/or the distributed ledger at any point in time. Advantageously, a smart contract is more transparent than traditional coded contracts because it is stored on a distributed ledger. Additionally, all executions of the smart contract are immutably stored and accessible on the distributed ledger, which is an improvement over non-distributed, stateless coded contracts. In one embodiment, the state information is also stored on a distributed ledger.

Cryptocurrency Transactions

Distributed ledger technology further enables the use of cryptocurrencies. A cryptocurrency is a digital asset wherein ownership records and transaction records of a unit of cryptocurrency (typically a token) are stored in a digital ledger using cryptography. Use of centralized cryptocurrencies and decentralized cryptocurrencies are both compatible with the present invention. Centralized cryptocurrencies are minted prior to issuance and/or are issued by a single body. Records of a decentralized cryptocurrency are stored on a distributed ledger (e.g., a blockchain), and any node participating in the distributed ledger is operable to mint the decentralized cryptocurrency. The distributed ledger thus serves as a public record of financial transactions. Cryptocurrencies are typically fungible in that each token of a given cryptocurrency is interchangeable. The present invention is operable to facilitate transactions of at least one cryptocurrency, including, but not limited to, BITCOIN, LITECOIN, RIPPLE, NXT, DASH, STELLAR, BINANCE COIN, and/or ETHEREUM. In one embodiment, the present invention is operable to facilitate transactions of stablecoins, NEO Enhancement Protocol (NEP) tokens, and/or BINANCE Chain Evolution Proposal (BEP) tokens. In one embodiment, the present invention is operable to support tokens created using the ETHEREUM Request for Comment (ERC) standards as described by the Ethereum Improvement Proposals (EIP). For example, the present invention is operable to support ERC-20-compatible tokens, which are created using the *EIP-20: ERC-20 Token Standard*, published by Vogelsteller, et al., on Nov. 19, 2015, which is incorporated herein by reference in its entirety.

A cryptocurrency wallet stores keys for cryptocurrency transactions. As cryptocurrency is a virtual currency, the ability to access and transfer cryptocurrency must be protected through physical and/or virtual means such that such actions are only operable to be performed by the rightful owner and/or parties with permission. In one embodiment, a cryptocurrency wallet stores a private key and a public key. In another embodiment, the cryptocurrency wallet is operable to create the private key and/or the public key, encrypt data, and/or sign data (e.g., with a digital signature). In one embodiment, the private key is generated via a first cryptographic algorithm wherein the input to the first cryptographic algorithm is random. Alternatively, the input to the first cryptographic algorithm is non-random. In one embodiment, the public key is generated from the private key using a second cryptographic algorithm. In one embodiment, the first cryptographic algorithm and the second cryptographic algorithm are the same. The private key is only accessible to the owner of the cryptocurrency wallet, while the public key is accessible to the owner of the cryptocurrency wallet as well as a receiving party receiving cryptocurrency from the owner of the cryptocurrency wallet. Deterministic and non-deterministic cryptocurrency wallets are compatible with the present invention.

As a non-limiting example, a cryptocurrency transaction between a first party and a second party involves the first party using a private key to sign a transaction wherein the transaction includes data on a first cryptocurrency wallet belonging to the first party, the amount of the transaction, and a second cryptocurrency wallet belonging to the second party. In one embodiment, the second cryptocurrency wallet is identified by a public key. The transaction is then populated to a distributed network wherein a proportion (e.g., 51%) of the nodes of the distributed network verify the transaction. Verifying the transaction includes verifying that the private key corresponds to the first cryptocurrency wallet and that the amount of the transaction is available in the first cryptocurrency wallet. The nodes then record the transaction on the distributed ledger, e.g., by adding a block to a blockchain. Fulfilling the cryptocurrency transaction is a computationally intensive process due to key cryptography and the consensus necessary for adding data to the distributed ledger that could not practically be performed in the human mind. In one embodiment, a node is operable to verify a block of transactions rather than a single transaction.

Desktop wallets, mobile wallets, hardware wallets, and web wallets are compatible with the present invention. A software wallet (e.g., a desktop wallet, a mobile wallet, a web wallet) stores private and/or public keys in software. A hardware wallet stores and isolates private and/or public keys in a physical unit, e.g., a universal serial bus (USB) flash drive. The hardware wallet is not connected to the internet or any form of wireless communication, thus the data stored on the hardware wallet is not accessible unless the hardware wallet is connected to an external device with network connection, e.g., a computer. In one embodiment, the data on the hardware wallet is not operable to be transferred out of the hardware wallet. In one embodiment, the hardware wallet includes further data security measures, e.g., a password requirement and/or a biometric identifier requirement. In one embodiment, the present invention is operable to integrate a third-party cryptocurrency wallet. Alternatively, the present invention is operable to integrate a payments platform that is compatible with cryptocurrency, including, but not limited to, VENMO, PAYPAL, COINBASE, and/or payments platforms associated with financial institutions.

Tokenization

In one embodiment, the platform is operable to tokenize assets. A token is a piece of data that is stored on the distributed digital ledger and that can be used to represent a physical and/or a digital asset, e.g., in a transaction, in an inventory. The token is not the asset itself; however, possession and transfer of the token are stored on the distributed digital ledger, thus creating an immutable record of ownership. In one embodiment, the token includes cryptographic hashes of asset data, wherein the asset data is related to the asset. In one embodiment, the asset data is a chain of data blocks. For example, the asset is a work of digital art, and the asset data includes data about the work such as information about an artist, a subject matter, a file type, color data, etc. The corresponding token includes a cryptographic hash of the asset data, which describes the work. Alternative mappings of the asset data to the token are also compatible with the present invention. In one embodiment, the token is a non-fungible token (NFT). A first non-fungible token is not directly interchangeable with a second non-fungible token; rather, the value of the first token and the second token are determined in terms of a fungible unit (e.g., a currency). In one embodiment, the platform is operable to support ETHEREUM standards for tokenization, including, but not limited to, *EIP-721: ERC-721 Non-Fungible Token Standard* by Entriken, et al., which was published Jan. 24, 2018 and which is incorporated herein by reference in its entirety. In one embodiment, the platform is operable to create fractional NFTs (f-NFTs), wherein each f-NFT represents a portion of the asset. Ownership of an f-NFT corresponds to partial ownership of the asset.

In one embodiment, the shell of the case, an interior layer (e.g., a foam layer), the retaining element, a divider, and/or any other element is operable to be constructed via three-dimensional (3D) printing (i.e., additive manufacturing). In one embodiment, the elements are produced using Continuous Liquid Interface Production (CLIP) or similar 3D printing mechanisms. In another embodiment, an internal structure of the case, such as a retaining element shape, a foam layer, or a divider, is constructed based on one or more digital scans of an object. For example, in one embodiment, dimensions of a firearm and an attachable scope are determined using a digital scanning system, and a 3D model (e.g., a 3D computer aided design (CAD) model) is generated. Based on the 3D model, stress points of the object are manually and/or automatically determined, and a design is generated for one or more internal components to secure the firearm and attachable scope with both minimal movement and reinforced stress points. A foam layer, a plastic layer, a metal layer, or retaining element shape, cut-out, thickness, size, or other parameter are then generated and manufactured based on the generated design. In one embodiment, the process uses additive manufacturing methods and systems as described in PCT Publication No. WO2015105762, which is incorporated herein by reference in its entirety.

The above-mentioned examples are provided to serve the purpose of clarifying the aspects of the invention, and it will be apparent to one skilled in the art that they do not serve to limit the scope of the invention. By nature, this invention is highly adjustable, customizable and adaptable. The above-mentioned examples are just some of the many configurations that the mentioned components can take on. All modifications and improvements have been deleted herein for the sake of conciseness and readability but are properly within the scope of the present invention.

What it claimed is:

1. An article for packing an object, comprising:

a flexible bag, including an air intake valve;

wherein the flexible bag is operable to be positioned in a case;

wherein the flexible bag includes a sealed interior chamber containing a plurality of packaging materials;

wherein the flexible bag includes at least one bead refill opening, wherein the at least one bead refill opening extends through the case;

wherein the at least one bead refill opening allows beads to pass into and/or out of the flexible bag while the case is closed;

wherein the flexible bag is operable to be connected to a pump, wherein operation of the pump causes air to flow out of the flexible bag and causes the plurality of packaging materials to compact;

wherein the compactification of the plurality of packaging materials via operation of the pump causes the plurality of packaging materials to be displaced and condense around an object placed on top of the flexible bag; and wherein the at least one bead refill opening includes an iris mechanism, and wherein the iris mechanism is able to close or open the at least one bead refill opening.

2. The article of claim 1, wherein the flexible bag is removably attached to an interior surface of a bottom component of the case.

3. The article of claim 1, wherein rotation of the air intake valve allows air to flow into the flexible bag or prevents air from flowing into the flexible bag.

4. The article of claim 1, wherein the flexible bag is operable to conform to the interior surface of a bottom component of the case.

5. The article of claim 1, wherein the plurality of packaging materials includes materials made from polystyrene and/or polylactic acid.

6. The article of claim 1, wherein the flexible bag is operable to be connected to and inflated by the pump.

7. The article of claim 1, wherein the plurality of packaging materials prevents movement of the object when the case is rotated.

8. The article of claim 1, wherein the flexible bag substantially covers the interior surface of the bottom component of the case.

9. The article of claim 1, wherein at least one pipe extends outwardly from an exterior surface of the flexible bag, wherein the at least one opening extends through the at least one pipe, and wherein case includes at least one cut-out through which the at least one pipe extends.

10. A system for packing an object, comprising:

a case having a top component and a bottom component;

a retaining element including a flexible bag, wherein the flexible bag includes an air intake valve;

a pump operable to remove air from the bag; and at least one bead containment pod, wherein the at least one bead containment pod includes a hollow tube with an opening to one side;

wherein at least one pipe extends outwardly from an exterior surface of the flexible bag;

wherein at least one opening is defined through the at least one pipe, such that the opening connects an interior region of the flexible bag to a space outside the flexible bag;

wherein the at least one pipe is connected to at least one twist mechanism, wherein the rotation of the at least one twist mechanism is operable to open and/or close the at least one opening;

wherein the opening of the at least one bead containment pod is configured to rotationally couple with the at least one twist mechanism, such that rotation of the at least one bead containment pod causes rotation of the at least one twist mechanism;

wherein the flexible bag includes a sealed interior chamber containing a plurality of packaging materials;

wherein the removal of air from the flexible bag causes the plurality of packaging materials to become compact.

11. The system of claim 10, wherein the flexible bag is removably attached to an interior surface of the bottom component of the case.

12. The system of claim 10, wherein rotation of the air intake valve allows or prevents air from flowing into the flexible bag.

13. The system of claim 10, wherein the flexible bag conforms to the interior surface of the bottom component of the case.

14. The system of claim 10, wherein the flexible bag substantially covers the interior surface of the bottom component of the case.

15. The system of claim 10, wherein an end of the at least one bead replacement pod opposite that of the opening includes a removable cap, and wherein the removable cap, when attached, covers a second opening of the at least one bead replacement pod.

16. The system of claim 10, wherein the flexible bag is operable to be connected to and inflated by the pump.

17. The system of claim 10, wherein the at least one bead containment pod is attached to at least one secondary pump operable to pull beads from an interior section of the flexible bag into the at least one bead containment pod.

18. The system of claim 10, wherein the top component of the case includes a foam layer attached to an interior surface of the top component.

19. A system for packing an object, comprising:

a case having a top component and a bottom component;

a retaining element including a flexible bag, wherein the flexible bag includes an air intake valve; and a pump operable to remove air from the bag;

includes a hollow tube with an opening to one side;

wherein at least one pipe extends outwardly from an exterior surface of the flexible bag;

wherein at least one opening is defined through the at least one pipe, such that the opening connects an interior region of the flexible bag to a space outside the flexible bag;

wherein at least one cap is attached to the at least one pipe by at least one living hinge, and wherein the at least one cap is configured to close the at least one opening;

wherein the flexible bag includes a sealed interior chamber containing a plurality of packaging materials; and wherein the removal of air from the flexible bag causes the plurality of packaging materials to become compact.

* * * * *